US010600625B2

(12) United States Patent
Quaas et al.

(10) Patent No.: US 10,600,625 B2
(45) Date of Patent: Mar. 24, 2020

(54) METHOD OF CALIBRATING A MASS SPECTROMETER

(71) Applicant: Thermo Fisher Scientific (Bremen) GmbH, Bremen (DE)

(72) Inventors: Norbert Quaas, Bremen (DE); Hans-Juergen Schlueter, Bremen (DE); Gerhard Jung, Delmenhorst (DE)

(73) Assignee: Thermo Fisher Scientific (Bremen) GMBH, Bremen (DE)

( * ) Notice: Subject to any disclaimer, the term of this patent is extended or adjusted under 35 U.S.C. 154(b) by 0 days.

(21) Appl. No.: 15/675,125

(22) Filed: Aug. 11, 2017

(65) Prior Publication Data

US 2018/0047549 A1 Feb. 15, 2018

(30) Foreign Application Priority Data

Aug. 12, 2016 (GB) ..... 1613890.1

(51) Int. Cl.
*H01J 49/36* (2006.01)
*H01J 49/40* (2006.01)
(Continued)

(52) U.S. Cl.
CPC ..... *H01J 49/0009* (2013.01); *H01J 49/36* (2013.01); *H01J 49/40* (2013.01); *H01J 49/4215* (2013.01); *H01J 49/4225* (2013.01)

(58) Field of Classification Search
CPC .... H01J 49/0009; H01J 49/0036; H01J 49/40; H01J 49/4215; H01J 49/425;
(Continued)

(56) References Cited

U.S. PATENT DOCUMENTS 8,269,166 B2 9/2012 Okumura
8,384,022 B1 * 2/2013 Remes ..... H01J 49/4225 250/252.1
(Continued)

FOREIGN PATENT DOCUMENTS

CN 102308361 A 1/2012
CN 103460332 A 12/2013
WO WO03103006 A2 12/2003

OTHER PUBLICATIONS

Garofolo, F., "LC-MS Instrument Calibration", Harvard Apparatus U.K., [online], available from:http://www.harvardapparatus.eo.uk/hapdfs/HAUK_DOCCAT_I_2/PP145.pdf [Accessed Dec. 15, 2016], See section 13.3.2, 2004.

*Primary Examiner* — David A Vanore

(57) ABSTRACT

A method of calibrating a mass spectrometer is disclosed. The mass spectrometer includes a first quadrupole, a second mass analyzer and a detection means. The method includes calibrating the second mass analyzer at a first time, calibrating the first quadrupole at a second time later than the first including a) determining for each of several selected masses a corresponding value of the amplitude of the RF voltage and DC voltage applied to the electrodes of the first quadrupole, b) fitting a function of the selected mass to the values of the amplitude of the RF voltage and DC voltage corresponding to the several selected masses, c) detecting the selected mass in a filter window width over a mass range, d) evaluating a shift of the peak position and/or a deviation of the filter window width, and e) repeating the calibration steps under certain conditions.

51 Claims, 13 Drawing Sheets

(51) Int. Cl.
*H01J 49/00* (2006.01)
*H01J 49/42* (2006.01)

(58) Field of Classification Search
CPC .... H01J 49/0031; H01J 49/004; H01J 49/164; H01J 49/26; H01J 49/36; H01J 49/4225; B01L 2200/0652; B01L 2200/0668; B01L 2200/12; B01L 2300/12; B01L 2230/06; B01L 2400/043; B01L 3/502761
USPC ..... 250/281, 282, 252.1, 287, 288, 290, 291
See application file for complete search history.

(56) References Cited

U.S. PATENT DOCUMENTS

| | | | | |
|---|---|---|---|---|
| 8,698,072 | B2 | 4/2014 | Sugawara et al. | |
| 8,704,164 | B2 * | 4/2014 | Bateman | H01J 49/0031 250/282 |
| 9,202,676 | B2 * | 12/2015 | Campbell | H01J 49/4215 |
| 9,697,995 | B2 * | 7/2017 | Bateman | H01J 49/0031 |
| 9,878,327 | B2 * | 1/2018 | Smith | B01L 3/502761 |
| 9,984,864 | B2 * | 5/2018 | Rather | H01J 49/429 |
| 10,083,825 | B2 * | 9/2018 | Bateman | H01J 49/0031 |
| 2011/0057095 | A1 * | 3/2011 | Loboda | H01J 49/0031 250/282 |
| 2011/0240841 | A1 * | 10/2011 | Lange | H01J 49/0036 250/282 |
| 2013/0151190 | A1 * | 6/2013 | Platt | H01J 49/0009 702/123 |
| 2014/0361159 | A1 * | 12/2014 | Pfaff | H01J 49/0036 250/282 |
| 2017/0154169 | A1 * | 6/2017 | Paschke | G01N 30/7266 |
| 2018/0047549 | A1 * | 2/2018 | Quaas | H01J 49/0009 |

* cited by examiner

Calibration of the mass selecting mode of the first quadrupole (step ii) Part 1

260

Setting of the calibration parameters:

Calibrated filter window width w: $w_{cal}$ = 10 u

Initial function of the amplitude of applied RF voltage: $RF_{ini}(m, w_{cal})$

Initial function of applied DC voltage: $DC_{ini}(m, w_{cal})$

Several selected masses $m_{cal}$ for voltage determination:

$m_{cal} \in M_{cal} = \{m_1, m_2, \ldots, m_n\}$

Some of the several selected masses $m_{check}$ for checking the fitted voltage functions:

$m_{check} \in M_{check}$; $M_{check} \subseteq M_{cal}$; $M_{check} = \{m_{check_1}, m_{check_2}, \ldots, m_{check_6}\}$ ; $6 \leq 8$ Assign to each of these masses $m_{check_i}$ a mass range to be scanned:

$\rho_{mass_m_check_i}$ (i = 1, 2, …, 6; comprising $m_{check_i}$; $\rho_{mass_m_check_i} > w_{cal}$):

Number of repetitions of the calibration: N=10; $N_{rep} = 0$ j = 0 j = j + 1

261

Step ii a): Voltage determination for several selected masses $m_{cal}$ $m_{cal} = m_j$ j = 1, 2, …, 8

Determination of

- the corresponding value of RF amplitude: $Rf_{det}(m_j)$
- the corresponding value of DC voltage: $DC_{det}(m_j)$ j < n j = n

271

262

Step ii b): Fitting of voltage functions:

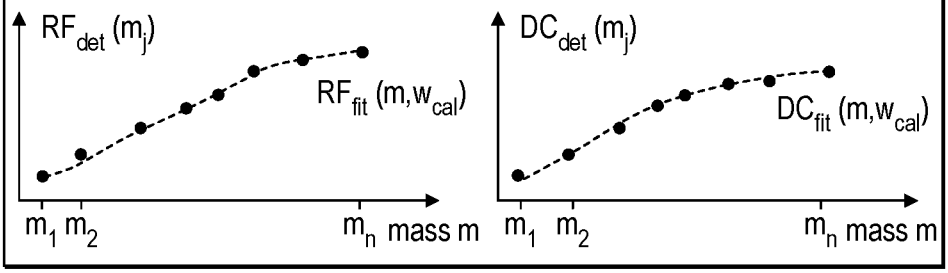

FIG. 11

METHOD OF CALIBRATING A MASS SPECTROMETER

CROSS-REFERENCE TO RELATED APPLICATION

This application claims the priority benefit under 35 U.S.C. § 119 to British Patent Application No. 1613890.1, filed on Aug. 12, 2016, the disclosure of which is incorporated herein by reference.

FIELD OF THE INVENTION

The invention belongs to the methods for calibrating of a mass spectrometer. The mass spectrometer comprises an ion source, a first mass analyzer being a first quadrupole, a second mass analyzer and a detection means to detect ions. The ions ejected from the ion source can be moved on trajectories to the detection means passing both mass analyzers in which they first pass the first quadrupole and afterwards the second mass analyzer.

BACKGROUND OF THE INVENTION

Normally mass spectrometers are able to separate charged particles in particular ions of atoms or molecules according to their mass-to-charge ratio m/z. That means that ions having the same mass-to-charge ratio m/z have same trajectories in at least parts of the mass spectrometers. For the simplification of the presentation in the following description and patent claims instead of the mass-to-charge ratio m/z only the term mass m will be used. So the term mass m will replace the correct term mass-to-charge ratio m/z. So the reader should take always into account that whenever the term mass m is used it is meant the mass to ratio-to-charge m/z. So for example a function f(m) is not a function of the mass m, it is a function of the mass ratio m/z (function f(m/z)). For example single charged ions $^{16}O^{+}$ and double charged ions $^{32}S^{++}$ have the same nominal mass-to-charge ratio 16. This means if in the further description a ion having mass 16 is mentioned both ions are described.

At the present the quadrupole mass analyzers of mass spectrometer are calibrated on its own to calibrate the RF voltage and a DC voltage which are applied to the electrodes of the quadrupole just if they are part a mass spectrometer having more than one mass analyzer like a triple quadrupole mass spectrometer comprising three quadrupoles. A quadrupole is operable as a pre-selecting mass analyzer in a mass selecting mode selecting masses in a mass filter window having a filter window width w. For this mode for the amplitude of the applied RF voltage a first function RF(m, w) of a selected mass m and the filter window width w and the applied DC voltage a second function DC(m, w) of the selected mass m and the filter window width w has to be defined by a calibration process. Typically during the calibration of a mass analyzer the analyzer is scanning several calibration masses in one run and afterwards certain parameters of the first function RF(m, w) and the second function DC(m, w) are adjusted by a fitting process. Very often for this fitting there is assumed for the functions RF(m, w) and DC(m, w) a specific function whose flexible parameters can be only changed by fitting the whole scan result to the specific function. Hereby the fitting is very inflexible because functions deviating from the assumed specific function are not possible and excluded be better calibration functions.

By this kind of calibration mass scans over the whole mass range of the calibration masses have to be repeated as long as the calibration functions RF(m, w) and DC(m, w) do not fulfill the required quality conditions.

Mostly these calibration processes are only successful—particularly after a few runs and therefore a short time—if good priority assumptions for the calibrations functions can be made at the beginning of the calibration. Depending on the technical detail of a quadrupole this is not possible for any construction of a quadrupole.

Further on during a mass scan of the calibration process over a mass range there can be detected outliers in the scan resulting from technical instabilities which are not always avoidable. These outliers lead to failure in the calibration process and the calibration results.

It is the object of the invention to improve the calibration of mass spectrometers having at least two mass analyzers. The improved method for calibrating a mass spectrometer shall be faster than the methods of the state of art. Further on the improved method for calibrating a mass spectrometer shall be more robust because it shall be e.g. more independent on the choice of start conditions of the calibration. Further on it is object to define a method for calibrating a mass spectrometer which is flexible. This means that the method may e.g. not relate on start conditions and is able to run with various fitting algorithms and fitting functions to find calibration curves. Another object of the invention was to find a method of calibration which is able to use calibration masses for the calibration having overlapping signals in the operation mode of the mass analyzer which shall be calibrated.

SUMMARY OF THE INVENTION

The above mentioned objects are solved by a new method for calibrating a mass spectrometer comprising an ion source, a first mass analyzer being a first quadrupole, a second mass analyzer and a detection means to detect ions according to claim 1. In this mass spectrometer ions are ejected from the ion source and can be moved on trajectories to the detection means passing both mass analyzers in which they first pass the first quadrupole and afterwards the second mass analyzer or vice versa. The first quadrupole is operable as a pre-selecting mass analyzer in a mass selecting mode selecting masses in a mass filter window having a filter window width w, in which a RF voltage and a DC voltage are applied to electrodes of the first quadrupole, the amplitude of the RF voltage being a first function RF(m, w) of a selected mass m and the filter window width w and the DC voltage being a second function DC(m, w) of the selected mass m and the filter window width w.

The new method of calibrating comprises the steps:

i) calibrating the second mass analyzer at a first time $t_1$, ii) calibrating the first quadrupole in the mass selecting mode selecting masses in the mass filter window having the filter window width $w_{cal}$ at a second time $t_2$ later than the first time $t_1$ when the second mass analyzer is operated in a mass analysing mode.

This calibrating the first quadrupole in the mass selecting mode selecting masses in the mass filter window having the filter window width $w_{cal}$ comprising the following steps during the second mass analyzer is operated in a mass analysing mode:

ii a) determining individually for each of several selected masses $m_{cal}$ a corresponding value of the amplitude of the RF voltage $RF_{det}(m_{cal})$ and value of DC voltage $DC_{det}(m_{cal})$ applied to the electrodes of the first quadrupole, ii b) fitting a function $RF_{fit}(m, w_{cal})$ of the selected mass m to the values of the amplitude of the RF voltage $RF_{det}(m_{cal})$ corresponding to the several selected masses $m_{cal}$ and fitting a function $DC_{fit}(m, w_{cal})$ of the selected mass m to the values of DC voltages $DC_{det}(m_{cal})$ corresponding to the several selected masses $m_{cal}$, ii c) for some masses and/or at least some of the several selected masses $m_{check}$ detecting the mass $m_{check}$ at the detection means via the second analyzer operating in a mass analysing mode during scanning the first quadrupole operating as pre-selecting analyzer in the mass selecting mode selecting masses in the mass filter window having the filter window width $w_{cal}$ over a mass range $\rho_{mass_m_check}$ assigned to the selected mass $m_{check}$, comprising the mass $m_{check}$ and being larger than the filter window width $w_{cal}$ of the mass filter window of the mass selecting mode of the first quadrupole, the amplitude of the RF voltage applied to the electrodes of the first quadrupole given by the function $RF_{fit}(m, w_{cal})$ and the DC voltage applied to the electrodes of the first quadrupole given by the function $DC_{fit}(m, w_{cal})$, ii d) evaluating for each of these detected masses $m_{check}$ a shift of the peak position $\Delta m(m_{check})$ and/or a deviation of the filter window width $\Delta w(m_{check})$ of the mass selecting mode of the first quadrupole selecting masses in the mass filter window having the filter window width $w_{cal}$, when applying the RF voltage with the amplitude given by the function $RF_{fit}(m, w_{cal})$ and the DC voltage given by the function $DC_{fit}(m, w_{cal})$, ii e) if the evaluated values of the shift of the peak position $\Delta m(m_{check})$ and/or the deviation of the filter window width $\Delta w(m_{check})$ of the detected masses $m_{check}$ do not comply with a quality condition of the calibration or if another repetition condition is fulfilled, repeating the calibration steps ii a) to ii e) using in step ii a) in the mass selecting mode of the first quadrupole the functions $RF_{fit}(m, w_{cal})$ as the first function RF(m, w) and $DC_{fit}(m, w_{cal})$ as the second function DC(m, w) until all quality conditions of the calibration are fulfilled and no repetition condition is fulfilled or the calibration steps ii a) to ii e) have been executed N times.

The invention provides a new method for calibrating a mass spectrometer. Mass spectrometer in general comprise at least an ion source, a mass analyzer in which the ions are separated according to their mass (as illustrated above correctly they are separated according to their mass-to-charge ratio m/z) and detection means to detect the separated ions. This detection can be done by measuring the amount of ions having a specific mass or signals of the ions which can be evaluated to get the information about the mass of the ions and the amount of ions having a specific mass (e.g. by Fourier transformation). Mass spectrometer, which can be calibrated by the inventive method, has at least two mass analyzers. In this mass spectrometer ions which are ejected from the ion source can be moved on trajectories to the detection means wherein passing at least two mass analyzers of the mass spectrometer, a first mass analyzer and a second mass analyzer. The ions first pass the first mass analyzer, which is a quadrupole—in the following named the first quadrupole—and afterwards the second mass analyzer or vice versa. The first quadrupole is operable as a pre-selecting mass analyzer in a mass selecting mode. In this mode the first quadrupole selecting masses in a mass filter window having a filter window width w. This means that only ions are able to pass the first quadrupole which have a mass in a specific mass range, the mass filter window. The filter window width w of the first quadrupole is the width of the specific mass range of ions able to pass the first quadrupole. So if the first quadrupole is operated as a pre-selecting mass analyzer, by the first quadrupole the ions generated by the ion source are pre-selected and only ions having a mass in the mass filter window can pass the first quadrupole and reach afterwards the second mass analyzer. To operate the first quadrupole a RF voltage and a DC voltage are applied to electrodes of the first quadrupole. In the mass selecting mode of the first quadrupole the amplitude of the RF voltage is a first function RF(m, w) of a selected mass m and the filter window width w and the DC voltage is a second function DC(m, w) of the selected mass m and the filter window width w. The frequency of the RF voltage which is applying radiofrequency electromagnetic field to the electrodes of the quadrupole is fixed for the quadrupole during its operation and in the range of 1 MHz up to 15 MHz, preferably in the range of 2 MHz up to 6 MHz and particularly in the range of 3 MHz up to 5 MHz.

The method for calibrating a mass spectrometer according to the invention comprises two steps of calibrating.

At the first step the second mass analyzer has to be calibrated. The second mass analyzer has at least to be calibrated in a mass analysing mode. In this mode the second mass analyzer is mass selective so that ions of a specific mass can be separately detected by the detection means. In this resolution mode of the second mass analyzer the analyzer has a high resolution to separate the masses of the detected ions. The calibration of the second mass analyzer is done by calibration methods being state of the art. During the calibration of the second mass analyzer the first quadrupole is preferably operated in a transmission mode, that is in a non-mass-selective mode so that all ions from the ion source can reach the second mass analyzer.

At the second step the first quadrupole is calibrated in the mass selecting mode. This calibration has to be done for a specific filter window width $w_{cal}$ of the mass filter window of the mass selecting mode. So the calibrated first quadrupole shall select in the mass selecting mode ions with masses in a mass filter window having the filter window width $w_{cal}$. During the calibration of the quadrupole according to the invention the second mass analyzer is operated in a mass analysing mode. Therefore it is important that in the first step of the inventive method the second mass analyzer has been calibrated.

According to the invention the calibration of the second mass analyzer has executed before the first quadrupole is calibrated in the mass selecting mode. So the second mass analyzer has to be calibrated at a first time $t_1$, and at a second time $t_2$ later than the first time $t_1$ the first quadrupole has to be calibrated in the mass selecting mode. So calibration of both mass analyzers can be executed directly one after the other, so that the time difference between the first time $t_1$ and the second time $t_2$ can be very short, like seconds, minutes or hours. On the other hand the calibration of the second mass analyzer can be done only at the setup of the mass spectrometer and the calibration of the first quadrupole can be done later, e.g. when the mass spectrometer is installed at the end user. Additionally the calibration of the first quadrupole can be repeated time by time. A preceding or another calibration of the second mass analyzer might not be necessary.

The inventive method for calibrating a mass spectrometer comprising the following steps for the calibrating the first quadrupole in the mass selecting mode:

In a first step of the calibration of the first quadrupole ii a) for several masses $m_{cal}$ which shall be selected by the first quadrupole in the mass selecting mode the amplitude of the RF voltage and DC voltage is determined which has to be applied to the electrodes of the first quadrupole so that the mass $m_{cal}$ is selected by the first quadrupole in the middle of the mass filter window which has the intended filter window width $w_{cal}$. This determination is executed individually for each of several selected masses $m_{cal}$ one after the other. Typically these several selected masses $m_{cal}$ being calibration masses for defining reference points of suitable values of the amplitude of the RF voltage and DC voltage are defined in a parameter set for a suitable calibration. So a number of n calibration masses are defined as the several selected masses. Accordingly the defined calibration masses result in a set $M_{cal}$ of calibration masses $m_{cal}$ containing the masses $m_1, m_2, m_3 \ldots, m_n$.

$$m_{cal} \in M_{cal} = \{m_1, m_2, \ldots, m_n\}$$

For each of the several selected masses $m_{cal}$ a corresponding value of the amplitude of the RF voltage $RF_{det}(m_{cal})$ and value of DC voltage $DC_{det}(m_{cal})$ is determined. If the corresponding RF voltage and DC voltage applied to the electrodes of the first quadrupole, masses are selected by the first quadrupole in a mass filter window having in the middle the selected mass $m_{cal}$ and the filter window width $w_{cal}$. So for each mass $m_j$ (j=1, 2, 3, . . . , n) of set $M_{cal}$ of calibration masses $m_{cal}$a corresponding value of the amplitude of the RF voltage $RF_{det}(m_j)$ and value of DC voltage $DC_{det}(m_j)$ is determined.

In a next step of the calibration of the first quadrupole ii b) functions are fitted to the reference points determined for the calibration masses in the step described before. A function $RF_{fit}(m, w_{cal})$ of the selected mass m is fitted to the values of the amplitude of the RF voltage $RF_{det}(m_{cal})$ corresponding to the several selected masses $m_{cal}$ and a function $DC_{fit}(m, w_{cal})$ of the selected mass m is fitted to the values of DC voltages $DC_{det}(m_{cal})$ corresponding to the several selected masses $m_{cal}$. The function $RF_{fit}(m, w_{cal})$ of the selected mass m is fitted to the value of the amplitude of the RF voltage $RF_{det}(m_j)$ of each mass $m_j$ (j=1, 2, 3, . . . , n) of set $M_{cal}$ of calibration masses $m_{cal}$. The function $DC_{fit}(m, w_{cal})$ of the selected mass m is fitted to value of DC voltage $DC_{det}(m_j)$ of each mass $m_j$ (j=1, 2, 3, . . . , n) of set $M_{cal}$ of calibration masses $m_{cal}$.

In a next step of the calibration of the first quadrupole ii c) the fit of the functions fitted in the step above is checked. This check is performed for some masses and/or at least some of the several selected masses $m_{check}$. These masses $m_{check}$ may belong to the several masses $m_{cal}$ for which in the foregoing step ii a) the RF voltage and DC voltage has been determined. In one embodiment the check is performed for all masses $m_{cal}$ for which in the foregoing step ii a) the RF voltage and DC voltage has been determined. In other embodiments the check is performed for some of the masses $m_{cal}$ for which in the foregoing step ii a) the RF voltage and DC voltage has been determined. So the set $M_{check}$ of masses $m_{check}$ for which the check is performed may be the set $M_{cal}$ of calibration masses $m_{cal}$ or a subset of the set $M_{cal}$ of calibration masses $m_{cal}$.

$$m_{check} \in M_{check};\ M_{check} \subseteq M_{cal}$$

If for k masses $m_{check}$ the check is performed the set $M_{check}$ of masses $m_{check}$ is:

$$M_{check} = \{m_{check_1}, m_{check_2}, \ldots, m_{check_k}\};\ k \leq n$$

For each mass $m_{check_i}$ (i=1, 2, 3, . . . , k) of set $M_{check}$ of masses $m_{check}$ the check is performed. In general these masses $m_{check_i}$ may belong to the several selected masses $m_{cal}$, may belong partially to the several selected masses $m_{cal}$ or may not belong to the several selected masses $m_{cal}$.

The masses $m_{check}$ for which the check is performed are detected at the detection means via the second analyzer operating in a mass analysing mode during scanning the first quadrupole operating as pre-selecting analyzer in the mass selecting mode selecting masses in the mass filter window having the filter window width $w_{cal}$ over a mass range $\rho_{mass_m_check}$ assigned to the mass $m_{check}$, comprising the selected mass $m_{check}$ and being larger than the filter window width $w_{cal}$ of the mass filter window of the mass selecting mode of the first quadrupole. The amplitude of the RF voltage applied to the electrodes of the first quadrupole is given by the function $RF_{fit}(m, w_{cal})$ and the DC voltage applied to the electrodes of the first quadrupole is given by the function $DC_{fit}(m, w_{cal})$.

So each mass $m_{check_i}$ (i=1, 2, 3, . . . , k) of set $M_{check}$ of masses $m_{check}$ is one after the other detected at the detection means via the second analyzer operating in a mass analysing mode during scanning the first quadrupole operating as pre-selecting analyzer in the mass selecting mode selecting masses in the mass filter window having the filter window width $w_{cal}$ over a mass range $\rho_{mass_m_check_i}$ assigned to the selected mass $m_{check_i}$. This mass range $\rho_{mass_m_check_i}$ comprises the selected mass $m_{check_i}$ and is larger than the filter window width $w_{cal}$ of the mass filter window of the mass selecting mode of the first quadrupole. During the scanning of the first quadrupole the amplitude of the RF voltage applied to the electrodes of the first quadrupole is given by the function $RF_{fit}(m, w_{cal})$ and the DC voltage applied to the electrodes of the first quadrupole is given by the function $DC_{fit}(m, w_{cal})$.

In a next step of the calibration of the first quadrupole ii d) the check of the fitted functions $RF_{fit}(m, w_{cal})$ and $DC_{fit}(m, w_{cal})$ is evaluated. For each of these detected selected masses $m_{check}$ a shift of the peak position $\Delta m(m_{check})$ and/or a deviation of the filter window width $\Delta w(m_{check})$ of the mass selecting mode of the first quadrupole selecting masses in the mass filter window having the filter window width $w_{cal}$, when applying the RF voltage with the amplitude given by the function $RF_{fit}(m, w_{cal})$ and the DC voltage given by the function $DC_{fit}(m, w_{cal})$, is evaluated. By the parameters shift of the peak position $\Delta m(m)$ and/or a deviation of the filter window width $\Delta w(m)$ it shall be determined how big is the deviation of the mass peaks of the detected selected masses $m_{check}$ in the detection means when the first quadrupole operating as pre-selecting analyzer in the mass selecting mode selecting masses in the mass filter window having the filter window width $w_{cal}$ is scanned over the mass range $\rho_{mass_m_check}$ assigned to the mass $m_{check}$ from the expected mass peak of the detected masses $m_{check}$ when this detected masses $m_{check}$ is in the center of the mass filter window of the first quadrupole and the filter mass window has the filter window width $w_{cal}$. The filter mass window of the first quadrupole is mapped on the detector means by the mass analysing mode of the second analyzer during scanning the mass range $\rho_{mass_m_check}$ by the first quadrupole. This may be a convolution of the mass filter window of the first quadrupole with the mass filter window of the second analyzer operating in the mass analyzing mode. Mostly the filter window width $w_2$ of the mass filter window of the second mass analyzer operating in the mass analysing mode is lower than 1 u. Typically the filter window width $w_2$ of the mass filter window of the second mass analyzer operating in the mass analysing mode is between 0.5 u and 1 u, preferably between 0.6 u and 0.9 u and particular preferably between 0.65 u and 0.85 u. Depending on the mass analyzer the filter window width $w_2$ can also been chosen much smaller.

For each mass $m_{check_i}$ (i=1, 2, 3, . . . , k) of set $M_{check}$ of masses $m_{check}$ a shift of the peak position $\Delta m(m_{check_i})$ and/or a deviation of the filter window width $\Delta w(m_{check_i})$ of the mass selecting mode of the first quadrupole selecting masses in the mass filter window having the filter window width $w_{cal}$, when applying the RF voltage with the amplitude given by the function $RF_{fit}(m, w_{cal})$ and the DC voltage given by the function $DC_{fit}(m, w_{cal})$, is evaluated.

In a next step of the calibration of the first quadrupole ii e) a decision about the repetition of the calibration has to be defined. It is decided to repeat the calibration steps ii a) to ii e) if the evaluated values of the shift of the peak position $\Delta m(m_{check})$ and/or the deviation of the filter window width $\Delta w(m_{check})$ of the detected selected masses $m_{check}$ do not comply with a quality condition of the calibration or if another repetition condition is fulfilled. By such a quality condition can be made sure that when a RF voltage with an amplitude given by the function $RF_{fit}(m, w_{cal})$ as calibration function and a DC voltage given by the function $DC_{fit}(m, w_{cal})$ as calibration function are applied to electrodes of the first quadrupole that the shift of the peak position $\Delta m(m_{check})$ does not exceed a threshold value $\Delta m_{max}$ and/or the deviation of the filter window width $\Delta w(m_{check})$ does not exceed a threshold value $\Delta w_{max}$. These threshold values $\Delta m_{max}$ and $\Delta w_{max}$ max be the same for all detected masses $m_{check}$. In another embodiment there may be different threshold values $\Delta m_{max_i}$ and $\Delta w_{max_i}$ for different detected masses $m_{check_i}$. In other embodiments of the invention the quality condition may be that only for a specific number of detected selected masses $m_{check}$ $\Delta m(m_{check})$ does not exceed a threshold value $\Delta m_{max}$ and/or the deviation of the filter window width $\Delta w(m_{check})$ does not exceed a threshold value $\Delta w_{max}$. Also in this embodiment there may be different threshold values $\Delta m_{max_i}$ and $\Delta w_{max_i}$ for different detected selected masses $m_{check_i}$.

It is therefore decided to repeat the calibration steps ii a) to ii e) if the evaluated values of the shift of the peak position $\Delta m(m_{check_i})$ and/or the deviation of the filter window width $\Delta w(m_{check_i})$ of the masses $m_{check_i}$ (i=1, 2, 3, . . . , k) of set $M_{check}$ of masses $m_{check}$ do not comply with a quality condition of the calibration or if another repetition condition is fulfilled.

During the repetition of the calibration steps ii a) to ii e) in step ii a) in the mass selecting mode of the first quadrupole the functions $RF_{fit}(m, w_{cal})$ as the first function RF(m, w) and $DC_{fit}(m, w_{cal})$ as the second function DC(m, w) are used.

The repetition of the calibration steps ii a) to ii e) is executed according to the decision until all quality conditions of the calibration are fulfilled and no repetition condition is fulfilled or the calibration steps ii a) to ii e) have been executed N times.

If all quality conditions of the calibration are fulfilled and no repetition condition is fulfilled the calibration by the steps ii a) to ii e) is finished and a RF voltage with an amplitude given by the function $RF_{fit}(m, w_{cal})$ as calibration function and a DC voltage given by the function $DC_{fit}(m, w_{cal})$ as calibration function is applied to electrodes of the first quadrupole afterwards during the measurement with the mass spectrometer calibrated with the method according to the invention. So the functions function $RF_{fit}(m, w_{cal})$ and $DC_{fit}(m, w_{cal})$ fitted in the last step ii b) have been defined as suitable calibration functions with which the first quadrupole can be operated as a pre-selecting mass analyzer in a mass selecting mode selecting masses in a mass filter window having a filter window width $w_{cal}$.

If on the other hand the calibration steps ii a) to ii e) have been executed N times and after that not all quality conditions of the calibration are fulfilled or a repetition condition is fulfilled the calibration is stopped because it was not successful. In this case the inventive method for calibrating a mass spectrometer may be started again having a different setting of the calibration parameters like different initial functions of the amplitude of the RF voltage $RF_{ini}(m, w_{cal})$ and the DC voltage $DC_{ini}(m, w_{cal})$, a new set of the several selected masses $M_{cal}$ to determine individually corresponding value of the amplitude of the RF voltage $RF_{det}(m_{cal})$ and value of DC voltage $DC_{det}(m_{cal})$ applied to the electrodes of the first quadrupole, a new set of masses $M_{check}$ for which the check of the fitted functions $RF_{fit}(m, w_{cal})$ and $DC_{fit}(m, w_{cal})$ is performed, a new fitting procedure using e.g. a modified fitting function or another fitting algorithm, new quality conditions or repetition conditions or an higher number of possible repetitions N of the calibration steps.

In an embodiment of the invention the first quadrupole of the mass spectrometer can be operated also in a non-selective transmission mode.

The detection means of the mass spectrometer may be a detector which is separated from the second mass analyzer.

In another embodiment the detection means of the mass spectrometer is detecting an image current induced by the ions.

The second mass analyzer may be a second quadrupole. This second quadrupole may be operated also in a non-selective transmission mode.

In another embodiment of the invention the mass spectrometer may comprise a third quadrupole. During the calibration of the first quadrupole in the mass selecting mode the third quadrupole may be operated in a transmission mode. The third quadrupole may be operable also in a mass selecting mode.

The second mass analyzer may be a time-of-flight mass analyzer or an ion trap. This ion trap may be an orbitrap or an ion cyclotron resonance cell. In another embodiment the second mass analyzer may be a magnetic and/or electric sector analyzer.

In an embodiment of the invention the mass spectrometer comprises a reaction cell, which is located between the first quadrupole and the second mass analyzer and is passed by the ions ejected from ion source which can be moved on trajectories to the detection means. This reaction cell may be a collision and/or fragmentation cell. The reaction in the reaction cell may be an electron capture dissociation, an electron-transfer dissociation, oxidation, hydridisation, clustering or complex reaction. The reaction cell may comprise a quadrupole or a hexapole, a octopole, a higher order multipole device or a stacked ring ion guide. During the calibrating of the second mass analyzer (step i)) the quadrupole of the reaction cell may be operated in a transmission mode.

During the calibrating of the second mass analyzer (step i)) the first quadrupole may be operated in a transmission mode in which ions are not mass selected. In the transmission mode of the first quadrupole only a RF voltage with an amplitude given by a function $RF_{trans}(m_{trans})$ of a transmitted mass $m_{trans}$ may be applied to the first quadrupole. During the calibrating of the second mass analyzer (step i)) the quadrupole of a reaction cell may be operated in a transmission mode.

In the transmission mode of the quadrupole of the reaction cell only a RF voltage with an amplitude given by a function $RF_{Rc,trans}(m_{trans})$ of a transmitted mass $m_{trans}$ may be applied to the quadrupole of the reaction cell.

In another embodiment only a RF voltage with an amplitude given by a function $RF_{Rc,trans}(m_{trans})$ of a transmitted mass $m_{trans}$ may be applied to a hexapole, a octopole, a higher order multipole device or a stacked ring ion guide of a reaction cell.

The first quadrupole may be calibrated in the mass selecting mode to have a filter window width $w_{cal}$ between 2 u and 30 u, preferably to have a filter window width $w_{cal}$ between 5 u and 20 u and particular preferably to have a filter window width $w_{cal}$ between 8 u and 15 u.

In an embodiment of the inventive method the step ii) of calibrating the first quadrupole in the mass selecting mode is repeated several times for different values of the filter window width $w_{cal}$ in the range between 2 u and 30 u, preferable in the range between 5 u and 20 u and particular preferable in the range between 8 u and 15 u.

Preferable at the beginning of the calibration of the first quadrupole in the mass selecting mode an initial function $RF_{ini}(m, w_{cal})$ is used for the first function $RF(m, w_{cal})$ and an initial function $DC_{ini}(m, w_{cal})$ for the second function $DC(m, w_{cal})$.

Preferable for two selected masses $m_{coarse}$ a corresponding value of the amplitude of the RF voltage $RF_{det}(m_{coarse})$ and value of DC voltage $DC_{det}(m_{coarse})$ is determined individually before for several selected masses $m_{cal}$ a corresponding value of the amplitude of the RF voltage $RF_{det}(m_{cal})$ and value of DC voltage $DC_{det}(m_{cal})$ is determined individually (step ii a)). In particular the two selected masses $m_{coarse}$ for which a corresponding value of the amplitude of the RF voltage $RF_{det}(m_{coarse})$ and value of DC voltage $DC_{det}(m_{coarse})$ is determined individually before for several selected masses $m_{cal}$ a corresponding value of the amplitude of the RF voltage $RF_{det}(m_{cal})$ and value of DC voltage $DC_{det}(m_{cal})$ is determined individually are the masses of the molecules $^{16}O^{40}Ar$ and $^{40}Ar^{40}Ar$.

After for the two selected masses $m_{coarse}$ a corresponding value of the amplitude of the RF voltage $RF_{det}(m_{coarse})$ and value of DC voltage $DC_{det}(m_{coarse})$ is determined individually, a function $RF_{coarse}(m, w_{cal})$ being a summation of a constant value $RFoffset_{2_fit}$ and a linear function of the selected mass m may be fitted to the values of the amplitudes of the RF voltage $RF_{det}(m_{coarse})$ corresponding to the two selected masses $m_{coarse}$ and/or a function $DC_{coarse}(m, w_{cal})$ being a summation of a constant value $DCoffset_{2_fit}$ and a linear function of the selected mass m may be fitted to the values of DC voltages $DC_{det}(m_{coarse})$ corresponding to the two selected masses $m_{coarse}$.

In another embodiment after for the two selected masses $m_{coarse}$ a corresponding value of the amplitude of the RF voltage $RF_{det}(m_{coarse})$ and value of DC voltage $DC_{det}(m_{coarse})$ is determined individually, a function $RF_{coarse}(m, w_{cal})$ of the selected mass m may be fitted to the values of the amplitudes of the RF voltage $RF_{det}(m_{coarse})$ corresponding to the two selected masses $m_{coarse}$ by changing a linear factor RFlinear and/or a constant offset value RFoffset of the initial function $RF_{ini}(m, w_{cal})$ and/or a function $DC_{coarse}(m, w_{cal})$ of the selected mass m may be fitted to the values of DC voltage $DC_{det}(m_{coarse})$ corresponding to the two selected masses $m_{coarse}$ by changing a linear factor DClinear and/or a constant offset value DCoffset of the initial function $DC_{ini}(m, w_{cal})$.

In one embodiment of the invention the several selected masses $m_{cal}$, for which a corresponding value of the amplitude of the RF voltage $RF_{det}(m_{cal})$ and value of DC voltage $DC_{det}(m_{cal})$ is determined individually (step ii a)), are 4 to 18 selected masses $m_{cal}$, preferable 8 to 15 selected masses $m_{cal}$ and particular preferable 9 to 12 selected masses $m_{cal}$.

In an embodiment of the invention during the individual determination of the corresponding value of the amplitude of the RF voltage $RF_{det}(m_{cal})$ and value of DC voltage $DC_{det}(m_{cal})$ to a selected mass $m_{cal}$ the second mass analyzer is filtering the selected mass $m_{cal}$. In an preferred embodiment during the individual determination of the corresponding value of the amplitude of the RF voltage $RF_{det}(m_{cal})$ and value of DC voltage $DC_{det}(m_{cal})$ to a selected mass $m_{cal}$ the second quadrupole is set to filter the selected mass $m_{cal}$ by selecting masses m in a mass filter window having a filter window width $w_2$ between 0.5 u and 1 u, preferable by selecting masses m in a mass filter window having a filter window width $w_2$ between 0.6 u and 0.9 u and particular preferable by selecting masses m in a mass filter window having a filter window width $w_2$ between 0.65 u and 0.85 u.

In one embodiment of the invention the filter window width w of the first quadrupole is increased when the selected mass $m_{cal}$ is not transmitted by the second analyzer and detected by the detection means during the individual determination of the corresponding value of the amplitude of the RF voltage $RF_{det}(m_{cal})$ and value of DC voltage $DC_{det}(m_{cal})$ to the selected mass $m_{cal}$. Preferably the filter window width w of the first quadrupole is at least doubled.

In another embodiment of the invention the DC voltage applied to the electrodes of the first quadrupole is decreased stepwise or the amplitude of the AC voltage applied to the electrodes of the first quadrupole is increased stepwise until the selected mass $m_{cal}$ is detected by the second analyzer when the selected mass $m_{cal}$ is not detected by the second analyzer during the individual determination of the corresponding value of the amplitude of the RF voltage $RF_{det}(m_{cal})$ and value of DC voltage $DC_{det}(m_{cal})$ to the selected mass $m_{cal}$, after the filter window width w of the first quadrupole is extended. In particular the DC voltage applied to the electrodes of the first quadrupole may be decreased stepwise in that in the second function DC(m, w) which is defining the DC voltage, a constant offset value DCoffset is lowered stepwise until the selected mass is detected by the second analyzer.

In an embodiment of the invention the constant offset value DCoffset of the second function DC(m, w) is increased stepwise until the filter window width w of the first quadrupole is below a filter window width $w_{min}$ of the mass selecting mode to be calibrated, when the selected mass $m_{cal}$ is analysed by the second analyzer and detected by the detection means and the peak width w of the selected mass $m_{cal}$ is bigger than a first maximum peak width $w_{max}$.

In an embodiment of the invention during the individual determination of the corresponding value of the amplitude of the RF voltage $RF_{det}(m_{cal})$ and value of DC voltage $DC_{det}(m_{cal})$ to a selected mass $m_{cal}$ the first quadrupole is scanned over a mass range $\rho_{mass}$ comprising the selected mass $m_{cal}$ applying the RF amplitude and the DC voltage to the electrodes of the first quadrupole according to the first function $RF(m, w_{cal})$ and the a second function $DC(m, w_{cal})$ for the masses m of the mass range $\rho_{mass}$. After the scanning of the first quadrupole over the mass range $\rho_{mass}$ it may be evaluated for which masses $m_{set}$ of the mass range $\rho_{mass}$ when set at the first function of the amplitude of the $RF(m, w_{cal})$ and the second function of the DC voltage $DC(m, w_{cal})$ to apply the RF voltage and DC voltage at the first quadrupole the detection means is detecting the selected mass $m_{cal}$. After the evaluation at which masses $m_{set}$ of the mass range $\rho_{mass}$ the detection means is detecting the selected mass $m_{cal}$ the shift of the peak position $\Delta m(m_{cal})$ of the selected mass $m_{cal}$ may be evaluated. The evaluation of the shift of the peak position $\Delta m(m_{cal})$ of the selected mass $m_{cal}$ may be performed by calculating the difference between the mass $m_{set_c}$ at the center of the masses $m_{set}$ at which the detection means is detecting the selected mass $m_{cal}$ and the selected mass $m_{cal}$.

In an embodiment of the invention during the individual determination of the corresponding value of the amplitude of the RF voltage $RF_{det}(m_{cal})$ and value of DC voltage $DC_{det}(m_{cal})$ to a selected mass $m_{cal}$ the individual definition of a corresponding the amplitude of the RF voltage $RF_{det}(m_{cal})$ and DC voltage $DC_{det}(m_{cal})$ (step ii a)) of the selected mass $m_{cal}$ is done by changing the value of the first function $RF(m_{cal},w_{cal})$ and/or the value of the second function $DC(m_{cal}, w_{cal})$ corresponding to the selected mass $m_{cal}$ depending on the shift of the peak position $\Delta m(m_{cal})$ of the selected mass $m_{cal}$. The individual definition of a corresponding value of the amplitude of the RF voltage $RF_{det}(m_{cal})$ and value of the DC voltage $DC_{det}(m_{cal})$ of the selected mass $m_{cal}$ may be done by adding to the value of the first function $RF(m_{cal},w_{cal})$ and/or the value of the second function $DC(m_{cal},w_{cal})$ corresponding to the selected mass $m_{cal}$ the value the shift of the peak position $\Delta m(m_{cal})$ of the selected mass $m_{cal}$ multiplied with a factor corresponding to the amplitude of the RF voltage $RFfactor_{p_shift}$ and/or DC voltage $DCfactor_{p_shift}$.

$$RF(m_{cal},w_{cal})_{new}=RF(m_{cal},w_{cal})+RF\text{factor}_{p_shift}*\Delta m(m_{cal})$$

$$DC(m_{cal},w_{cal})_{new}=DC(m_{cal},w_{cal})+DC\text{factor}_{p_shift}*\Delta m(m_{cal})$$

In another embodiment the individual definition of a corresponding value of the amplitude of the RF voltage $RF_{det}(m_{cal})$ of the selected mass $m_{cal}$ is done by adding to the value of the first function $RF(m_{cal},w_{cal})$ corresponding to the selected mass $m_{cal}$ the value the shift of the peak position $\Delta m(m_{cal})$ of the selected mass $m_{cal}$ multiplied with a linear factor RFlinear of the first function $RF(m, w_{cal})$.

$$RF(m_{cal},w_{cal})_{new}=RF(m_{cal},w_{cal})+RF\text{linear}*\Delta m(m_{cal})$$

The linear factor RFlinear of the first function $RF(m, w_{cal})$ is the factor with which the mass m is multiplied if the function $RF(m, w_{cal})$ in a summation of different functions and one of the summed function is a linear function.

$$RF(m,w_{cal})=RF\text{linear}*m+f_1(m)+f_2(m)+\ldots.$$

In an embodiment of the invention the individual definition of a corresponding DC voltage $DC_{det}(m_{cal})$ of the selected mass $m_{cal}$ is done by adding to the value of the second function $DC(m_{cal},w_{cal})$ corresponding to the selected mass $m_{cal}$ the value the shift of the peak position $\Delta m(m_{cal})$ of the selected mass $m_{cal}$ multiplied with a linear factor DClinear of the second function $DC(m, w_{cal})$ divided by a linear factor RFlinear of the first function $RF(m, w_{cal})$.

$$DC(m_{cal},w_{cal})_{new}=DC(m_{cal},w_{cal})+DC\text{linear}/RF\text{linear}*\Delta m(m_{cal})$$

The linear factor DClinear of the second function $DC(m, w_{cal})$ is the factor with which the mass m is multiplied if the function $DC(m, w_{cal})$ in a summation of different functions and one of the summed function is a linear function.

$$DC(m,w_{cal})=DC\text{linear}*m+f_1(m)+f_2(m)+\ldots.$$

In an embodiment of the invention the deviation of the filter window width $\Delta w(m_{cal})$ of the selected mass $m_{cal}$ is evaluated after the evaluation at which masses $m_{set}$ of the mass range $\rho_{mass}$ the detection means is detecting the selected mass $m_{cal}$. Preferably the evaluation of the deviation of the filter window width $\Delta w(m_{cal})$ of the selected mass $m_{cal}$ is performed by evaluating a mass range $\rho_{massdetect}(m_{cal})$ of the masses $m_{set}$ set at the first function of the amplitude of the $RF(m, w_{cal})$ and the second function of the DC voltage $DC(m, w_{cal})$ to apply the RF voltage and DC voltage at the first quadrupole for which the detection means is detecting the selected mass $m_{cal}$ and calculating the difference $\Delta w(m_{cal})$ between the mass range $\rho_{massdetect}(m_{cal})$ and the filter window width $w_{cal}$ for which the first quadrupole has to be calibrated.

$$\Delta w(m_{cal})=\rho_{massdetect}(m_{cal})-w_{cal}$$

In a further preferred embodiment of the invention the evaluation of the mass range $\rho_{massdetect}(m_{cal})$ is performed by evaluating the masses $m_{set}$ set at the first function of the amplitude of the $RF(m, w_{cal})$ and the second function of the DC voltage $DC(m, w_{cal})$ to apply the RF voltage and DC voltage at the first quadrupole for which the detector means is detecting a signal higher than a minimum detection value. (Claim K3*a*B2)

In another preferred embodiment of the invention the evaluation of the mass range $\rho_{massdetect}(m_{cal})$ is performed by evaluating the masses $m_{set}$ set at the first function of the amplitude of the $RF(m, w_{cal})$ and the second function of the DC voltage $DC(m, w_{cal})$ to apply the RF voltage and DC voltage at the first quadrupole for which the detection means is detecting a signal which is higher than a percentage of the highest signal detected by the detection means. Preferable the evaluation of the mass range $\rho_{massdetect}(m_{cal})$ is performed by evaluating the masses $m_{set}$ set at the first function of the amplitude of the $RF(m, w_{cal})$ and the second function of the DC voltage $DC(m, w_{cal})$ to apply the RF voltage and DC voltage at the first quadrupole for which the detection means is detecting a signal which is higher than 40 percent of the highest signal detected by the detection means, in particular higher than 50 percent of the highest signal detected by the detection means.

In an embodiment of the invention during the individual determination of the corresponding value of the amplitude of the RF voltage $RF_{det}(m_{cal})$ and value of DC voltage $DC_{det}(m_{cal})$ to a selected mass $m_{cal}$ the individual definition of a corresponding the amplitude of the RF voltage $RF_{det}(m_{cal})$ and DC voltage $DC_{det}(m_{cal})$ (step ii a)) of the selected mass $m_{cal}$ is done by changing the value of the first function $RF(m_{cal}, w_{cal})$ and/or the value of the second function $DC(m_{cal}, w_{cal})$ corresponding to the selected mass $m_{cal}$ depending on the deviation of the filter window width $\Delta w(m_{cal})$ of the selected mass $m_{cal}$.

In an embodiment of the invention the individual determination of a corresponding value of the amplitude of the RF voltage $RF_{det}(m_{cal})$ and value of the DC voltage $DC_{det}(m_{cal})$ of the selected mass $m_{cal}$ is done by adding to the value of the first function $RF(m_{cal}, w_{cal})$ and/or the value of the second function $DC(m_{cal}, w_{cal})$ corresponding to the selected mass $m_{cal}$ the value the deviation of the filter window width $\Delta w(m_{cal})$ of the selected mass $m_{cal}$ multiplied with a factor corresponding to the RF voltage $\Delta w\text{-factor}_{RF}$ and/or DC voltage $\Delta w\text{-factor}_{DC}$.

$$RF(m_{cal},w_{cal})_{new}=RF(m_{cal},w_{cal})+\Delta w\text{-factor}_{RF}*\Delta w(m_{cal})$$

$$DC(m_{cal},w_{cal})_{new}=DC(m_{cal},w_{cal})+\Delta w\text{-factor}_{DC}*\Delta w(m_{cal})$$

In an embodiment of the invention the individual determination of a corresponding value of the amplitude of the RF voltage $RF_{det}(m_{cal})$ of the selected mass $m_{cal}$ is done by adding to the value of the first function $RF(m_{cal}, w_{cal})$ corresponding to the selected mass $m_{cal}$ the value of the deviation of the filter window width $\Delta w(m_{cal})$ of the selected mass $m_{cal}$ multiplied with a linear factor DClinear of the second function $DC(m, w_{cal})$ divided by a linear factor RFlinear of the first function $RF(m, w_{cal})$.

$$RF(m_{cal},w_{cal})_{new}=RF(m_{cal},w_{cal})+DC\text{linear}/RF\text{linear}*\Delta w(m_{cal})$$

In an embodiment of the invention during a repetition of the calibration steps ii a) to ii e) the factor $\Delta w\text{-factor}_{DC}$ with which the value the deviation of the filter window width $\Delta w(m_{cal})$ of the selected mass $m_{cal}$ is multiplied and then added to the value of the second function $DC(m_{cal}, w_{cal})$ of the selected mass $m_{cal}$ to individually determine the DC voltage $DC(m_{cal}, w_{cal})$ of the selected mass $m_{cal}$ is changed. Preferably the change of the factor $\Delta w\text{-factor}_{DC}$ during a repetition of the calibration steps ii a) to ii e) is such indicates that the determination of the DC voltage $DC(m_{cal}, w_{cal})$ of the selected mass $m_{cal}$ is converging. In another preferred embodiment of the invention during the repetition of the calibration steps ii a) to ii e) the factor $\Delta w\text{-factor}_{DC}$ is only changed if during the repetition of the calibration steps ii a) to ii e) it is observed that the deviation of the filter window width $\Delta w(m_{cal})$ of the selected mass $m_{cal}$ has not changed compared to the previous calibration steps such that the deviation of the filter window width $\Delta w(m_{cal})$ of the selected mass $m_{cal}$ is converging.

In one embodiment of the invention the individual determination of the corresponding value of the amplitude of the RF voltage $RF_{det}(m_{cal})$ and value of DC voltage $DC_{det}(m_{cal})$ to a selected mass $m_{cal}$ (step ii a)) is done by adding an offset to the value of the first function $RF(m_{cal},w_{cal})$ and/or the value of the second function $DC(m_{cal},w_{cal})$ corresponding to the selected mass $m_{cal}$.

In one embodiment of the invention when fitting of a function $RF_{fit}(m,w_{cal})$ of the selected mass m to the values of the amplitude of the RF voltage $RF_{det}(m_{cal})$ corresponding to the several selected masses $m_{cal}$ (step ii b)) the function $RF_{fit}(m,w_{cal})$ is summation of a constant $RFoffset_{fit}$ and a linear function of the selected mass m.

In another embodiment of the invention when fitting a function $DC_{fit}(m,w_{cal})$ of the selected mass m to the values of DC voltage $DC_{det}(m_{cal})$ corresponding to the several selected masses $m_{cal}$ (step ii b)) the function $DC_{fit}(m,w_{cal})$ is a summation of a constant value $DCoffset_{fit}$ and a linear function of the selected mass m.

In another embodiment of the invention when fitting a function $RF_{fit}(m,w_{cal})$ of the selected mass m to the values of the amplitude of the RF voltage $RF_{det}(m_{cal})$ corresponding to the several selected masses $m_{cal}$ (step ii b)) the function $RF_{fit}(m,w_{cal})$ is a sum of functions comprising a linear function of the selected mass m.

In another embodiment of the invention when fitting a function $RF_{fit}(m,w_{cal})$ of the selected mass m to the values of the amplitude of the RF voltage $RF_{det}(m_{cal})$ corresponding to the several selected masses $m_{cal}$ (step ii b)) the function $RF_{fit}(m,w_{cal})$ is a sum of functions comprising a quadratic function of the selected mass m.

In another embodiment of the invention when fitting a function $RF_{fit}(m,w_{cal})$ of the selected mass m to the values of the amplitude of the RF voltage $RF_{det}(m_{cal})$ corresponding to the several selected masses $m_{cal}$ (step ii b)) the function $RF_{fit}(m,w_{cal})$ is a sum of functions comprising an exponential function of the selected mass m.

In another embodiment of the invention when fitting a function $RF_{fit}(m,w_{cal})$ of the selected mass m to the values of the amplitude of the RF voltage $RF_{det}(m_{cal})$ corresponding to the several selected masses $m_{cal}$ (step ii b)) the function $RF_{fit}(m,w_{cal})$ is a sum of functions comprising an exponential function whose exponent is a linear function of the selected mass m.

In another embodiment of the invention when fitting a function $RF_{fit}(m,w_{cal})$ of the selected mass m to the values of the amplitude of the RF voltage $RF_{det}(m_{cal})$ corresponding to the several selected masses $m_{cal}$ (step ii b)) the function $RF_{fit}(m,w_{cal})$ is a sum of functions comprising at least two exponential functions whose exponents are different linear functions of the selected mass m.

In another embodiment of the invention when fitting a function $RF_{fit}(m,w_{cal})$ of the selected mass m to the values of the amplitude of the RF voltage $RF_{det}(m_{cal})$ corresponding to the several selected masses $m_{cal}$ (step ii b)) the function $RF_{fit}(m,w_{cal})$ is a sum of functions containing only two exponential functions whose exponents are different linear functions of the selected mass m. Only these two exponential functions are summed up in the function $RF_{fit}(m,w_{cal})$.

In another embodiment of the invention when fitting a function $DC_{fit}(m,w_{cal})$ of the selected mass m to the values of DC voltage $DC_{det}(m_{cal})$ corresponding to the several selected masses $m_{cal}$ (step ii b)) the function $DC_{fit}(m,w_{cal})$ is a sum of functions comprising a linear function of the selected mass m.

In another embodiment of the invention when fitting a function $DC_{fit}(m,w_{cal})$ of the selected mass m to the values of DC voltage $DC_{det}(m_{cal})$ corresponding to the several selected masses $m_{cal}$ (step ii b)) the function $DC_{fit}(m,w_{cal})$ is a sum of functions comprising a quadratic function of the selected mass m.

In another embodiment of the invention when fitting a function $DC_{fit}(m,w_{cal})$ of the selected mass m to the values of DC voltage $DC_{det}(m_{cal})$ corresponding to the several selected masses $m_{cal}$ (step ii b)) the function $DC_{fit}(m,w_{cal})$ is a sum of functions comprising an exponential function of the selected mass m.

In another embodiment of the invention when fitting a function $DC_{fit}(m,w_{cal})$ of the selected mass m to the values of DC voltage $DC_{det}(m_{cal})$ corresponding to the several selected masses $m_{cal}$ (step ii b)) the function $DC_{fit}(m,w_{cal})$ is a sum of functions comprising an exponential function whose exponent is a linear function of the selected mass m.

In another embodiment of the invention when fitting a function $DC_{fit}(m,w_{cal})$ of the selected mass m to the values of DC voltage $DC_{det}(m_{cal})$ corresponding to the several selected masses $m_{cal}$ (step ii b)) the function $DC_{fit}(m,w_{cal})$ is a sum of functions comprising at least two exponential functions whose exponents are different linear functions of the selected mass m.

In another embodiment of the invention when fitting a function $DC_{fit}(m,w_{cal})$ of the selected mass m to the values of DC voltage $DC_{det}(m_{cal})$ corresponding to the several selected masses $m_{cal}$ (step ii b)) the function $DC_{fit}(m,w_{cal})$ is a sum of functions containing only two exponential functions whose exponents are different linear functions of the selected mass m.

In preferred embodiment of the invention when fitting a function $RF_{fit}(m,w_{cal})$ of the selected mass m to the values of the amplitude of the RF voltage $RF_{det}(m_{cal})$ corresponding to the several selected masses $m_{cal}$ and fitting a function $DC_{fit}(m,w_{cal})$ of the selected mass m to the values of DC voltage $DC_{det}(m_{cal})$ corresponding to the several selected masses $m_{cal}$ (step ii b)) the function $RF_{fit}(m,w_{cal})$ is the summation of a constant value $RFoffset_{fit}$, a linear function of the selected mass m, a quadratic function of the selected mass m and two exponential functions whose exponents are different linear functions of the selected mass m and the function $DC_{fit}(m,w_{cal})$ is summation of a constant value $DCoffset_{fit}$ and a linear function of the selected mass m.

In another preferred embodiment of the invention when fitting a function $RF_{fit}(m,w_{cal})$ of the selected mass m to the values of the amplitude of the RF voltage $RF_{det}(m_{cal})$ corresponding to the several selected masses $m_{cal}$ and fitting a function $DC_{fit}(m,w_{cal})$ of the selected mass m to the values of DC voltage $DC_{det}(m_{cal})$ corresponding to the several selected masses $m_{cal}$ (step ii b)) the function $RF_{fit}(m,w_{cal})$ is the summation of a constant value $RFoffset_{fit}$, a linear function of the selected mass m, a quadratic function of the selected mass m and two exponential functions whose exponents are different linear functions of the selected mass m and the function $DC_{fit}(m,w_{cal})$ is the summation of a constant value $DCoffset_{fit}$, a linear function of the selected mass m, a quadratic function of the selected mass m and two exponential functions whose exponents are different linear functions of the selected mass m.

In another preferred embodiment of the invention fitting a function $RF_{fit}(m,w_{cal})$ of the selected mass m to the values of the amplitude of the RF voltage $RF_{det}(m_{cal})$ corresponding to the several selected masses $m_{cal}$ and fitting a function $DC_{fit}(m,w_{cal})$ of the selected mass m to the values of DC voltage $DC_{det}(m_{cal})$ corresponding to the several selected masses $m_{cal}$ (step ii b)) the function $RF_{fit}(m,w_{cal})$ is summation of a constant value $RFoffset_{fit}$ and a linear function of the selected mass m and the function $DC_{fit}(m,w_{cal})$ is summation of a constant value $DCoffset_{fit}$ and a linear function of the selected mass m.

In another particular preferred embodiment of the invention when fitting a function $RF_{fit}(m,w_{cal})$ of the selected mass m to the values of the amplitude of the RF voltage $RF_{det}(m_{cal})$ corresponding to the several selected masses $m_{cal}$ and fitting a function $DC_{fit}(m,w_{cal})$ of the selected mass m to the values of DC voltage $DC_{det}(m_{cal})$ corresponding to the several selected masses $m_{cal}$ (step ii b)) in a first step summation of a constant value $RFoffset_{fit}$ and a linear function of the selected mass m is fitted for the function $RF_{fit}(m,w_{cal})$ and summation of a constant value $DCoffset_{fit}$ and a linear function of the selected mass m is fitted for the function $DC_{fit}(m,w_{cal})$ and in a second step the function $RF_{fit}(m,w_{cal})$ is fitted by adding to the summation of a constant value $RFoffset_{fit}$ and a linear function of the selected mass m fitted in the first step the summation of a constant value, a quadratic function of the selected mass m and two exponential functions whose exponents are different linear functions of the selected mass m and the function $DCF_{fit}(m,w_{cal})$ is fitted by adding to the summation of a constant value $DCoffset_{fit}$ and a linear function of the selected mass m fitted in the first step the summation of a constant, a quadratic function of the selected mass m and two exponential functions whose exponents are different linear functions of the selected mass m.

In another embodiment of the invention the fitting of a function $RF_{fit}(m,w_{cal})$ of the selected mass m to the values of the amplitude of the RF voltage $RF_{det}(m_{cal})$ corresponding to the several selected masses $m_{cal}$ and fitting a function $DC_{fit}(m,w_{cal})$ of the selected mass m to the values of DC voltage $DC_{det}(m_{cal})$ corresponding to the several selected masses $m_{cal}$ (step ii b)) is done by a method of polynomial fit, cubic spline fit, b-spline fit or nonlinear least square fit.

In one embodiment of the invention when some masses and/or at least some of the several selected masses $m_{check}$ are detected at the detection means via the second analyzer operating in a mass analysing mode during scanning the first quadrupole operating as pre-selecting analyzer in the mass selecting mode selecting masses in the mass filter window having the filter window width $w_{cal}$ over a mass range $\rho_{mass_m_check}$ assigned to the mass $m_{check}$, comprising the mass $m_{check}$ and being larger than the filter window width $w_{cal}$ of the mass filter window of the mass selecting mode of the first quadrupole, the amplitude of the RF voltage applied to the electrodes of the first quadrupole given by the function $RF_{fit}(m)$ and the DC voltage applied to the electrodes of the first quadrupole given by the function $DC_{fit}(m)$ (step ii c)) all of the several selected masses $m_{cal}$ for which a corresponding value of the amplitude of the RF voltage $RF_{det}(m_{cal})$ and value of DC voltage $DC_{det}(m_{cal})$ is determined individually are scanned with the first quadrupole and detected at the detection means. So in this embodiment the same masses $m_{cal}$ for which a corresponding value of the amplitude of the RF voltage $RF_{det}(m_{cal})$ and value of DC voltage $DC_{det}(m_{cal})$ is determined in step ii a) are checked in step ii c). So in this embodiment the set $M_{check}$ of masses $m_{check}$ for which the check is performed is at least the set $M_{cal}$ of calibration masses $m_{cal}$.

In other embodiments not all calibration masses $m_{cal}$ are checked in step ii c) as mass $m_{check}$. In some embodiments not more than two-thirds of the calibration masses $m_{cal}$, preferably not more than half of the calibration masses $m_{cal}$ and particular not more than one-third of the calibration masses $m_{cal}$ are checked in step ii c) as mass $m_{check}$.

In some embodiments the number of masses $m_{check}$ checked in step ii c) is between 2 and 15, preferable between 4 and 12 and particular preferable between 6 and 10.

Preferably at the beginning of the evaluation of the check of the fitted functions $RF_{fit}(m, w_{cal})$ and $DC_{fit}(m, w_{cal})$ after the scanning of the first quadrupole over the mass range $\rho_{mass_m_check}$ (step ii c) for a selected mass $m_{check}$ it is evaluated for which masses $m_{set_m_check}$ of the mass range $\rho_{mass_m_check}$ when set at the first function of the amplitude of the $RF_{fit}(m, w_{cal})$ and the second function of the DC voltage $DC_{fit}(m, w_{cal})$ to apply the RF voltage and DC voltage at the first quadrupole the detection means is detecting the selected mass $m_{check}$.

According to the result of this evaluation in some embodiments of the invention the evaluation of the shift of the peak position $\Delta m(m_{check})$ of the detected selected masses $m_{check}$ (step ii d)) is performed by calculating the difference between the mass $m_{set_m_check_c}$ at the center of the scanned masses $m_{set_m_check}$ at which the detection means is detecting the selected mass $m_{check}$ and the selected mass $m_{check}$.

$$\Delta m(m_{check})=m_{set_m_check_c}-m_{check}$$

Like at all differences ($\Delta m(\ldots)$, $\Delta w(\ldots)$) calculated during the execution of the inventive method the difference $\Delta m(m_{check})$ may have positive and negative values or be in the best case zero. According to a positive or negative value the mass $m_{set_m_check_c}$ at the center of the scanned masses can be shifted to a higher value or lower value in comparison to the expected value $m_{check}$.

According to the result of before mentioned evaluation of the masses $m_{set_m_check}$ in some embodiments of the invention the evaluation of the deviation of the filter window width $\Delta w(m_{check})$ of the detected selected mass $m_{check}$ (step ii d)) is performed by evaluating a filter window width $w_{check}(m_{check})$ from the masses $m_{set_m_check}$ of the mass range $\rho_{mass_m_check}$ at which the detection means is detecting the selected mass $m_{check}$ and calculating the difference between the filter window width $w_{check}(m_{check})$ and the filter window width $w_{cal}$ for which the first quadrupole has to be calibrated.

$$\Delta w(m_{check})=w_{check}(m_{check})-w_{cal}$$

If $\Delta w(m_{check})$ has a positive value the detected peak for the mass $m_{check}$ during scanning the first quadrupole is too wide and for a negative value to narrow.

In some embodiments of the invention the filter window width $w_{check}(m_{check})$ from the masses $m_{set_m_check}$ is determined by determining at which masses $m_{set_m_check}$ during scanning the first quadrupole over the mass range $\rho_{mass_m_check}$ the detection means is detecting a signal higher than a threshold value. The filter window width $w_{check}(m_{check})$ is then the mass range in which these signals are detected.

In other embodiments of the invention the filter window width $w_{check}(m_{check})$ from the masses $m_{set_m_check}$ is determined by determining at which masses $m_{set_m_check}$ during scanning the first quadrupole over the mass range $\rho_{mass_m_check}$ the detection means is detecting a signal which is higher than a percentage of the highest signal detected by the detection means during the scanning. Preferable this percentage in the range between 5% and 60% and particular preferable this percentage is in the range between 8% and 25%.

In an embodiment of the invention the repetition condition to be fulfilled such that the repetition of the calibration steps ii a) to ii e) is stopped is that the calibration steps ii a) to ii e) has been repeated one time. In this case is N=2 because the calibration is stopped after one repetition of the calibration. If not all quality conditions of the calibration are not fulfilled at that moment the calibration was not successful.

In other embodiments of the invention the repetition condition to be fulfilled such that the repetition of the calibration steps ii a) to ii e) is stopped is that the calibration steps ii a) to ii e) has been repeated 2, 3, 5, 7 or 10 times.

In an embodiment of the invention the quality condition of the calibration to be fulfilled such that the repetition of the calibration steps ii a) to ii e) is stopped is that all evaluated values of a shift of the peak position $\Delta m(m_{check})$ of the mass selecting mode of the detected selected masses $m_{check}$ are below a critical threshold $\Delta m_{max}$ and all deviations of the filter window width $\Delta w(m_{check})$ of the mass selecting mode of the measured selected masses m are below a second critical threshold $\Delta w_{max}$.

In an embodiment of the invention the calibration steps ii a) to ii e) are repeated if the quality conditions are not fulfilled, using in step ii a) in the mass selecting mode of the first quadrupole the functions $RF_{fit}(m,w_{cal})$ as the first function RF(m,w) and $DC_{fit}(m,w_{cal})$ as the second function DC(m,w), determining individually corresponding values of the amplitude of the RF voltage $RF_{det}(m_{cal})$ and corresponding values of DC voltage $DC_{det}(m_{cal})$ only for such of the detected selected masses $m_{check}$ for which the evaluated value of the shift of the peak position $\Delta m(m_{check})$ of the mass selecting mode is not below a critical threshold $\Delta m_{max}$ or the deviation of the filter window width $\Delta w(m_{check})$ of the mass selecting mode is not below a second critical threshold $\Delta w_{max}$.

In another embodiment of the invention the calibrating of the first quadrupole is repeated after changing at least one kind of function used in calibration step ii b) to fit a function $RF_{fit}(m,w_{cal})$ of the selected mass m to the values of the amplitude of the RF voltage $RF_{det}(m_{cal})$ corresponding to the several selected masses $m_{cal}$ and to fit a function $DC_{fit}(m,w_{cal})$ of the selected mass m to the values of DC voltage $DC_{det}(m_{cal})$ corresponding to the several selected masses $m_{cal}$ or after changing at least one of the quality conditions of the calibration when not all quality conditions of the calibration are fulfilled after the calibration steps ii a) to ii e) have been executed N times. In this embodiment the calibration is started again after N repetitions of the calibration with the aim to find calibration functions by changing to kind of function fitted to the values of the amplitude of the RF voltage $RF_{det}(m_{cal})$ corresponding to the several selected masses $m_{cal}$ or values of DC voltage $DC_{det}(m_{cal})$ corresponding to the several selected masses $m_{cal}$.

In some embodiments of the invention the calibrating of the first quadrupole is repeated after changing at least one function of the initial function $RF_{ini}(m,w_{cal})$ for the first function RF(m,w) and the initial function $DC_{ini}(m,w_{cal})$ for the second function DC(m,w) at the beginning of the calibration of the first quadrupole in the mass selecting mode when not all quality conditions of the calibration are fulfilled after the calibration steps ii a) to ii e) have been executed N times. In this embodiment the calibration is started again after N repetitions of the calibration with the aim to find calibration functions by starting the calibration again with at least the changed initial $$\text{function } RF_{ini}(m,w_{cal}) \text{ or } DC_{ini}(m,w_{cal}).$$

To the content of this description of the invention belong also all embodiments which are combinations of the before mentioned embodiments of the invention. So all embodiments are encompassed which comprise a combinations of features described just for single embodiments before.

The inventive method for calibrating a mass spectrometer has the advantage that the calibration of the first quadrupole is much faster than a calibration of the quadrupole alone known from the prior art. On the one hand the second mass analyzer operating in his mass analysing mode is now supporting the calibration according to the invention. This support is particularly based on the fact that when in step ii a) the corresponding value of the amplitude of the RF voltage $RF_{det}(m_{cal})$ and value of DC voltage $DC_{det}(m_{cal})$ applied to the electrodes of the first quadrupole are determined individually for each calibration mass $m_{cal}$ the second analyzer is just analysing these mass $m_{cal}$ so that the detection means is only detecting the mass $m_{cal}$. This makes the determination of the corresponding values easy.

With the method according to the invention during the determination of the corresponding value of the amplitude of the RF voltage $RF_{det}(m_{cal})$ and value of DC voltage $DC_{det}(m_{cal})$ for each of the several selected masses $m_{cal}$ individually only a small mass range $\rho_{mass}$ is scanned for each mass and not the whole mass range of the mass spectrometer. This makes the calibration time much shorter, because the measured range are smaller. Additional because the values of the masses $m_{cal}$ are determined one after the other the parameters of the mass spectrometer have not to be changed very much in a short time which makes the calibrating scan over the whole mass range of a mass spectrometer more time consuming. Particularly due to the adequate choice of fitting functions in the inventive method the claimed calibration method is converging very well and therefore more robust than the calibration methods of the prior art. Also the new calibration method has proved to be uncritical regarding the choice of the initial functions, calibration masses and check masses.

Another advantage of the inventive method for calibrating a mass spectrometer is that the first quadrupole can be calibrated in his mass selecting mode just if two of the several selected masses $m_{cal}$, two calibration masses, for which in step ii a) corresponding values of the amplitude of the RF voltage $RF_{det}(m_{cal})$ and value of DC voltage $DC_{det}(m_{cal})$ are determined, are used, which are positioned in the same time in the mass filter window of the mass selecting mode of the first quadrupole. If these masses are detected alone by the first quadrupole then they can not be resolved and detected as single mass peaks. Due the support by the second mass analyzer in his mass analysing mode both masses are separately detected as mass peaks by the detection means. This shows that the coordination of both mass analyzers, the first quadrupole and the second mass analyzer by the inventive method of calibration enhances the possibilities to use calibration masses which are not useable for a single calibration of the first quadrupole.

Further on with the inventive method of calibration it is easy to change the kind of function which shall be fitted in the fitting process step ii c) after some repetitions of the steps ii a) to ii c) have not been successful. So a first attempt to find the calibration functions by the calibration the first quadrupole according to the step ii) can be stopped already after a small number of repetitions, mostly between N=2 and N=6 and the step ii) can be executed again with another functions to be fitted to find the calibration functions. Because the execution of step ii) is not taking much time, more kinds of functions to be fitted can be tested in a short time period increasing the chance to find optimal calibration functions $RF_{fit}(m,w_{cal})$ and $DC_{fit}(m,w_{cal})$. This results in an improved operating of the first quadrupole as pre-selecting mass analyzer in a mass selecting mode due to the calibration of the first quadrupole with the inventive method.

BRIEF DESCRIPTION OF THE DRAWINGS

FIG. 11 is a flow chart illustrating in detail the steps of the calibration of the first quadrupole of the second embodiment of a mass spectrometer according to a second embodiment of the inventive method (part 1).

DETAILED DESCRIPTION OF PREFERRED EMBODIMENTS

Figure 1:
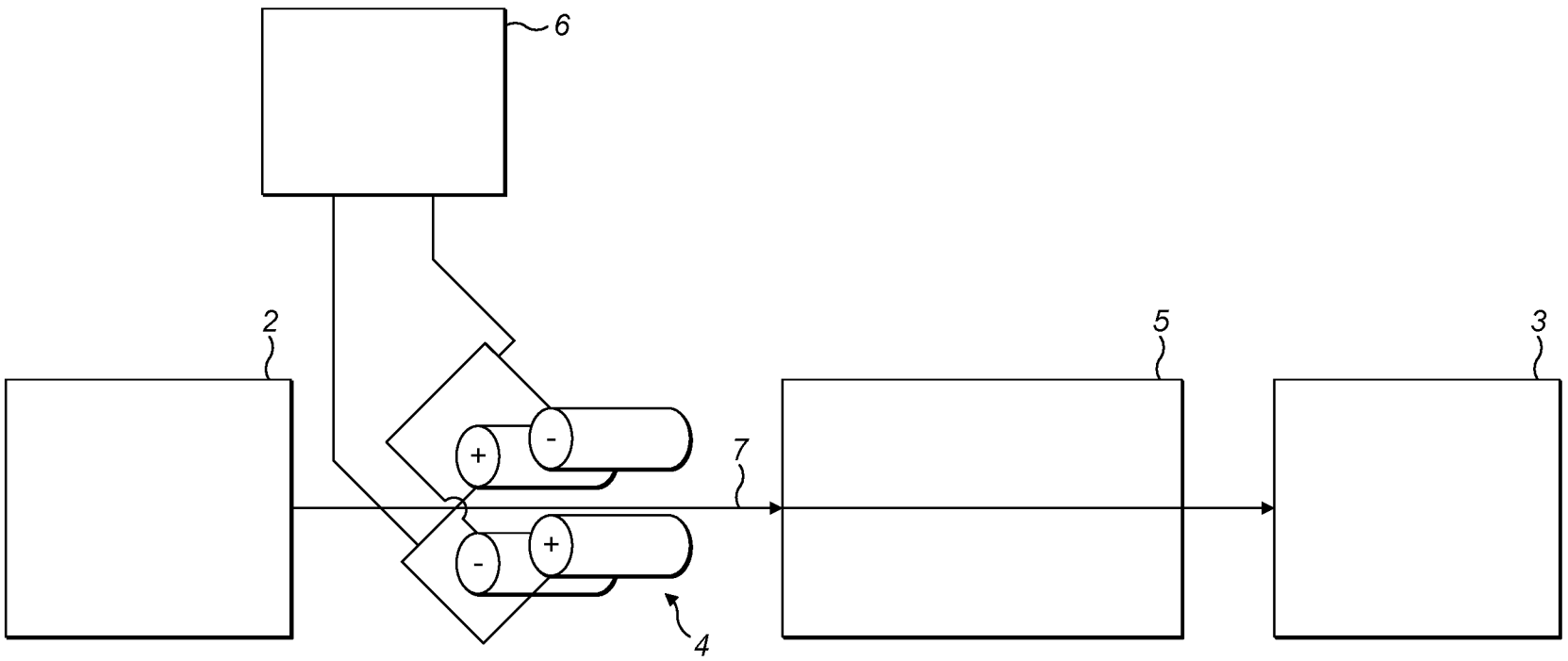
FIG. 1 shows are first embodiment of a mass spectrometer which can be calibrated by the inventive method.

In FIG. 1 is shown a first embodiment of a mass spectrometer 1 which can be calibrated with the method for calibration of claim 1.

In FIG. 1 only the main components of the mass spectrometer are shown for better understanding of the new method for calibrating such a mass spectrometer.

Two of the main components of the mass spectrometer are an ion source 2 in which ions to be analysed by the mass spectrometer are generated from a sample which shall be investigated and a detection means 3 to detect ions. The detected ions may be at least portion of the ions directly generated in the ion source 2. The detected ions may be generated by additional processes from the ions generated in ion source 2. All processes known to a person skilled in the art to create such secondary ions and/or ions of higher order (created by more than one process step) can be used for these additional processes. Just for example shall be mentioned the processes of collision, fragmentation, capturing and dissociation. Of course it is also possible that the detection means 3 is detecting similarly ions directly generated in the ion source 2 and ions generated by the additional processes.

Further on the mass spectrometer of the first embodiment comprises two mass analyzers as main components, a first mass analyzer 4 and a second mass analyzer 5. The first mass analyzer 4 is a quadrupole, the first quadrupole 4. In this mass spectrometer 1 ions are ejected from the ion source 2 and can be moved on trajectories 7 to the detection means 3 passing both mass analyzers 4 and 5 in which they first pass the first quadrupole 4 and afterwards the second mass analyzer 5.

The detection means 3 of the mass spectrometer 1 is a detector 3 which is separated from the second mass analyzer 5.

The second mass analyzer 5 may be a second quadrupole. This second quadrupole may be operated also in a non-selective transmission mode. The second mass analyzer 5 may be a time-of-flight mass analyzer or an ion trap. These ion trap may be an orbitrap or an ion cyclotron resonance cell. In another embodiment the second mass analyzer 5 may be a magnetic and/or electric sector analyzer.

The first quadrupole 4 is operable as a pre-selecting mass analyzer in a mass selecting mode selecting masses in a mass filter window having a filter window width w, in which a RF voltage and a DC voltage are applied to electrodes of the first quadrupole 4 by a power supply 6 supplying both voltages. The amplitude of the supplied RF voltage is a first function RF(m, w) of a selected mass m and the filter window width w and the supplied DC voltage is a second function DC(m, w) of the selected mass m and the filter window width w. The selected mass m is the mass at the center of the mass filter window, when the first quadrupole 4 is operated as a pre-selecting mass analyzer in the mass selecting mode.

Only ions are able to pass the first quadrupole 4 which have a mass in a specific mass range, the mass filter window. The filter window width w of the first quadrupole 4 is the width of the specific mass range of ions able to pass the first quadrupole. So if the first quadrupole 4 is operated as a pre-selecting mass analyzer, by the first quadrupole 4 the ions generated by the ion source are pre-selected and only ions having a mass in the mass filter window can pass the first quadrupole and reach afterwards the second mass analyzer.

The frequency of the RF voltage which is applying radiofrequency electromagnetic field to the electrodes of the quadrupole is fixed for the quadrupole during its operation and in the range of 1 MHz up to 15 MHz, preferably in the range of 2 MHz up to 6 MHz and particularly in the range of 3 MHz up to 5 MHz.

The mass spectrometer of the first embodiments normally comprises more elements, in particularly ion optical elements e.g. for defining the trajectories of ion beams and focusing ions beams. These elements are known to a person skilled in the art and are not described in detail for simplification the illustration of the invention.

Figure 2:
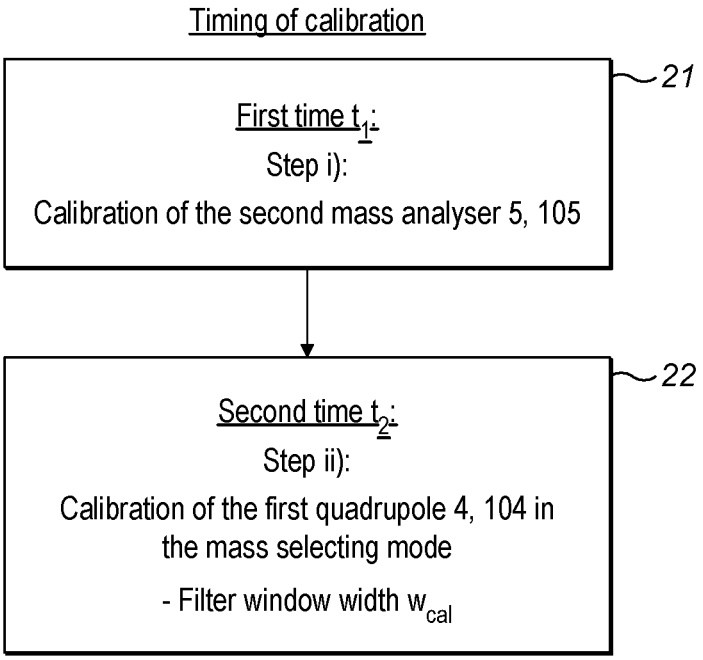
FIG. 2 is a flow chart illustrating the timing of the calibration of the mass analyzers of a mass spectrometer according to inventive method.

In FIG. 2 is the timing of the inventive method for calibrating a mass spectrometer is illustrated by a flow chart.

At a first time $t_1$ the calibration of the second mass analyzer (step i), 21) is performed.

At this first step 21 the second mass analyzer 5 has to be calibrated. The second mass analyzer 5 has at least to be calibrated in a mass analysing mode. In this mode the second mass analyzer 5 is mass selective so that ions of a specific mass can be separately detected by the detection means. In this resolution mode of the second mass analyzer 5 the analyzer has a high resolution to separate the masses of the detected ions. The calibration of the second mass analyzer 5 is done by calibration methods being state of the art. During the calibration of the second mass analyzer 5 the first quadrupole 4 is operated in a transmission mode, that is in a non-mass-selective mode so that all ions from the ion source can reach the second mass analyzer. In the transmission mode of the first quadrupole 4 only a RF voltage with an amplitude given by a function $RF_{trans}(m_{trans})$ of a transmitted mass $m_{trans}$ may be applied to the first quadrupole.

At a second time $t_2$ later than the first time $t_1$ the first quadrupole is calibrated in the mass selecting mode selecting masses in the mass filter window having the filter window width $w_{cal}$ (step ii), 22). During this calibration of the first quadrupole second mass analyzer is operated in a mass analysing mode.

At this second step 22 the first quadrupole 4 is calibrated in the mass selecting mode. This calibration has to be done for a specific filter window width $w_{cal}$ of the mass filter window of the mass selecting mode. So the calibrated first quadrupole 4 shall select in the mass selecting mode ions with masses in a mass filter window having the filter window width $w_{cal}$.

The first quadrupole 4 may be calibrated in the mass selecting mode to have a filter window width $w_{cal}$ between 2 u and 30 u, preferably to have a filter window width $w_{cal}$ between 5 u and 20 u and particular preferably to have a filter window width $w_{cal}$ between 8 u and 15 u.

According to the invention the calibration of the second mass analyzer 5 has executed before the first quadrupole 4 is calibrated in the mass selecting mode. So the second mass analyzer 5 has to be calibrated at a first time $t_1$, and at a second time $t_2$ later than the first time $t_1$ the first quadrupole 4 has to be calibrated in the mass selecting mode. So calibration of both mass analyzers 4, 5 can be executed directly one after the other, so that the time difference between the first time $t_1$ and the second time $t_2$ can be very short, like seconds, minutes or hours. On the other hand the calibration of the second mass analyzer 5 can be done only at the setup of the mass spectrometer and the calibration of the first quadrupole 4 can be done later, e.g. when the mass spectrometer is installed at the end user. Additionally the calibration of the first quadrupole 4 can be repeated time by time. A preceding or another calibration of the second mass analyzer 5 might not be necessary.

Figure 3:
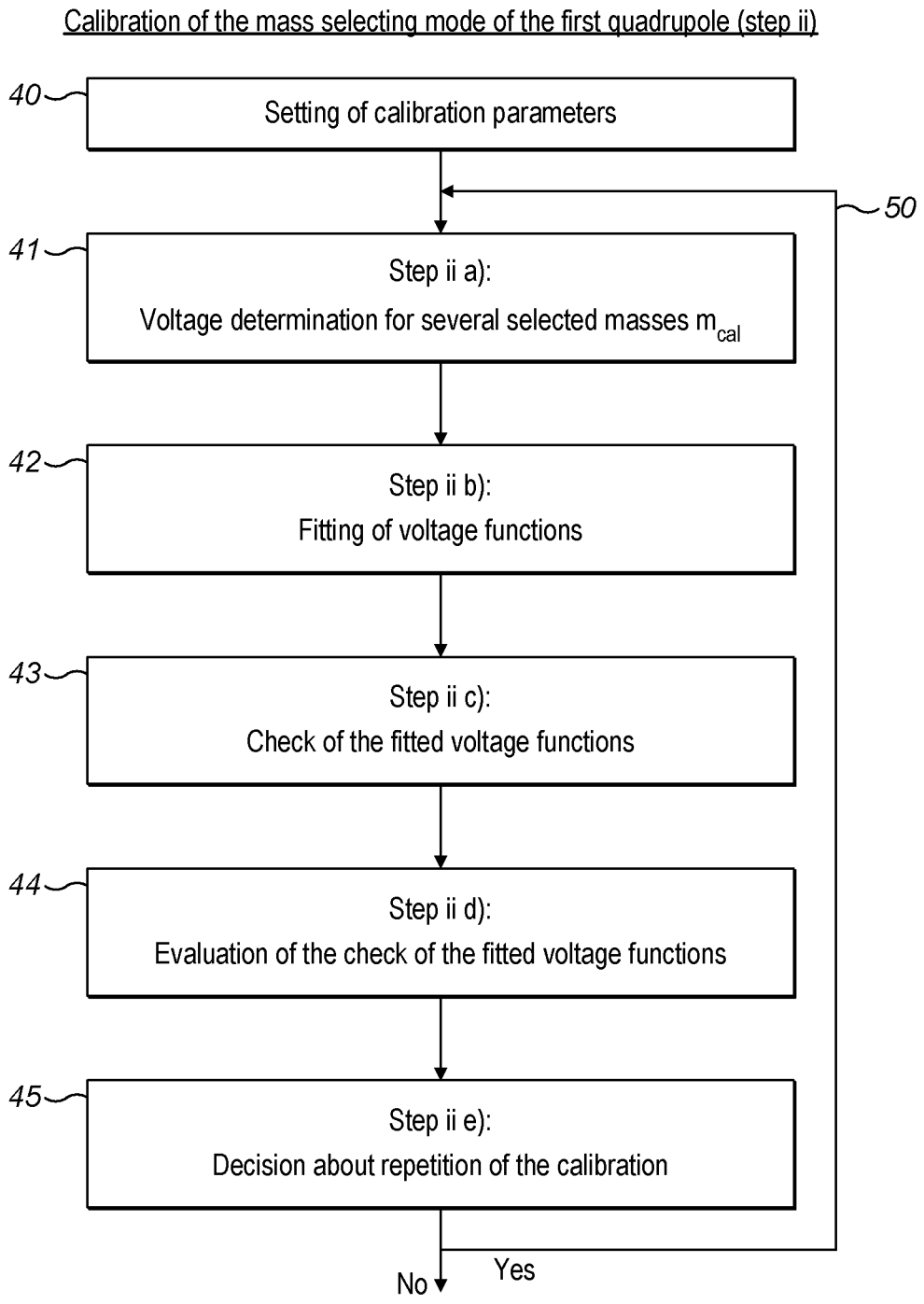
FIG. 3 is a flow chart illustrating coarse the steps of the calibration of the first quadrupole of a mass spectrometer according to inventive method.

The essential steps of this calibration of the first quadrupole of a mass spectrometer according to inventive method are illustrated in a coarse manner by the flow chart shown in FIG. 3. Any method of calibration comprising additional steps to these essential steps is also encompassed by the invention. By this coarse description of the inventive method shall be only explained what are the basic functions of the essential steps of the method to give an overview about the structure of the inventive method.

Before the calibration of the first quadrupole 4 is started, there must be a setting of calibration parameters 40 for the calibration. This setting can be a one time setting. This one time setting can be fix stored in a controlling unit of the mass spectrometer and/or set with the setup of the mass spectrometer. The one time setting can set also later e.g. at the start of using the instrument and can be fitted to measurement requirements the mass spectrometer shall be used for. The setting of the calibrating parameters 40 can also be repeated time by time in some embodiments of the invention e.g. depending on the use of the mass spectrometer or the change of parameters of the mass spectrometer.

In a first step of the calibration of the first quadrupole (step ii a), 41) for several selected masses $m_{cal}$ which shall be selected by the first quadrupole 4 in the mass selecting mode the amplitude of the RF voltage and DC voltage is determined which has to be applied to the electrodes of the first quadrupole so that the mass $m_{cal}$ is selected by the first quadrupole in the middle of the mass filter window which has the intended filter window width $w_{cal}$.

In a next step of the calibration of the first quadrupole (step ii b, 42) voltage functions are fitted to the values of the amplitude of the RF voltage and DC voltage determined for the several selected masses $m_{cal}$ in the step described before (step ii a), 41. The voltage functions represent the RF voltage and a DC voltage which are applied to electrodes of the first quadrupole 4 by the power supply 6. They are assigned to the filter window width $w_{cal}$ which shall be calibrated and are functions of the selected mass m.

In a next step of the calibration of the first quadrupole 4 (step ii c), 43) the fit of the functions fitted in the step above (step ii b), 42) is checked.

In a next step of the calibration of the first quadrupole 4 (step ii d, 44) the check of the fitted voltage functions $RF_{fit}(m, w_{cal})$ and $DC_{fit}(m, w_{cal})$ is evaluated.

In a next step of the calibration of the first quadrupole 4 (step ii e, 45) a decision about the repetition of the calibration is defined. This decision is prepared by the check of the fitted functions (step ii c), 43) and the evaluation of this check (step ii d, 44). If there is a decision to repeat the calibration (yes) the calibration steps ii a) to ii e) (41, 42, 43, 44, 45) are repeated shown by the arrow 50. If there is a decision not to repeat the calibration (no) the calibration of the first quadrupole 4 in the mass selecting mode for selecting masses in a filter window having a filter window width $w_{cal}$ is finished. In this case the fitted voltage functions $RF_{fit}(m, w_{cal})$ and $DC_{fit}(m, w_{cal})$ are used when the first quadrupole 4 is operated in the mass selecting mode for selecting masses in a filter window having a filter window width $w_{cal}$.

Figure 4:
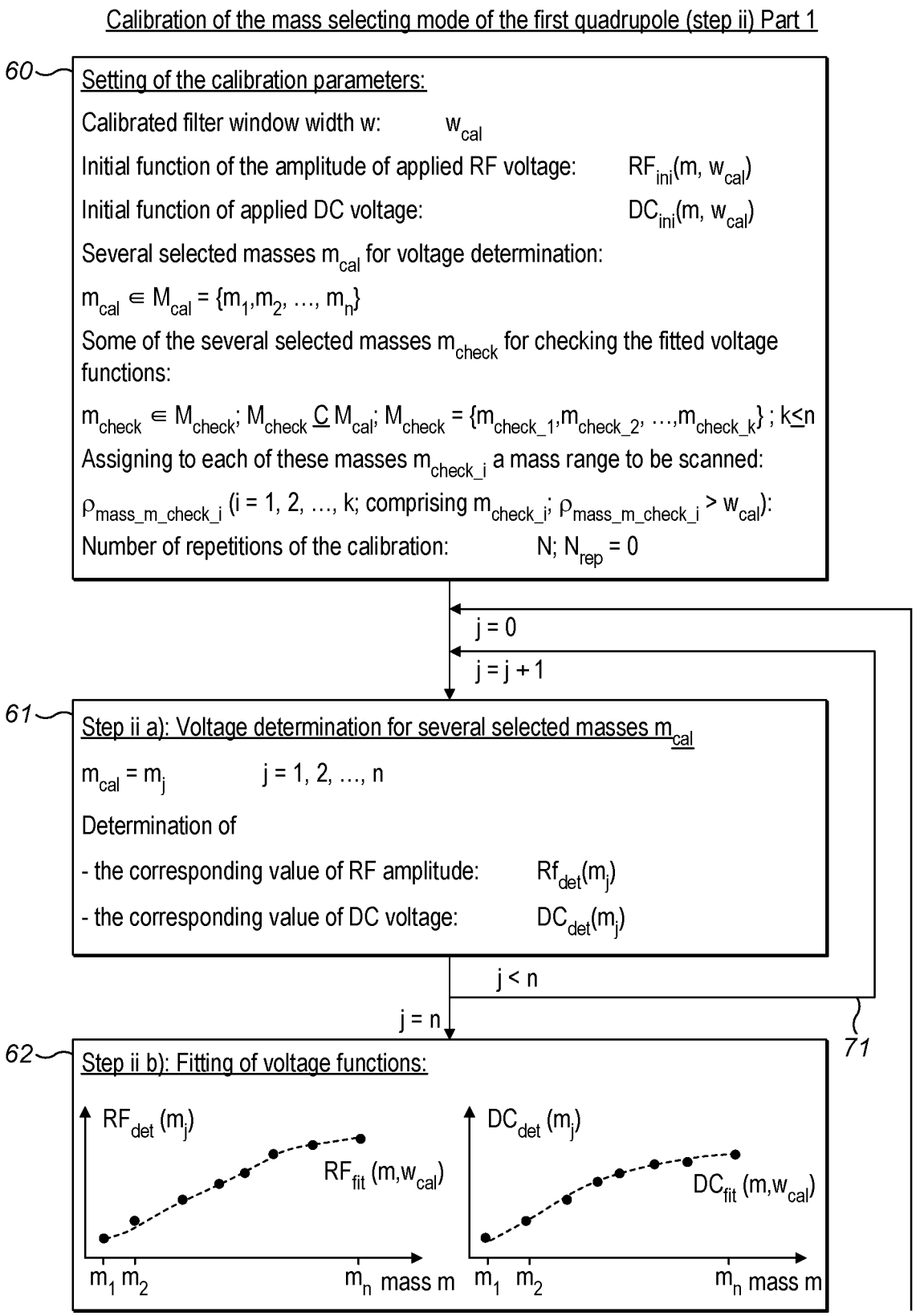
FIG. 4 is a flow chart illustrating in detail the steps of the calibration of the first quadrupole of the first embodiment of a mass spectrometer according to inventive method (part 1).
Figure 5:
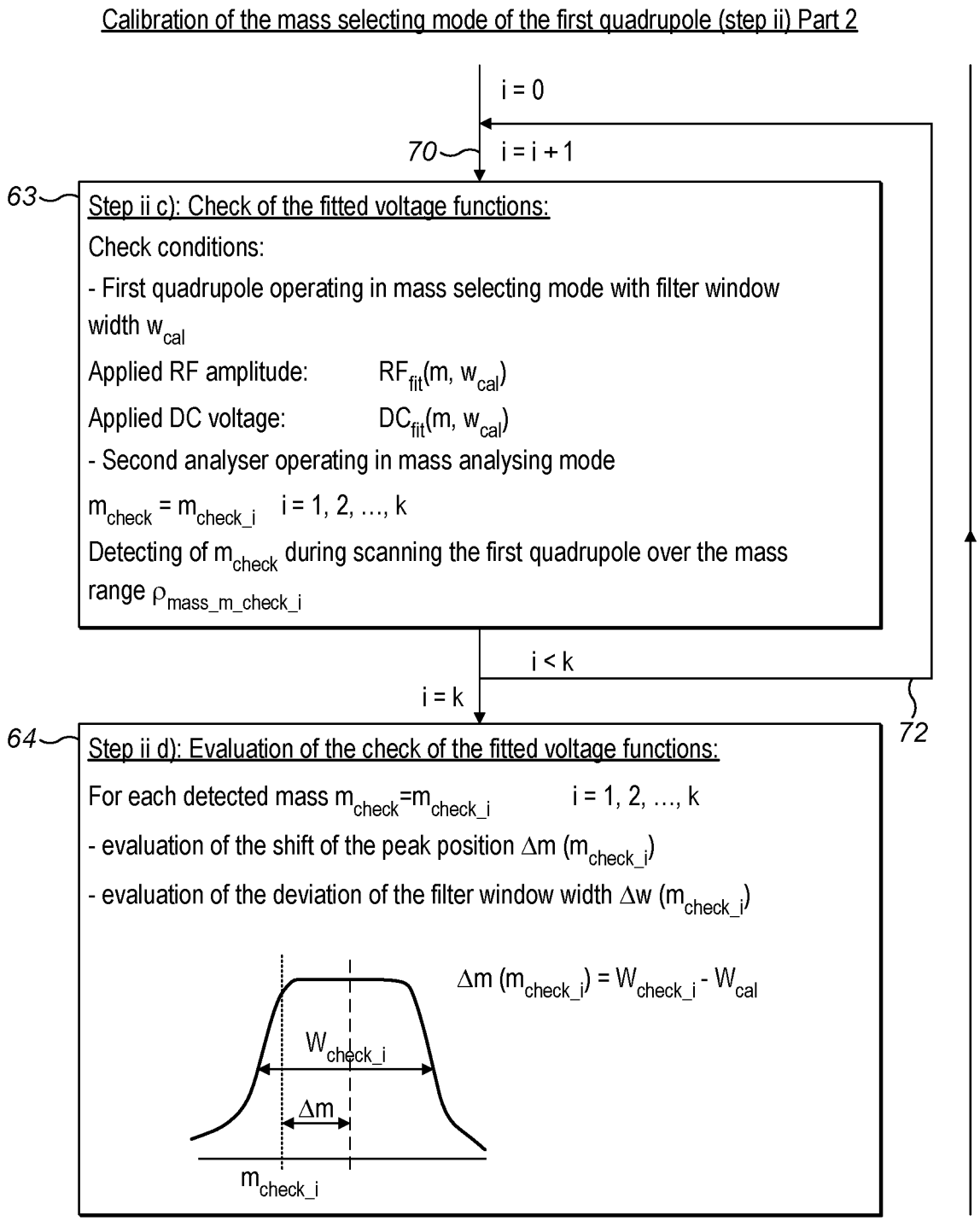
FIG. 5 is a flow chart illustrating in detail the steps of the calibration of the first quadrupole of the first embodiment of a mass spectrometer according to inventive method (part 2).
Figure 6:
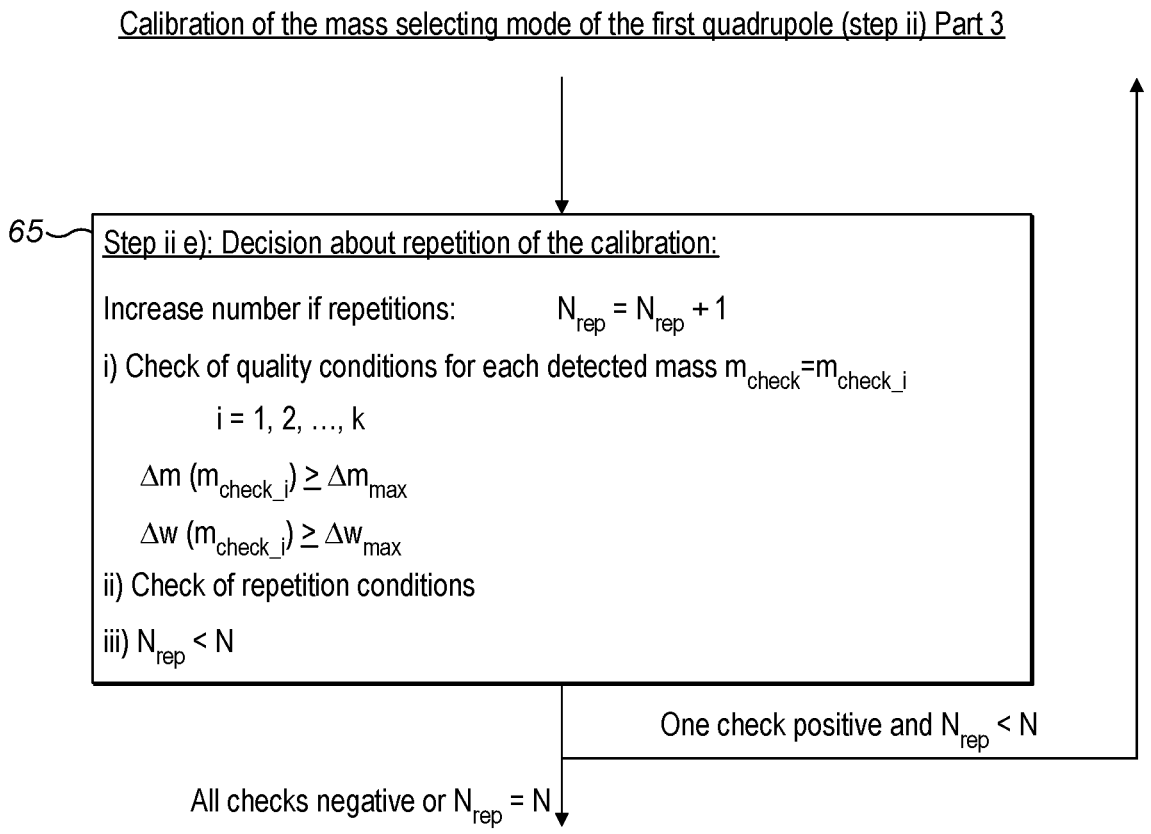
FIG. 6 is a flow chart illustrating in detail the steps of the calibration of the first quadrupole of the first embodiment of a mass spectrometer according to inventive method (part 3).

An embodiment of the claimed method which is used for calibrating the first embodiment of a mass spectrometer shown in FIG. 1 is illustrated in detail by a flow chart showing in detail the steps of the calibration of the first quadrupole (step ii, 22). For better clarity of the flow chart showing a lot of details of the method the low chart in split in three parts (parts 1, 2 and 3) which are shown in the separate FIGS. 4, 5 and 6. It is clear that the different steps of the method shall be executed one of the other following the arrows between the boxes of the flow chart. So despite the repetitions of several steps shown by arrows running in parallel to the boxes of the flow short showing up the different steps are executed starting from the top of each Figure to the bottom of the Figure and after executing the steps of one Figure the steps of the following Figure are executed again from the top to the bottom of the following Figure. The after the steps of FIG. 4 are executed the Steps of FIG. 5 are executed and after the steps of FIG. 5 are executed the Steps of FIG. 6 are executed. More in detail for example of the step at the bottom of FIG. 4 is executed (step ii b) the step at the top of FIG. 5 (step ii c) is executed. This is also shown by the arrow 70 above the box of step ii c) in FIG. 5 pointing with his arrowhead to the box of step ii c).

Before the calibration of the first quadrupole 4 is started, there is a setting of calibration parameters 60 for the calibration.

At the beginning of the calibration of the first quadrupole 4 in the mass selecting mode an initial function $RF_{ini}(m, w_{cal})$ is used for the first function $RF(m, w_{cal})$ and an initial function $DC_{ini}(m, w_{cal})$ for the second function $DC(m, w_{cal})$. These initial functions are set during the setting of calibration parameters 60.

In a first step of the calibration of the first quadrupole (step ii a), 61) for several masses $m_{cal}$ which shall be selected by the first quadrupole in the mass selecting mode the amplitude of the RF voltage and DC voltage is determined which has to be applied to the electrodes of the first quadrupole so that the mass $m_{cal}$ is selected by the first quadrupole in the middle of the mass filter window which has the intended filter window width $w_{cal}$.

This determination is executed individually for each of several selected masses $m_{cal}$ one after the other. These several selected masses $m_{cal}$ are calibration masses for defining reference points of suitable values of the amplitude of the RF voltage and DC voltage. These several selected masses $m_{cal}$ are defined in a parameter set during the setting of the calibration parameters 60. So a number of n calibration masses are defined as the several selected masses. Accordingly the defined calibration masses result in a set $M_{cal}$ of calibration masses $m_{cal}$ containing the masses $m_1$, $m_2$, $m_3$ . . . , $m_n$.

$$m_{cal} \in M_{cal} = \{m_1, m_2, \ldots, m_n\}$$

For each of the several selected masses $m_{cal}$ a corresponding value of the amplitude of the RF voltage $RF_{det}(m_{cal})$ and value of DC voltage $DC_{det}(m_{cal})$ is determined. If the corresponding RF voltage and DC voltage applied to the electrodes of the first quadrupole, masses are selected by the first quadrupole in a mass filter window having in the middle the selected mass $m_{cal}$ and the filter window width $w_{cal}$. So for each mass $m_j$ (j=1, 2, 3, . . . , n) of set $M_{cal}$ of calibration masses $m_{cal}$a corresponding value of the amplitude of the RF voltage $RF_{det}(m_j)$ and value of DC voltage $DC_{det}(m_j)$ is determined.

That determination is executed individually for each of several selected masses $m_{cal}$ one after the other, is shown in FIG. 4 by the arrow 71. Before step ii a) 61 a mass indicator j is set to j=0. This indicator is increased before a determination of a value of the amplitude of the RF voltage $RF_{det}(m_{cal})$ and a value of DC voltage $DC_{det}(m_{cal})$ by j=j+1. So at first the determination is executed for the mass $m_1$ (j=1). The mass indicator j is increased with every repetition shown by the arrow 71, so that during the second determination of a value of the amplitude of the RF voltage $RF_{det}(m_{cal})$ and a value of DC voltage $DC_{det}(m_{cal})$ the determination is executed for the mass $m_2$ (j=2). This determination is in that way repeated up to the mass $m_n$ (j=n). If j=n there is no more repetition of a determination of a value of the amplitude of the RF voltage $RF_{det}(m_{cal})$ and a value of DC voltage $DC_{det}(m_{cal})$ and the next step of the calibration (step ii b, 62) is executed. So for all of the several selected masses $m_{cal}$, the set $M_{cal}$ of calibration masses $m_{cal}$ containing the masses $m_1$, $m_2$, $m_3$ . . . , $m_n$ a determination of a value of the amplitude of the RF voltage $RF_{det}(m_{cal})$ and a value of DC voltage $DC_{det}(m_{cal})$ is executed.

The several selected masses $m_{cal}$, for which a corresponding value of the amplitude of the RF voltage $RF_{det}(m_{cal})$ and value of DC voltage $DC_{det}(m_{cal})$ is determined individually (step ii a), 61), are 4 to 18 selected masses $m_{cal}$, preferable 8 to 15 selected masses $m_{cal}$ and particular preferable 9 to 12 selected masses $m_{cal}$.

During the individual determination of the corresponding value of the amplitude of the RF voltage $RF_{det}(m_{cal})$ and value of DC voltage $DC_{det}(m_{cal})$ to a selected mass $m_{cal}$ the second mass analyzer 5 is filtering the selected mass $m_{cal}$. During this determination the second quadrupole 5 is set to filter the selected mass $m_{cal}$ by selecting masses m in a mass filter window having a filter window width $w_2$ between 0.6 u and 0.9 u and preferable by selecting masses m in a mass filter window having a filter window width $w_2$ between 0.65 u and 0.85 u.

During the individual determination of the corresponding value of the amplitude of the RF voltage $RF_{det}(m_{cal})$ and value of DC voltage $DC_{det}(m_{cal})$ to a selected mass $m_{cal}$ the first quadrupole 4 is scanned over a mass range $\rho_{mass}$ comprising the selected mass $m_{cal}$ applying the RF amplitude and the DC voltage to the electrodes of the first quadrupole according to the first function $RF(m, w_{cal})$ and the a second function $DC(m, w_{cal})$ for the masses m of the mass range $\rho_{mass}$. After the scanning of the first quadrupole 4 over the mass range $\rho_{mass}$ it may be evaluated for which masses $m_{set}$ of the mass range $\rho_{mass}$ when set at the first function of the amplitude of the $RF(m, w_{cal})$ and the second function of the DC voltage $DC(m, w_{cal})$ to apply the RF voltage and DC voltage at the first quadrupole 4 the detection means 3 is detecting the selected mass $m_{cal}$.

The filter window width w of the first quadrupole 4 is increased when the selected mass $m_{cal}$ is not transmitted by the second analyzer 5 and detected by the detection means 3 during the individual determination of the corresponding value of the amplitude of the RF voltage $RF_{det}(m_{cal})$ and value of DC voltage $DC_{det}(m_{cal})$ to the selected mass $m_{cal}$. Preferably the filter window width w of the first quadrupole 4 is at least doubled.

Furthermore the DC voltage applied to the electrodes of the first quadrupole 4 is decreased stepwise until the selected mass $m_{cal}$ is detected by the second analyzer 5 when the selected mass $m_{cal}$ is not detected by the second analyzer 5 during the individual determination of the corresponding value of the amplitude of the RF voltage $RF_{det}(m_{cal})$ and value of DC voltage $DC_{det}(m_{cal})$ to the selected mass $m_{cal}$, after the filter window width w of the first quadrupole 4 is extended.

In particular the DC voltage applied to the electrodes of the first quadrupole is decreased stepwise in that in the second function DC(m, w) which is defining the DC voltage, a constant offset value DCoffset is lowered stepwise until the selected mass $m_{cal}$ is detected by the second analyzer 5 and the detection means 3.

If due to these provisions the selected mass $m_{cal}$ is detected by the second analyzer 5 and the detection means 3 the constant offset value DCoffset of the second function DC(m, w) is increased stepwise until the filter window width w of the first quadrupole 4 is below a filter window width $w_{min}$ of the mass selecting mode to be calibrated, when the selected mass $m_{cal}$ is analysed by the second analyzer 5 and detected by the detection means 3 and the peak width w of the selected mass $m_{cal}$ is bigger than a first maximum peak width $w_{max}$.

After the evaluation at which masses $m_{set}$ of the mass range $\rho_{mass}$ the detection means 3 is detecting the selected mass $m_{cal}$ it is determined if the whole peak of the mass $m_{cal}$ is detected. This is only given if there is detected at both borders of the mass range $\rho_{mass}$ only no real mass signal, that means only a signal a noise signal detected by the detecting means 3. If only at one of the borders of the mass range no real mass signal is detected, the peak of the mass $m_{cal}$ has to be shifted. This is done by adding offset values RFoffset and DCoffset to the first function of the amplitude of the RF(m, w) and the second function of the DC voltage DC(m, w) to apply the RF voltage and DC voltage at the first quadrupole 4. If at both borders a real mass signal is detected the peak of the mass $m_{cal}$ is broader than the mass range $\rho_{mass}$ and has at first made more narrow by adding a positive offset value DCoffset to the second function of the DC voltage DC(m, w) to apply the DC voltage at the first quadrupole 4 or negative offset value RFoffset to the first function of the amplitude of the RF voltage RF(m, w) to apply the RF voltage at the first quadrupole 4.

If the whole peak of the mass $m_{cal}$ is detected the shift of the peak position $\Delta m(m_{cal})$ of the selected mass $m_{cal}$ may be evaluated. The evaluation of the shift of the peak position $\Delta m(m_{cal})$ of the selected mass $m_{cal}$ is performed by calculating the difference between the mass $m_{set_c}$ at the center of the masses $m_{set}$ at which the detection means 3 is detecting the selected mass $m_{cal}$ and the selected mass $m_{cal}$.

The individual determination of the corresponding value of the amplitude of the RF voltage $RF_{det}(m_{cal})$ and value of DC voltage $DC_{det}(m_{cal})$ to a selected mass $m_{cal}$ the individual definition of a corresponding the amplitude of the RF voltage $RF_{det}(m_{cal})$ and DC voltage $DC_{det}(m_{cal})$ (step ii a), 61) of the selected mass $m_{cal}$ is done by changing the value of the first function $RF(m_{cal},w_{cal})$ and/or the value of the second function $DC(m_{cal}, w_{cal})$ corresponding to the selected mass $m_{cal}$ depending on the shift of the peak position $\Delta m(m_{cal})$ of the selected mass $m_{cal}$. This individual definition of a corresponding value of the amplitude of the RF voltage $RF_{det}(m_{cal})$ and value of the DC voltage $DC_{det}(m_{cal})$ of the selected mass $m_{cal}$ may be done by adding to the value of the first function $RF(m_{cal},w_{cal})$ and/or the value of the second function $DC(m_{cal},w_{cal})$ corresponding to the selected mass $m_{cal}$ the value the shift of the peak position $\Delta m(m_{cal})$ of the selected mass $m_{cal}$ multiplied with a factor corresponding to the amplitude of the RF voltage $RFfactor_{p_shift}$ and/or DC voltage $DCfactor_{p_shift}$.

$$RF(m_{cal},w_{cal})_{new}=RF(m_{cal},w_{cal})+RF\text{factor}_{p_shift}*\Delta m(m_{cal})$$

$$DC(m_{cal},w_{cal})_{new}=DC(m_{cal},w_{cal})+DC\text{factor}_{p_shift}*\Delta m(m_{cal})$$

In particular the individual definition of a corresponding value of the amplitude of the RF voltage $RF_{det}(m_{cal})$ of the selected mass $m_{cal}$ may be done by adding to the value of the first function $RF(m_{cal},w_{cal})$ corresponding to the selected mass $m_{cal}$ the value the shift of the peak position $\Delta m(m_{cal})$ of the selected mass $m_{cal}$ multiplied with a linear factor RFlinear of the first function RF(m, $w_{cal}$).

$$RF(m_{cal},w_{cal})_{new}=RF(m_{cal},w_{cal})+RF\text{linear}*\Delta m(m_{cal})$$

The linear factor RFlinear of the first function RF(m, $w_{cal}$) is the factor with which the mass m is multiplied if the function RF(m, $w_{cal}$) in a summation of different functions and one of the summed function is a linear function.

$$RF(m,w_{cal})=RF\text{linear}*m+f_1(m)+f_2(m)+\ldots.$$

In particular the individual definition of a corresponding DC voltage $DC_{det}(m_{cal})$ of the selected mass $m_{cal}$ may be done by adding to the value of the second function $DC(m_{cal}, w_{cal})$ corresponding to the selected mass $m_{cal}$ the value the shift of the peak position $\Delta m(m_{cal})$ of the selected mass $m_{cal}$ multiplied with a linear factor DClinear of the second function DC(m, $w_{cal}$) divided by a linear factor RFlinear of the first function RF(m, $w_{cal}$).

$$DC(m_{cal},w_{cal})_{new}=DC(m_{cal},w_{cal})+DC\text{linear}/RF\text{linear}*\Delta m(m_{cal})$$

The linear factor DClinear of the second function DC(m, $w_{cal}$) is the factor with which the mass m is multiplied if the function DC(m, $w_{cal}$) in a summation of different functions and one of the summed function is a linear function.

$$DC(m,w_{cal})=DC\text{linear}*m+f_1(m)+f_2(m)+\ldots.$$

The deviation of the filter window width $\Delta w(m_{cal})$ of the selected mass $m_{cal}$ is evaluated after the evaluation at which masses $m_{set}$ of the mass range $\rho_{mass}$ the detection means is detecting the selected mass $m_{cal}$. Preferably the evaluation of the deviation of the filter window width $\Delta w(m_{cal})$ of the selected mass $m_{cal}$ is performed by evaluating a mass range $\rho_{massdetect}(m_{cal})$ of the masses $m_{set}$ set at the first function of the amplitude of the RF(m, $w_{cal}$) and the second function of the DC voltage DC(m, $w_{cal}$) to apply the RF voltage and DC voltage at the first quadrupole 4 for which the detection means is detecting the selected mass $m_{cal}$ and calculating the difference $\Delta w(m_{cal})$ between the mass range $\rho_{massdetect}(m_{cal})$ and the filter window width $w_{cal}$ for which the first quadrupole has to be calibrated.

$$\Delta w(m_{cal})=\rho_{massdetect}(m_{cal})-w_{cal}$$

In one embodiment of the invention the evaluation of the mass range $\rho_{massdetect}(m_{cal})$ is performed by evaluating the masses $m_{set}$ set at the first function of the amplitude of the RF(m, $w_{cal}$) and the second function of the DC voltage DC(m, $w_{cal}$) to apply the RF voltage and DC voltage at the first quadrupole 4 for which the detector means 3 is detecting a signal higher than a minimum detection value.

In another embodiment of the invention the evaluation of the mass range $\rho_{massdetect}(m_{cal})$ is performed by evaluating the masses $m_{set}$ set at the first function of the amplitude of the RF(m, $w_{cal}$) and the second function of the DC voltage DC(m, $w_{cal}$) to apply the RF voltage and DC voltage at the first quadrupole for which the detection means 3 is detecting a signal which is higher than a percentage of the highest signal detected by the detection means. Preferable the evaluation of the mass range $\rho_{massdetect}(m_{cal})$ is performed by evaluating the masses $m_{set}$ set at the first function of the amplitude of the RF(m, $w_{cal}$) and the second function of the DC voltage DC(m, $w_{cal}$) to apply the RF voltage and DC voltage at the first quadrupole for which the detection means is detecting a signal which is higher than 20 percent of the highest signal detected by the detection means 3, in particular higher than 10 percent of the highest signal detected by the detection means.

During the individual determination of the corresponding value of the amplitude of the RF voltage $RF_{det}(m_{cal})$ and value of DC voltage $DC_{det}(m_{cal})$ to a selected mass $m_{cal}$ the individual definition of a corresponding the amplitude of the RF voltage $RF_{det}(m_{cal})$ and DC voltage $DC_{det}(m_{cal})$ (step ii a), 61) of the selected mass $m_{cal}$ is done by changing the value of the first function $RF(m_{cal}, w_{cal})$ and the value of the second function $DC(m_{cal}, w_{cal})$ corresponding to the selected mass $m_{cal}$ depending on the deviation of the filter window width $\Delta w(m_{cal})$ of the selected mass $m_{cal}$.

In particular the individual determination of a corresponding value of the amplitude of the RF voltage $RF_{det}(m_{cal})$ and value of the DC voltage $DC_{det}(m_{cal})$ of the selected mass $m_{cal}$ is done by adding to the value of the first function $RF(m_{cal}, w_{cal})$ and/or the value of the second function $DC(m_{cal}, w_{cal})$ corresponding to the selected mass $m_{cal}$ the value the deviation of the filter window width $\Delta w(m_{cal})$ of the selected mass $m_{cal}$ multiplied with a factor corresponding to the RF voltage $\Delta w\text{-factor}_{RF}$ and/or DC voltage $\Delta w\text{-factor}_{DC}$.

$$RF(m_{cal}, w_{cal})_{new} = RF(m_{cal}, w_{cal}) + \Delta w\text{-factor}_{RF} * \Delta w(m_{cal})$$

$$DC(m_{cal}, w_{cal})_{new} = DC(m_{cal}, w_{cal}) + \Delta w\text{-factor}_{DC} * \Delta w(m_{cal})$$

In particular the individual determination of a corresponding value of the amplitude of the RF voltage $RF_{det}(m_{cal})$ of the selected mass $m_{cal}$ is done by adding to the value of the first function $RF(m_{cal}, w_{cal})$ corresponding to the selected mass $m_{cal}$ the value of the deviation of the filter window width $\Delta w(m_{cal})$ of the selected mass $m_{cal}$ multiplied with a linear factor DClinear of the second function DC(m, $w_{cal}$) divided by a linear factor RFlinear of the first function RF(m, $w_{cal}$).

$$RF(m_{cal}, w_{cal})_{new} = RF(m_{cal}, w_{cal}) + DC\text{linear}/RF\text{linear} * \Delta w(m_{cal})$$

The individual determination of the corresponding value of the amplitude of the RF voltage $RF_{det}(m_{cal})$ and value of DC voltage $DC_{det}(m_{cal})$ to a selected mass $m_{cal}$ (step ii a), 61) may be done by adding an offset to the value of the first function $RF(m_{cal}, w_{cal})$ and/or the value of the second function $DC(m_{cal}, w_{cal})$ corresponding to the selected mass $m_{cal}$.

In the next step of the calibration of the first quadrupole (step ii b), 62) shown in FIG. 4 functions are fitted to the reference points determined for the calibration masses in the step described before. A function $RF_{fit}(m, w_{cal})$ of the selected mass m is fitted to the values of the amplitude of the RF voltage $RF_{det}(m_{cal})$ corresponding to the several selected masses $m_{cal}$ and a function $DC_{fit}(m, w_{cal})$ of the selected mass m is fitted to the values of DC voltages $DC_{det}(m_{cal})$ corresponding to the several selected masses $m_{cal}$. The function $RF_{fit}(m, w_{cal})$ of the selected mass m is fitted to the value of the amplitude of the RF voltage $RF_{det}(m_j)$ of each mass $m_j$ (j=1, 2, 3, . . . , n) of set $M_{cal}$ of calibration masses $m_{cal}$. The function $DC_{fit}(m, w_{cal})$ of the selected mass m is fitted to value of DC voltage $DC_{det}(m_j)$ of each mass $m_j$ (j=1, 2, 3, . . . , n) of set $M_{cal}$ of calibration masses $m_{cal}$.

In general there are various approaches to fit a function $RF_{fit}(m, w_{cal})$ of the selected mass m to the determined values of the amplitude of the RF voltage $RF_{det}(m_{cal})$ corresponding to the several selected masses $m_{cal}$ and a function $DC_{fit}(m, w_{cal})$ of the selected mass m to the determined values of DC voltages $DC_{det}(m_{cal})$ corresponding to the several selected masses $m_{cal}$.

In one embodiment of the invention when fitting of a function $RF_{fit}(m, w_{cal})$ of the selected mass m to the values of the amplitude of the RF voltage $RF_{det}(m_{cal})$ corresponding to the several selected masses $m_{cal}$ (step ii b)) the function $RF_{fit}(m, w_{cal})$ is summation of a constant $RFoffset_{fit}$ and a linear function of the selected mass m.

In another embodiment of the invention when fitting a function $DC_{fit}(m, w_{cal})$ of the selected mass m to the values of DC voltage $DC_{det}(m_{cal})$ corresponding to the several selected masses $m_{cal}$ (step ii b), 62) the function $DC_{fit}(m, w_{cal})$ is a summation of a constant value $DCoffset_{fit}$ and a linear function of the selected mass m.

In another embodiment of the invention when fitting a function $RF_{fit}(m, w_{cal})$ of the selected mass m to the values of the amplitude of the RF voltage $RF_{det}(m_{cal})$ corresponding to the several selected masses $m_{cal}$ (step ii b)) the function $RF_{fit}(m, w_{cal})$ is a sum of functions comprising a linear function of the selected mass m.

In another embodiment of the invention when fitting a function $RF_{fit}(m, w_{cal})$ of the selected mass m to the values of the amplitude of the RF voltage $RF_{det}(m_{cal})$ corresponding to the several selected masses $m_{cal}$ (step ii b)) the function $RF_{fit}(m, w_{cal})$ is a sum of functions comprising a quadratic function of the selected mass m.

In another embodiment of the invention when fitting a function $RF_{fit}(m, w_{cal})$ of the selected mass m to the values of the amplitude of the RF voltage $RF_{det}(m_{cal})$ corresponding to the several selected masses $m_{cal}$ (step ii b)) the function $RF_{fit}(m, w_{cal})$ is a sum of functions comprising an exponential function of the selected mass m.

In another embodiment of the invention when fitting a function $RF_{fit}(m, w_{cal})$ of the selected mass m to the values of the amplitude of the RF voltage $RF_{det}(m_{cal})$ corresponding to the several selected masses $m_{cal}$ (step ii b)) the function $RF_{fit}(m, w_{cal})$ is a sum of functions comprising an exponential function whose exponent is a linear function of the selected mass m.

In another embodiment of the invention when fitting a function $RF_{fit}(m, w_{cal})$ of the selected mass m to the values of the amplitude of the RF voltage $RF_{det}(m_{cal})$ corresponding to the several selected masses $m_{cal}$ (step ii b), 62) the function $RF_{fit}(m, w_{cal})$ is a sum of functions comprising at least two exponential functions whose exponents are different linear functions of the selected mass m.

In another embodiment of the invention when fitting a function $RF_{fit}(m, w_{cal})$ of the selected mass m to the values of the amplitude of the RF voltage $RF_{det}(m_{cal})$ corresponding to the several selected masses $m_{cal}$ (step ii b), 62) the function $RF_{fit}(m, w_{cal})$ is a sum of functions containing only two exponential functions whose exponents are different linear functions of the selected mass m. Only these two exponential functions are summed up in the function $RF_{fit}(m, w_{cal})$.

In another embodiment of the invention when fitting a function $DC_{fit}(m, w_{cal})$ of the selected mass m to the values of DC voltage $DC_{det}(m_{cal})$ corresponding to the several selected masses $m_{cal}$ (step ii b), 62) the function $DC_{fit}(m, w_{cal})$ is a sum of functions comprising a linear function of the selected mass m.

In another embodiment of the invention when fitting a function $DC_{fit}(m, w_{cal})$ of the selected mass m to the values of DC voltage $DC_{det}(m_{cal})$ corresponding to the several selected masses $m_{cal}$ (step ii b), 62) the function $DC_{fit}(m, w_{cal})$ is a sum of functions comprising a quadratic function of the selected mass m.

In another embodiment of the invention when fitting a function $DC_{fit}(m,w_{cal})$ of the selected mass m to the values of DC voltage $DC_{det}(m_{cal})$ corresponding to the several selected masses $m_{cal}$ (step ii b), 62) the function $DC_{fit}(m, w_{cal})$ is a sum of functions comprising an exponential function of the selected mass m.

In another embodiment of the invention when fitting a function $DC_{fit}(m,w_{cal})$ of the selected mass m to the values of DC voltage $DC_{det}(m_{cal})$ corresponding to the several selected masses $m_{cal}$ (step ii b), 62) the function $DC_{fit}(m, w_{cal})$ is a sum of functions comprising an exponential function whose exponent is a linear function of the selected mass m.

In another embodiment of the invention when fitting a function $DC_{fit}(m,w_{cal})$ of the selected mass m to the values of DC voltage $DC_{det}(m_{cal})$ corresponding to the several selected masses $m_{cal}$ (step ii b), 62) the function $DC_{fit}(m, w_{cal})$ is a sum of functions comprising at least two exponential functions whose exponents are different linear functions of the selected mass m.

In another embodiment of the invention when fitting a function $DC_{fit}(m,w_{cal})$ of the selected mass m to the values of DC voltage $DC_{det}(m_{cal})$ corresponding to the several selected masses $m_{cal}$ (step ii b), 62) the function $DC_{fit}(m, w_{cal})$ is a sum of functions containing only two exponential functions whose exponents are different linear functions of the selected mass m.

In preferred embodiment of the invention when fitting a function $RF_{fit}(m,w_{cal})$ of the selected mass m to the values of the amplitude of the RF voltage $RF_{det}(m_{cal})$ corresponding to the several selected masses $m_{cal}$ and fitting a function $DC_{fit}(m,w_{cal})$ of the selected mass m to the values of DC voltage $DC_{det}(m_{cal})$ corresponding to the several selected masses $m_{cal}$ (step ii b), 62) the function $RF_{fit}(m,w_{cal})$ is the summation of a constant value $RFoffset_{fit}$, a linear function of the selected mass m, a quadratic function of the selected mass m and two exponential functions whose exponents are different linear functions of the selected mass m and the function $DC_{fit}(m,w_{cal})$ is summation of a constant value $DCoffset_{fit}$ and a linear function of the selected mass m.

In another preferred embodiment of the invention when fitting a function $RF_{fit}(m,w_{cal})$ of the selected mass m to the values of the amplitude of the RF voltage $RF_{det}(m_{cal})$ corresponding to the several selected masses $m_{cal}$ and fitting a function $DC_{fit}(m,w_{cal})$ of the selected mass m to the values of DC voltage $DC_{det}(m_{cal})$ corresponding to the several selected masses $m_{cal}$ (step ii b)) the function $RF_{fit}(m,w_{cal})$ is the summation of a constant value $RFoffset_{fit}$, a linear function of the selected mass m, a quadratic function of the selected mass m and two exponential functions whose exponents are different linear functions of the selected mass m and the function $DC_{fit}(m,w_{cal})$ is the summation of a constant value $DCoffset_{fit}$, a linear function of the selected mass m, a quadratic function of the selected mass m and two exponential functions whose exponents are different linear functions of the selected mass m.

In another preferred embodiment of the invention fitting a function $RF_{fit}(m,w_{cal})$ of the selected mass m to the values of the amplitude of the RF voltage $RF_{det}(m_{cal})$ corresponding to the several selected masses $m_{cal}$ and fitting a function $DC_{fit}(m,w_{cal})$ of the selected mass m to the values of DC voltage $DC_{det}(m_{cal})$ corresponding to the several selected masses $m_{cal}$ (step ii b), 62) the function $RF_{fit}(m,w_{cal})$ is summation of a constant value $RFoffset_{fit}$ and a linear function of the selected mass m and the function $DC_{fit}(m, w_{cal})$ is summation of a constant value $DCoffset_{fit}$ and a linear function of the selected mass m.

In another particular preferred embodiment of the invention when fitting a function $RF_{fit}(m,w_{cal})$ of the selected mass m to the values of the amplitude of the RF voltage $RF_{det}(m_{cal})$ corresponding to the several selected masses $m_{cal}$ and fitting a function $DC_{fit}(m,w_{cal})$ of the selected mass m to the values of DC voltage $DC_{det}(m_{cal})$ corresponding to the several selected masses $m_{cal}$ (step ii b), 62) in a first step summation of a constant value $RFoffset_{fit}$ and a linear function of the selected mass m is fitted for the function $RF_{fit}(m,w_{cal})$ and summation of a constant value $DCoffset_{fit}$ and a linear function of the selected mass m is fitted for the function $DC_{fit}(m,w_{cal})$ and in a second step the function $RF_{fit}(m,w_{cal})$ is fitted by adding to the summation of a constant value $RFoffset_{fit}$ and a linear function of the selected mass m fitted in the first step the summation of a constant value, a quadratic function of the selected mass m and two exponential functions whose exponents are different linear functions of the selected mass m and the function $DCF_{fit}(m,w_{cal})$ is fitted by adding to the summation of a constant value $DCoffset_{fit}$ and a linear function of the selected mass m fitted in the first step the summation of a constant, a quadratic function of the selected mass m and two exponential functions whose exponents are different linear functions of the selected mass m.

In another embodiment of the invention the fitting of a function $RF_{fit}(m,w_{cal})$ of the selected mass m to the values of the amplitude of the RF voltage $RF_{det}(m_{cal})$ corresponding to the several selected masses $m_{cal}$ and fitting a function $DC_{fit}(m,w_{cal})$ of the selected mass m to the values of DC voltage $DC_{det}(m_{cal})$ corresponding to the several selected masses $m_{cal}$ (step ii b), 62) is done by a method of polynomial fit, cubic spline fit or nonlinear least square fit.

In the next step of the calibration of the first quadrupole (step ii c), 63) shown in FIG. 5 the fit of the functions fitted in the step above (step ii b), 62) is checked. This check is performed for at least some of the several selected masses $m_{check}$. These masses $m_{check}$ belong to the several masses $m_{cal}$ for which in the foregoing step ii a) 61 the RF voltage and DC voltage has been determined. For which of the several selected masses $m_{check}$ the check is performed is set during the setting of the calibration parameters 60.

In one embodiment the check is performed for all masses $m_{cal}$ for which in the foregoing step ii a) the RF voltage and DC voltage has been determined. In other embodiments the check is performed for some of the masses $m_{cal}$ for which in the foregoing step ii a) 61 the RF voltage and DC voltage has been determined. So the set $M_{check}$ of masses $m_{check}$ for which the check is performed is the set $M_{cal}$ of calibration masses $m_{cal}$ or a subset of the set $M_{cal}$ of calibration masses $m_{cal}$.

$$m_{check} \epsilon M_{check};\ M_{check} \subseteq M_{cal}$$

If for k masses $m_{check}$ the check is performed the set $M_{check}$ of masses $m_{check}$ is:

$$M_{check} = \{m_{check_1}, m_{check_2}, \ldots, m_{check_k}\};\ k \leq n$$

So for each mass $m_{check_i}$ (i=1, 2, 3, . . . , k) of set $M_{check}$ of masses $m_{check}$ the check is performed.

The masses $m_{check}$ for which the check is performed are detected at the detection means 3 via the second analyzer 5 operating in a mass analysing mode during scanning the first quadrupole 4 operating as pre-selecting analyzer in the mass selecting mode selecting masses in the mass filter window having the filter window width $w_{cal}$ over a mass range $\rho_{mass_m_check}$ assigned to the selected mass $m_{check}$, comprising the selected mass $m_{check}$ and being larger than the filter window width $w_{cal}$ of the mass filter window of the mass selecting mode of the first quadrupole. The assignment of a mass range $\rho_{mass_m_check}$ to each the of selected masses $m_{check}$ is performed during the setting of the calibration parameters 60.

The amplitude of the RF voltage applied to the electrodes of the first quadrupole 4 is given by the function $RF_{fit}(m, w_{cal})$ and the DC voltage applied to the electrodes of the first quadrupole is given by the function $DC_{fit}(m, w_{cal})$.

So each mass $m_{check_i}$ (i=1, 2, 3, . . . , k) of set $M_{check}$ of masses $m_{check}$ is one after the other detected at the detection means 3 via the second analyzer operating 5 in a mass analysing mode during scanning the first quadrupole 4 operating as pre-selecting analyzer in the mass selecting mode selecting masses in the mass filter window having the filter window width $w_{cal}$ over a mass range $\rho_{mass_m_check_i}$ assigned to the selected mass $m_{check_i}$. This mass range $\rho_{mass_m_check_i}$ is comprising the selected mass $m_{check_i}$ and is larger than the filter window width $w_{cal}$ of the mass filter window of the mass selecting mode of the first quadrupole 4. During the scanning of the first quadrupole 4 the amplitude of the RF voltage applied to the electrodes of the first quadrupole is given by the function $RF_{fit}(m, w_{cal})$ and the DC voltage applied to the electrodes of the first quadrupole is given by the function $DC_{fit}(m, w_{cal})$.

That each mass $m_{check_i}$ (i=1, 2, 3, . . . , k) of set $M_{check}$ of masses $m_{check}$ is one after the other is detected individually at the detection means 3 via the second analyzer operating 5 in a mass analysing mode during scanning the first quadrupole 4 operating as pre-selecting analyzer in the mass selecting mode selecting masses in the mass filter window having the filter window width $w_{cal}$ over a mass range $\rho_{mass_m_check_i}$ assigned to the selected mass $m_{check_i}$, is shown in FIG. 5 by the arrow 72. Before step ii c) 63 a mass indicator i is set to i=0. This indicator is increased before a detection of a mass $m_{check_i}$ by i=i+1. So at first the detection of a mass $m_{check_i}$ is executed for the mass $m_{check_1}$ (i=1). The mass indicator i is increased with every repetition shown by the arrow 72, so that during the second detection of a mass $m_{check_i}$ the detection is executed for the mass $m_{check_2}$ (i=2). This detection is in that way repeated up to the mass $m_{check_k}$ (i=k). If i=k there is no more repetition of a detection of a mass $m_{check_i}$ and the next step of the calibration (step ii d, 64) is executed. So for all of the masses $m_{check}$, the set $M_{check}$ of masses $m_{check}$ containing the masses $$M_{check}=\{m_{check_1}, m_{check_2}, \ldots, m_{check_k}\}$$

a detection at the detection means 3 via the second analyzer operating 5 in a mass analysing mode during scanning the first quadrupole 4 operating as pre-selecting analyzer in the mass selecting mode selecting masses in the mass filter window having the filter window width $w_{cal}$ over a mass range $\rho_{mass_m_check_i}$ assigned to the selected mass $m_{check_i}$ is executed.

In one embodiment of the invention when at least some of the several selected masses $m_{check}$ are detected at the detection means 3 via the second analyzer 5 operating in a mass analysing mode during scanning the first quadrupole 4 operating as pre-selecting analyzer in the mass selecting mode selecting masses in the mass filter window having the filter window width $w_{cal}$ over a mass range $\rho_{mass_m_check}$ assigned to the selected mass $m_{check}$, comprising the selected mass $m_{check}$ and being larger than the filter window width $w_{cal}$ of the mass filter window of the mass selecting mode of the first quadrupole 4, the amplitude of the RF voltage applied to the electrodes of the first quadrupole 4 given by the function $RF_{fit}(m)$ and the DC voltage applied to the electrodes of the first quadrupole given by the function $DC_{fit}(m)$ (step ii c), 63) all of the several selected masses $m_{cal}$ for which a corresponding value of the amplitude of the RF voltage $RF_{det}(m_{cal})$ and value of DC voltage $DC_{det}(m_{cal})$ is determined individually are scanned with the first quadrupole 4 and detected at the detection means. So in this embodiment the same masses $m_{cal}$ for which a corresponding value of the amplitude of the RF voltage $RF_{det}(m_{cal})$ and value of DC voltage $DC_{det}(m_{cal})$ is determined in step ii a), 61 are checked in step ii c), 63. So in this embodiment the set $M_{check}$ of masses $m_{check}$ for which the check is performed is the set $M_{cal}$ of calibration masses $m_{cal}$.

In other embodiments not calibration masses $m_{cal}$ are checked in step ii c) 63 as mass $m_{check}$. In some embodiments not more than two-thirds of the calibration masses $m_{cal}$, preferably not more than half of the calibration masses $m_{cal}$ and particular not more than one-third of the calibration masses $m_{cal}$ are checked in step ii c) 63 as mass $m_{check}$.

In some embodiments the number of masses $m_{check}$ checked in step ii c) 63 is between 2 and 15, preferable between 4 and 12 and particular preferable between 6 and 10.

In the next step of the calibration of the first quadrupole 4 (step ii d, 64) shown in FIG. 5 the check of the fitted functions $RF_{fit}(m, w_{cal})$ and $DC_{fit}(m, w_{cal})$ is evaluated. For each of these detected selected masses $m_{check}$ a shift of the peak position $\Delta m(m_{check})$ and/or a deviation of the filter window width $\Delta w(m_{check})$ of the mass selecting mode of the first quadrupole 4 selecting masses in the mass filter window having the filter window width $w_{cal}$, when applying the RF voltage with the amplitude given by the function $RF_{fit}(m, w_{cal})$ and the DC voltage given by the function $DC_{fit}(m, w_{cal})$, is evaluated. By the parameters shift of the peak position $\Delta m(m)$ and/or a deviation of the filter window width $\Delta w(m)$ it shall be determined how big is the deviation of the mass peaks of the detected selected masses $m_{check}$ in the detection means 3 when the first quadrupole 4 operating as pre-selecting analyzer in the mass selecting mode selecting masses in the mass filter window having the filter window width $w_{cal}$ is scanned over the mass range $\rho_{mass_m_check}$ assigned to the selected mass $m_{check}$ from the expected mass peak of the detected selected masses $m_{check}$ when this detected selected masses $m_{check}$ is in the center of the mass filter window of the first quadrupole 4 and the filter mass window has the filter window width $w_{cal}$. The filter mass window of the first quadrupole 4 is mapped on the detector means 3 by the mass analysing mode of the second analyzer 5 during scanning the mass range $\rho_{mass_m_check}$ by the first quadrupole 4. This may be a convolution of the mass filter window of the first quadrupole 4 with the mass filter window of the second analyzer 5 operating in the mass analysing mode. The filter window width $w_2$ of the mass filter window of the second mass analyzer 5 operating in the mass analysing mode is nearly 1 u, preferably exactly 1 u (having a tolerance typically for a mass analyzer according to the state of the art).

For each mass $m_{check_i}$ (i=1, 2, 3, . . . , k) of set $M_{check}$ of masses $m_{check}$ a shift of the peak position $\Delta m(m_{check_i})$ and/or a deviation of the filter window width $\Delta w(m_{check_i})$ of the mass selecting mode of the first quadrupole 4 selecting masses in the mass filter window having the filter window width $w_{cal}$, when applying the RF voltage with the amplitude given by the function $RF_{fit}(m, w_{cal})$ and the DC voltage given by the function $DC_{fit}(m, w_{cal})$, is evaluated.

At the beginning of the evaluation of the check of the fitted functions $RF_{fit}(m, w_{cal})$ and $DC_{fit}(m, w_{cal})$ after the scanning of the first quadrupole 4 over the mass range $\rho_{mass_m_check}$ (step ii c, 63) for a selected mass $m_{check}$ it is evaluated for which masses $m_{set_m_check}$ of the mass range $\rho_{mass_m_check}$ when set at the first function of the amplitude of the $RF_{fit}(m, w_{cal})$ and the second function of the DC voltage $DC_{fit}(m, w_{cal})$ to apply the RF voltage and DC voltage at the first quadrupole 4 the detection means 3 is detecting the selected mass $m_{check}$.

According to the result of this evaluation the evaluation of the shift of the peak position $\Delta m(m_{check})$ of the detected selected masses $m_{check}$ (step ii d)) is performed by calculating the difference between the mass $m_{set_m_check_c}$ at the center of the scanned masses $m_{set_m_check}$ at which the detection means is detecting the selected mass $m_{check}$ and the selected mass $m_{check}$.

$$\Delta m(m_{check})=m_{set_m_check_c}-m_{check}$$

Like at all differences ($\Delta m(\ldots)$, $\Delta w(\ldots)$) calculated during the execution of the inventive method the difference $\Delta m(m_{check})$ may have positive and negative values or be in the best case zero. According to a positive or negative value the mass $m_{set_m_check_c}$ at the center of the scanned masses can be shifted to a higher value or lower value in comparison to the expected value $m_{check}$.

According to the result of before mentioned evaluation of the masses $m_{set_m_check}$ the evaluation of the deviation of the filter window width $\Delta w(m_{check})$ of the detected selected mass $m_{check}$ (step ii d)) is performed by evaluating a filter window width $w_{check}(m_{check})$ from the masses $m_{set_m_check}$ of the mass range $\rho_{mass_m_check}$ at which the detection means is detecting the selected mass $m_{check}$ and calculating the difference between the filter window width $w_{check}(m_{check})$ and the filter window width $w_{cal}$ for which the first quadrupole has to be calibrated.

$$\Delta w(m_{check})=w_{check}(m_{check})-w_{cal}$$

If $\Delta w(m_{check})$ has a positive value the detected peak for the mass $m_{check}$ during scanning the first quadrupole is too wide and for a negative value to narrow.

In some embodiments of the invention the filter window width $w_{check}(m_{check})$ from the masses $m_{set_m_check}$ is determined by determining at which masses $m_{set_m_check}$ during scanning the first quadrupole over the mass range $\rho_{mass_m_check}$ the detection means is detecting a signal higher than a threshold value. The filter window width $w_{check}(m_{check})$ is then the mass range in which these signals are detected.

In other embodiments of the invention the filter window width $w_{check}(m_{check})$ from the masses $m_{set_m_check}$ is determined by determining at which masses $m_{set_m_check}$ during scanning the first quadrupole over the mass range $\rho_{mass_m_check}$ the detection means is detecting a signal which is higher than a percentage of the highest signal detected by the detection means during the scanning. Preferable this percentage is 20% and particular preferable this percentage is 10%.

In the next step of the calibration of the first quadrupole 4 (step ii e), 65) shown in FIG. 6 a decision about the repetition of the calibration has to be defined. It is decided to repeat the calibration steps ii a) to ii e) if the evaluated values of the shift of the peak position $\Delta m(m_{check})$ and/or the deviation of the filter window width $\Delta w(m_{check})$ of the detected selected masses $m_{check}$ do not comply with a quality condition of the calibration or if another repetition condition is fulfilled. By such a quality condition can be made sure that when a RF voltage with an amplitude given by the function $RF_{fit}(m, w_{cal})$ as calibration function and a DC voltage given by the function $DC_{fit}(m, w_{cal})$ as calibration function are applied to electrodes of the first quadrupole 4 that the shift of the peak position $\Delta m(m_{check})$ does not exceed a threshold value $\Delta m_{max}$ and/or the deviation of the filter window width $\Delta w(m_{check})$ does not exceed a threshold value $\Delta w_{max}$. These threshold values $\Delta m_{max}$ and $\Delta w_{max}$ may be the same for all detected selected masses $m_{check}$. In another embodiment there may be different threshold values $\Delta m_{max_i}$ and $\Delta w_{max_i}$ for different detected selected masses $m_{check_i}$. In other embodiments of the invention the quality condition may be that only for a specific number of detected selected masses $m_{check}$ $\Delta m(m_{check})$ does not exceed a threshold value $\Delta m_{max}$ and/or the deviation of the filter window width $\Delta w(m_{check})$ does not exceed a threshold value $\Delta w_{max}$. Also in this embodiment there may be different threshold values $\Delta m_{max_i}$ and $\Delta w_{max_i}$ for different detected selected masses $m_{check_i}$.

It is therefore decided to repeat the calibration steps ii a) to ii e) if the evaluated values of the shift of the peak position $\Delta m(m_{check_i})$ and/or the deviation of the filter window width $\Delta w(m_{check_i})$ of the masses $m_{check_i}$ (i=1, 2, 3, . . . , k) of set $M_{check}$ of masses $m_{check}$ do not comply with a quality condition of the calibration or if another repetition condition is fulfilled.

During the repetition of the calibration steps ii a) to ii e) in step ii a) in the mass selecting mode of the first quadrupole the functions $RF_{fit}(m, w_{cal})$ as the first function RF(m, w) and $DC_{fit}(m, w_{cal})$ as the second function DC(m, w) are used.

In an embodiment of the invention during a repetition of the calibration steps ii a) to ii e) the factor $\Delta w\text{-factor}_{DC}$ with which the value the deviation of the filter window width $\Delta w(m_{cal})$ of the selected mass $m_{cal}$ is multiplied and then added to the value of the second function $DC(m_{cal}, w_{cal})$ of the selected mass $m_{cal}$ during step ii a) 61 to individually determine the DC voltage $DC(m_{cal}, w_{cal})$ of the selected mass $m_{cal}$ is changed. Preferably the change of the factor $\Delta w\text{-factor}_{DC}$ during a repetition of the calibration steps ii a) to ii e) is such indicates that the determination of the DC voltage $DC(m_{cal}, w_{cal})$ of the selected mass $m_{cal}$ is converging.

In another preferred embodiment of the invention during the repetition of the calibration steps ii a) to ii e) the factor $\Delta w\text{-factor}_{DC}$ is only changed if during the repetition of the calibration steps ii a) to ii e) it is observed that the deviation of the filter window width $\Delta w(m_{cal})$ of the selected mass $m_{cal}$ has not changed compared to the previous calibration steps such that the deviation of the filter window width $\Delta w(m_{cal})$ of the selected mass $m_{cal}$ is converging.

In an embodiment of the invention the quality condition of the calibration to be fulfilled such that the repetition of the calibration steps ii a) to ii e) is stopped is that all evaluated values of a shift of the peak position $\Delta m(m_{check})$ of the mass selecting mode of the detected selected masses $m_{check}$ are below a critical threshold $\Delta m_{max}$ and all deviations of the filter window width $\Delta w(m_{check})$ of the mass selecting mode of the measured selected masses m are below a second critical threshold $\Delta w_{max}$.

In an embodiment of the invention the calibration steps ii a) to ii e) are repeated if the quality conditions are not fulfilled, using in step ii a), 61 in the mass selecting mode of the first quadrupole the functions $RF_{fit}(m,w_{cal})$ as the first function RF(m,w) and $DC_{fit}(m,w_{cal})$ as the second function DC(m,w), determining individually corresponding values of the amplitude of the RF voltage $RF_{det}(m_{cal})$ and corresponding values of DC voltage $DC_{det}(m_{cal})$ only for such of the detected selected masses $m_{check}$ for which the evaluated value of the shift of the peak position $\Delta m(m_{check})$ of the mass selecting mode is not below a critical threshold $\Delta m_{max}$ or the deviation of the filter window width $\Delta w(m_{check})$ of the mass selecting mode is not below a second critical threshold $\Delta w_{max}$.

The repetition of the calibration steps ii a) to ii e) is executed according to the decision until all quality conditions of the calibration are fulfilled and no repetition condition is fulfilled or the calibration steps ii a) to ii e) have been executed N times.

The number N defining the number of calibration runs after which the calibration is finished is set during the setting of the calibration parameters 60.

In an embodiment of the invention the repetition condition to be fulfilled such that the repetition of the calibration steps ii a) to ii e) is stopped is that the calibration steps ii a) to ii e) has been repeated one time. In this case is N=2 because the calibration is stopped after one repetition of the calibration. If not all quality conditions of the calibration are not fulfilled at that moment the calibration was not successful.

In other embodiments of the invention the repetition condition to be fulfilled such that the repetition of the calibration steps ii a) to ii e) is stopped is that the calibration steps ii a) to ii e) has been repeated 2, 3, 5, 7 or 10 times.

If all quality conditions of the calibration are fulfilled and no repetition condition is fulfilled the calibration by the steps ii a) to ii e) is finished and a RF voltage with an amplitude given by the function $RF_{fit}(m, w_{cal})$ as calibration function and a DC voltage given by the function $DC_{fit}(m, w_{cal})$ as calibration function is applied to electrodes of the first quadrupole 4 afterwards during the measurement with the mass spectrometer calibrated with the method according to the invention. So the functions function $RF_{fit}(m, w_{cal})$ and $DC_{fit}(m, w_{cal})$ fitted in the last step ii b) have been defined as suitable calibration functions with which the first quadrupole can be operated as a pre-selecting mass analyzer in a mass selecting mode selecting masses in a mass filter window having a filter window width $w_{cal}$.

If on the other hand the calibration steps ii a) to ii e) have been executed N times and after that not all quality conditions of the calibration are fulfilled or a repetition condition is fulfilled the calibration is stopped because it was not successful. In this case the inventive method for calibrating a mass spectrometer 1 may be started again having a different setting of the calibration parameters like different initial functions of the amplitude of the RF voltage $RF_{ini}(m, w_{cal})$ and the DC voltage $DC_{ini}(m, w_{cal})$, a new set of the several selected masses $M_{cal}$ to determine individually corresponding value of the amplitude of the RF voltage $RF_{det}(m_{cal})$ and value of DC voltage $DC_{det}(m_{cal})$ applied to the electrodes of the first quadrupole 4, a new set of masses $M_{check}$ for which the check of the fitted functions $RF_{fit}(m, w_{cal})$ and $DC_{fit}(m, w_{cal})$ is performed, a new fitting procedure using e.g. a modified fitting function or another fitting algorithm, new quality conditions or repetition conditions or an higher number of possible repetitions N of the calibration steps.

In one embodiment of the invention the calibrating of the first quadrupole 4 is repeated after changing at least one kind of function used in calibration step ii b) to fit a function $RF_{fit}(m,w_{cal})$ of the selected mass m to the values of the amplitude of the RF voltage $RF_{det}(m_{cal})$ corresponding to the several selected masses $m_{cal}$ and to fit a function $DC_{fit}(m,w_{cal})$ of the selected mass m to the values of DC voltage $DC_{det}(m_{cal})$ corresponding to the several selected masses $m_{cal}$ or after changing at least one of the quality conditions of the calibration when not all quality conditions of the calibration are fulfilled after the calibration steps ii a) to ii e) have been executed N times. In this embodiment the calibration is started again after N repetitions of the calibration with the aim to find calibration functions by changing to kind of function fitted to the values of the amplitude of the RF voltage $RF_{det}(m_{cal})$ corresponding to the several selected masses $m_{cal}$ or values of DC voltage $DC_{det}(m_{cal})$ corresponding to the several selected masses $m_{cal}$.

In another embodiments of the invention the calibrating of the first quadrupole 4 is repeated after changing at least one function of the initial function $RF_{ini}(m,w_{cal})$ for the first function RF(m,w) and the initial function $DC_{ini}(m,w_{cal})$ for the second function DC(m,w) at the beginning of the calibration of the first quadrupole in the mass selecting mode when not all quality conditions of the calibration are fulfilled after the calibration steps ii a) to ii e) have been executed N times. In this embodiment the calibration is started again after N repetitions of the calibration with the aim to find calibration functions by starting the calibration again with at least the changed initial function $RF_{ini}(m,w_{cal})$ or $DC_{ini}(m,w_{cal})$.

In an embodiment of the inventive method the step ii) of calibrating the first quadrupole 4 in the mass selecting mode is repeated several times for different values of the filter window width $w_{cal}$ in the range between 2 u and 30 u, preferable in the range between 5 u and 20 u and particular preferable in the range between 8 u and 15 u.

Preferable for two selected masses $m_{coarse}$ a corresponding value of the amplitude of the RF voltage $RF_{det}(m_{coarse})$ and value of DC voltage $DC_{det}(m_{coarse})$ is determined individually before for several selected masses $m_{cal}$ a corresponding value of the amplitude of the RF voltage $RF_{det}(m_{cal})$ and value of DC voltage $DC_{det}(m_{cal})$ is determined individually (step ii a, 61)). In particular the two selected masses $m_{coarse}$ for which a corresponding value of the amplitude of the RF voltage $RF_{det}(m_{coarse})$ and value of DC voltage $DC_{det}(m_{coarse})$ is determined individually before for several selected masses $m_{cal}$ a corresponding value of the amplitude of the RF voltage $RF_{det}(m_{cal})$ and value of DC voltage $DC_{det}(m_{cal})$ is determined individually are the masses of the molecules $^{16}O^{40}Ar$ and $^{40}Ar^{40}Ar$.

After for the two selected masses $m_{coarse}$ a corresponding value of the amplitude of the RF voltage $RF_{det}(m_{coarse})$ and value of DC voltage $DC_{det}(m_{coarse})$ is determined individually, a function $RF_{coarse}(m, w_{cal})$ of the selected mass m is fitted to the values of the amplitudes of the RF voltage $RF_{det}(m_{coarse})$ corresponding to the two selected masses $m_{coarse}$ by changing a linear factor RFlinear and a constant offset value RFoffset of the initial function $RF_{ini}(m, w_{cal})$ and a function $DC_{coarse}(m, w_{cal})$ of the selected mass m is fitted to the values of DC voltage $DC_{det}(m_{coarse})$ corresponding to the two selected masses $m_{coarse}$ by changing a linear factor DClinear and a constant offset value DCoffset of the initial function $DC_{ini}(m, w_{cal})$.

Figure 7:
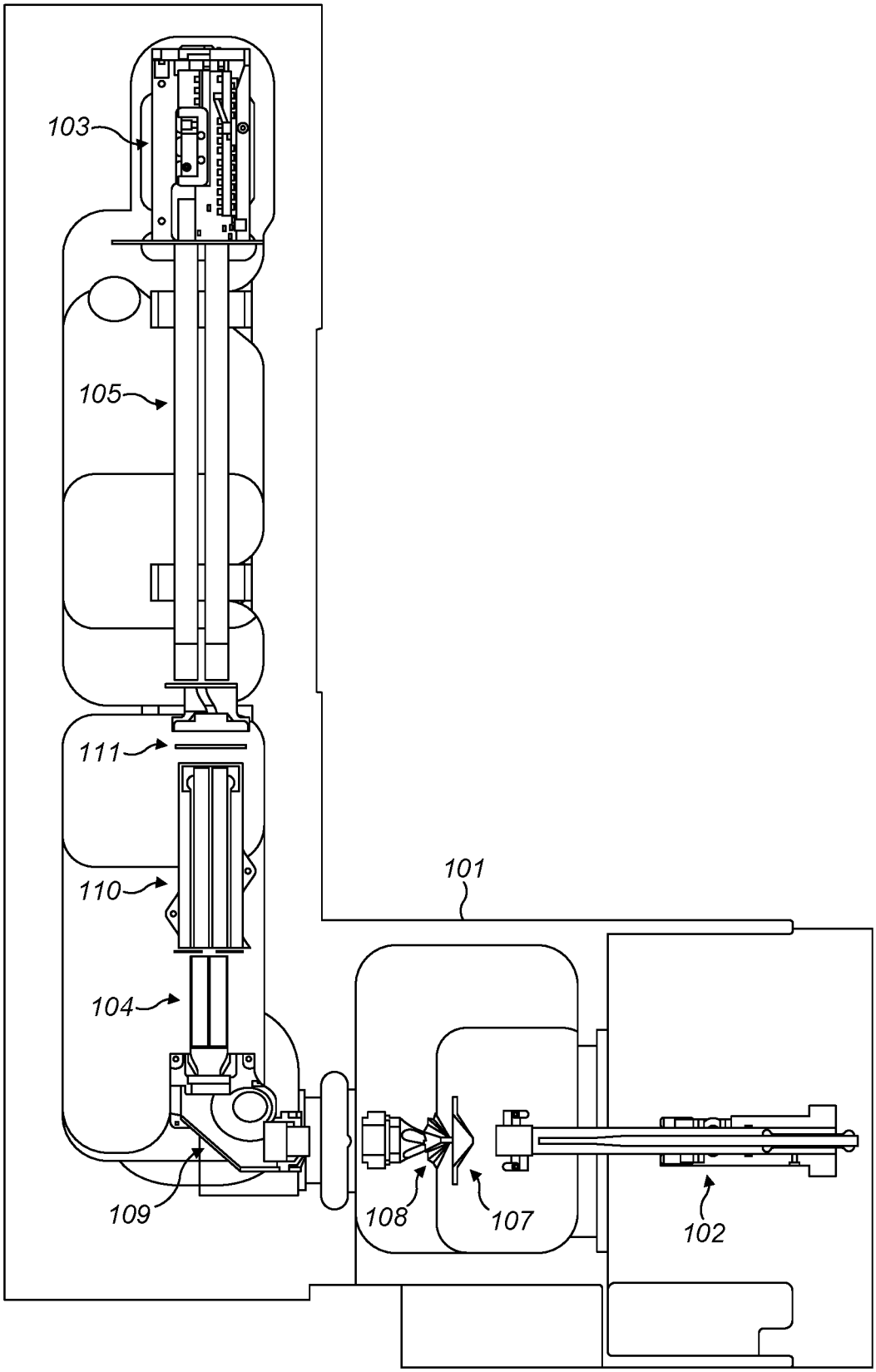
FIG. 7 shows are second embodiment of a mass spectrometer which can be calibrated by the inventive method.

In FIG. 7 is shown a second embodiment of a mass spectrometer 101 which can be calibrated by the inventive method.

In FIG. 7 is shown a schematic illustration of a known ICP mass spectrometer 101. This ICP mass spectrometer 101 comprises: an ICP torch 102 as ion source; a sampler cone 107; a skimmer cone 108; ion optics 109; a first (Q1) quadrupole mass filter 104 being a first quadrupole; a reaction cell (Q2) 110; a differentially pumped aperture 111; a second (Q3) mass filter 105 as second mass analyzer; and an ion detector 105 as detection means. Q3 mass filter 4105 may be considered a mass analyzer or a part of a mass analyzer. In this design, ions are produced in the ICP torch 102, introduced into vacuum via sampler 107 and skimmer 108, transported through (bending) ion optics 109 and selected by Q1 quadrupole mass filter 104. It will be noted that Q1 mass filter 104 is relatively short in comparison with Q2 reaction cell 110 and Q3 mass filter 105, and is schematically depicted so. Moreover, the vacuum conditions of the Q1 mass filter 104 are less demanding than for the subsequent stages. Here, the ion optics 109 and Q1 mass filter 104 are operated at substantially the same pressure. Ions of the selected mass range pass into the quadrupole reaction cell 110 and the reaction product is directed through ion optics and differentially pumped aperture 111 into the analytical quadrupole mass filter Q3 105 and detected by high dynamic range detector 103, for example an SEM. The Q3 mass filter 105 is highly selective (especially in comparison with the Q1 mass filter 104), and has a band-pass width of typically no greater than 1 amu.

Regarding the operation of this ICP mass spectrometer 101 it is referred to the co-pending UK patent application No. 1516508.7 which shall be incorporated in total to this description based on this reference.

Regarding this second embodiment of mass spectrometer 101 will be now described two embodiments of the inventive method, which can be used for calibrating the mass spectrometer 101.

The timing of the both embodiments of the inventive method for calibrating the mass spectrometer has been already illustrated by the flow chart of FIG. 2.

At a first time $t_1$ the calibration of the second mass analyzer 105 (step i), 21) has to be performed.

At this first step 21 the second mass analyzer 105 has to be calibrated. The second mass analyzer 105 has at least to be calibrated in a mass analysing mode. In this mode the second mass analyzer 105 is mass selective so that ions of a specific mass can be separately detected by the ion detector 103. In this resolution mode of the second mass analyzer 105 the analyzer has a high resolution to separate the masses of the detected ions. The calibration of the second mass analyzer 105 is done by calibration methods being state of the art. During the calibration of the second mass analyzer 105 the first quadrupole 104 is operated in a transmission mode, that is in a non-mass-selective mode so that all ions from the ion source can reach the second mass analyzer. In the transmission mode of the first quadrupole 104 only a RF voltage with an amplitude given by a function $RF_{trans}(m_{trans})$ of a transmitted mass $m_{trans}$ may be applied to the first quadrupole. During the calibrating of the second mass analyzer 105 (step i), 21) the quadrupole of a reaction cell 110 is operated in a transmission mode. In the transmission mode of the quadrupole of the reaction cell 110 only a RF voltage with an amplitude given by a function $RF_{Rc,trans}(m_{trans})$ of a transmitted mass $m_{trans}$ is applied to the quadrupole of the reaction cell 110.

At a second time $t_2$ later than the first time $t_1$ the first quadrupole 104 is calibrated in the mass selecting mode selecting masses in the mass filter window having the filter window width $w_{cal}$ (step ii), 22). During this calibration of the first quadrupole 104 second mass analyzer 105 is operated in a mass analysing mode.

At this second step 22 the first quadrupole 104 is calibrated in the mass selecting mode. This calibration has to be done for a specific filter window width $w_{cal}$ of the mass filter window of the mass selecting mode. So the calibrated first quadrupole 104 shall select in the mass selecting mode ions with masses in a mass filter window having the filter window width $w_{cal}$.

The first quadrupole 104 may be calibrated in the mass selecting mode to have a filter window width $w_{cal}$ between 8 u and 15 u, preferably to have a filter window width $w_{cal}$ between 9 u and 12 u and particular preferably to have a filter window width $w_{cal}$ between 9.5 u and 11 u. In the second embodiment of the inventive method to calibrate embodiment of the mass spectrometer 101 the calibration is described for the filter width window $w_{cal}$=10 u.

According to the invention the calibration of the second mass analyzer 105 has executed before the first quadrupole 104 is calibrated in the mass selecting mode. So the second mass analyzer 105 has to be calibrated at a first time $t_1$, and at a second time $t_2$ later than the first time $t_1$ the first quadrupole 104 has to be calibrated in the mass selecting mode. So calibration of both mass analyzers 104, 105 can be executed directly one after the other, so that the time difference between the first time $t_1$ and the second time $t_2$ can be very short, like seconds, minutes or hours. On the other hand the calibration of the second mass analyzer 105 can be done only at the setup of the mass spectrometer and the calibration of the first quadrupole 104 can be done later, e.g. when the mass spectrometer is installed at the end user. Additionally the calibration of the first quadrupole 104 can be repeated time by time. A preceding afreshed calibration of the second mass analyzer 105 might not be necessary.

Figure 8:
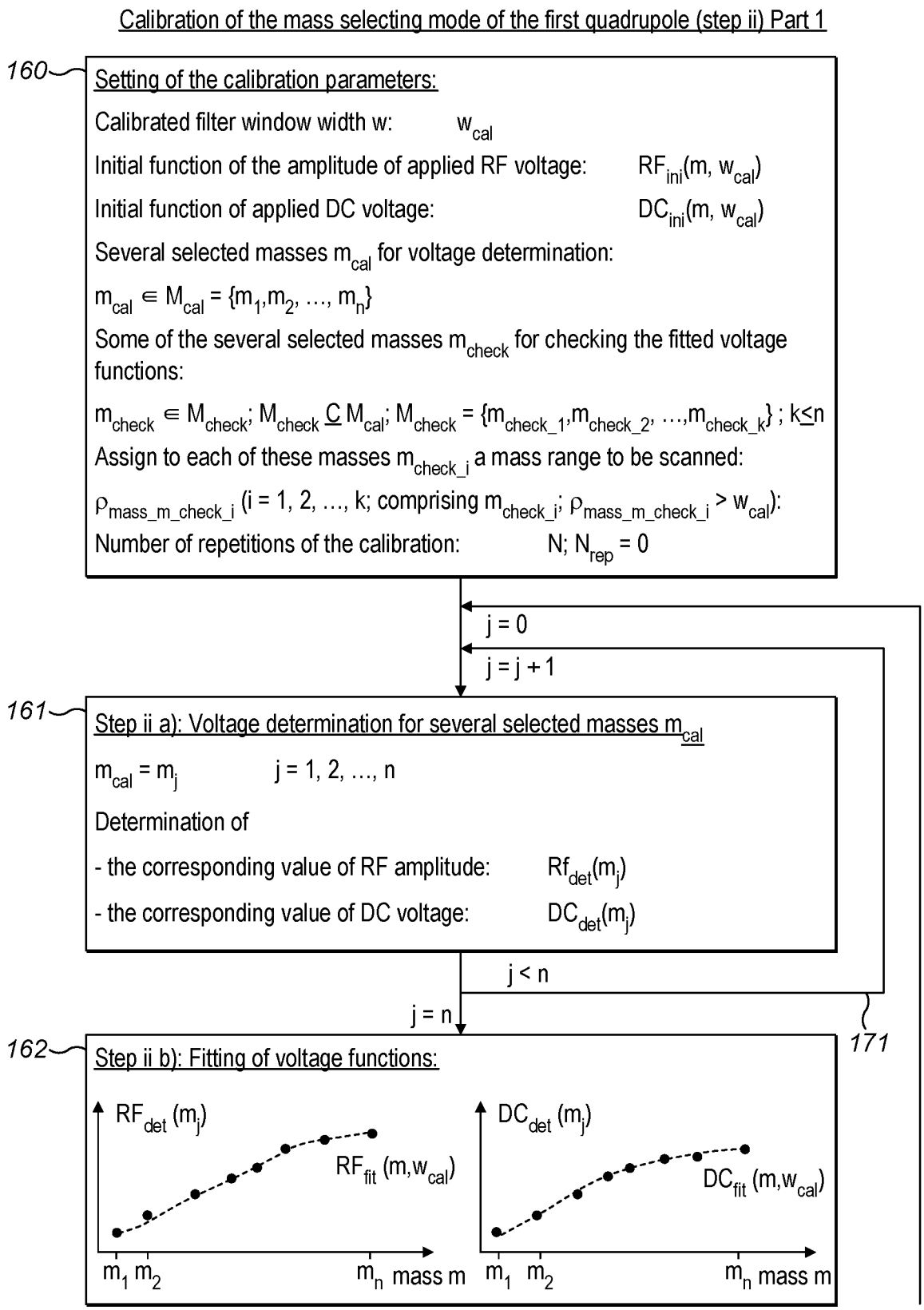
FIG. 8 is a flow chart illustrating in detail the steps of the calibration of the first quadrupole of the second embodiment of a mass spectrometer according to a first embodiment of the inventive method (part 1).
Figure 9:
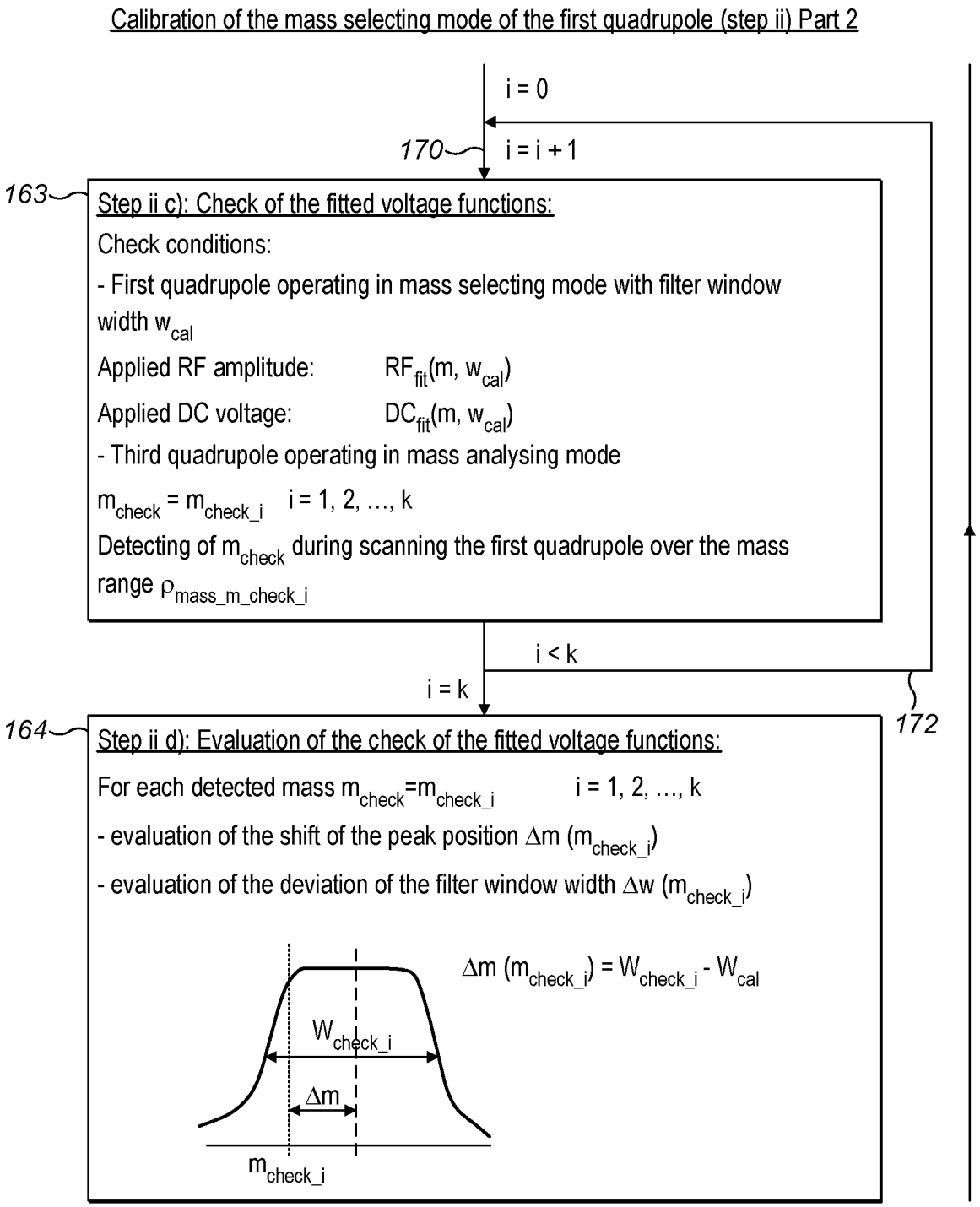
FIG. 9 is a flow chart illustrating in detail the steps of the calibration of the first quadrupole of the second embodiment of a mass spectrometer according to a first embodiment of the inventive method (part 2).
Figure 10:
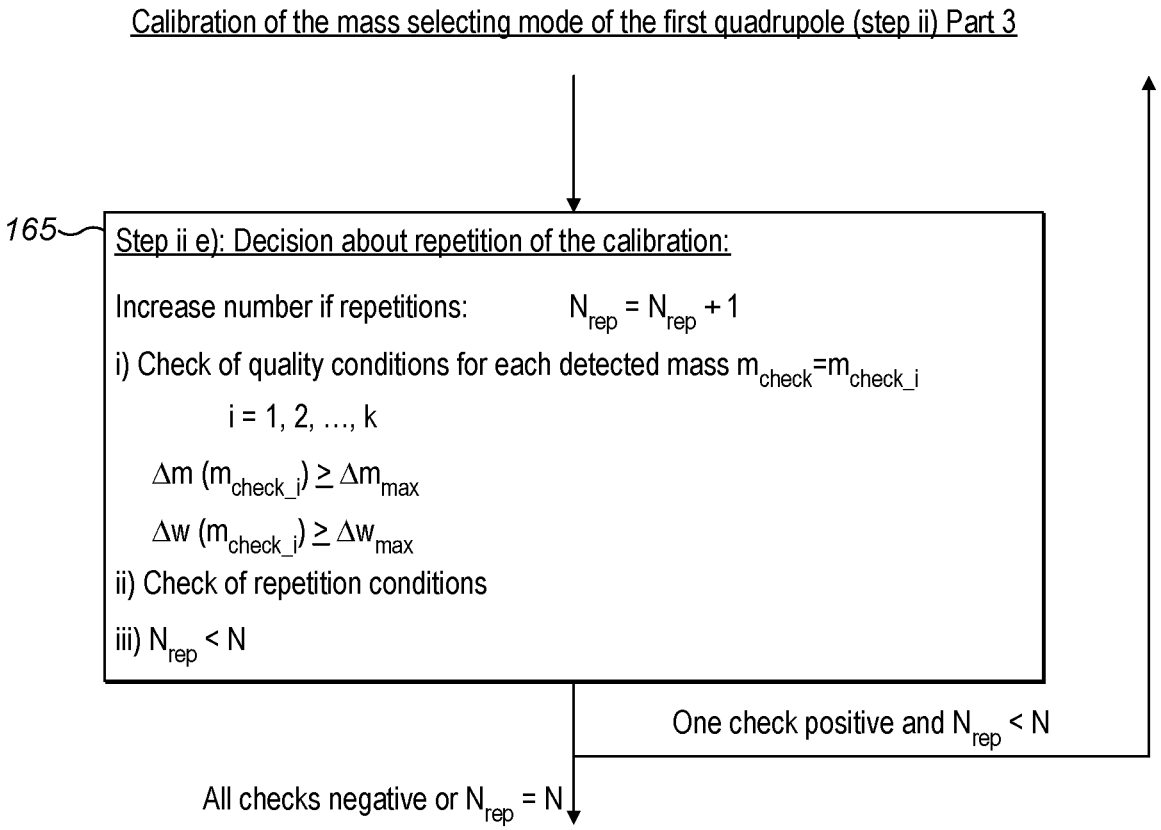
FIG. 10 is a flow chart illustrating in detail the steps of the calibration of the first quadrupole of the second embodiment of a mass spectrometer according to a first embodiment of the inventive method (part 3).

The first embodiment of the claimed method which is used for calibrating the first embodiment of a mass spectrometer shown in FIG. 7 is illustrated in detail by a flow chart showing in detail the steps of the calibration of the first quadrupole (step ii, 22). For better clarity of the flow chart showing a lot of details of the method the low chart in split in three parts (parts 1, 2 and 3) which are shown in the separate FIGS. 8, 9 and 10. It is clear that the different steps of the method shall be executed one of the other following the arrows between the boxes of the flow chart. So despite the repetitions of several steps shown by arrows running in parallel to the boxes of the flow short showing up the different steps are executed starting from the top of each Figure to the bottom of the Figure and after executing the steps of one Figure the steps of the following Figure are executed again from the top to the bottom of the following Figure. The after the steps of FIG. 8 are executed the Steps of FIG. 9 are executed and after the steps of FIG. 9 are executed the Steps of FIG. 10 are executed. More in detail for example of the step at the bottom of FIG. 8 is executed (step ii b) the step at the top of FIG. 9 (step ii c) is executed. This is also shown by the arrow 170 above the box of step ii c) in FIG. 9 pointing with his arrowhead to the box of step ii c).

Before the calibration of the first quadrupole 104 is started, there is a setting of calibration parameters 160 for the calibration.

At the beginning of the calibration of the first quadrupole 104 in the mass selecting mode an initial function $RF_{ini}(m, w_{cal})$ is used for the first function $RF(m, w_{cal})$ and an initial function $DC_{ini}(m, w_{cal})$ for the second function $DC(m, w_{cal})$. These initial functions are set during the setting of calibration parameters 160.

In a first step of the calibration of the first quadrupole (step ii a), 161) for several masses $m_{cal}$ which shall be selected by the first quadrupole in the mass selecting mode the amplitude of the RF voltage and DC voltage is determined which has to be applied to the electrodes of the first quadrupole 104 so that the mass $m_{cal}$ is selected by the first quadrupole in the middle of the mass filter window which has the intended filter window width $w_{cal}$.

This determination is executed individually for each of several selected masses $m_{cal}$ one after the other. These several selected masses $m_{cal}$ are calibration masses for defining reference points of suitable values of the amplitude of the RF voltage and DC voltage. These several selected masses $m_{cal}$ are defined in a parameter set during the setting of the calibration parameters 160. So a number of n calibration masses are defined as the several selected masses. Accordingly the defined calibration masses result in a set $M_{cal}$ of calibration masses $m_{cal}$ containing the masses $m_1$, $m_2$, $m_3$ . . . , $m_n$.

$$m_{cal} \in M_{cal} = \{m_1, m_2, \ldots, m_n\}$$

For each of the several selected masses $m_{cal}$ a corresponding value of the amplitude of the RF voltage $RF_{det}(m_{cal})$ and value of DC voltage $DC_{det}(m_{cal})$ is determined. If the corresponding RF voltage and DC voltage applied to the electrodes of the first quadrupole, masses are selected by the first quadrupole 104 in a mass filter window having in the middle the selected mass $m_{cal}$ and the filter window width $w_{cal}$. So for each mass $m_j$ (j=1, 2, 3, . . . , n) of set $M_{cal}$ of calibration masses $m_{cal}$ a corresponding value of the amplitude of the RF voltage $RF_{det}(m_j)$ and value of DC voltage $DC_{det}(m_j)$ is determined.

That determination is executed individually for each of several selected masses $m_{cal}$ one after the other, is shown in FIG. 8 by the arrow 171. Before step ii a) 161 a mass indicator j is set to j=0. This indicator is increased before a determination of a value of the amplitude of the RF voltage $RF_{det}(m_{cal})$ and a value of DC voltage $DC_{det}(m_{cal})$ by j=j+1. So at first the determination is executed for the mass $m_1$ (j=1). The mass indicator j is increased with every repetition shown by the arrow 171, so that during the second determination of a value of the amplitude of the RF voltage $RF_{det}(m_{cal})$ and a value of DC voltage $DC_{det}(m_{cal})$ the determination is executed for the mass $m_2$ (j=2). This determination is in that way repeated up to the mass $m_n$ (j=n). If j=n there is no more repetition of a determination of a value of the amplitude of the RF voltage $RF_{det}(m_{cal})$ and a value of DC voltage $DC_{det}(m_{cal})$ and the next step of the calibration (step ii b, 62) is executed. So for all of the several selected masses $m_{cal}$, the set $M_{cal}$ of calibration masses $m_{cal}$ containing the masses $m_1$, $m_2$, $m_3$ . . . , $m_n$ a determination of a value of the amplitude of the RF voltage $RF_{det}(m_{cal})$ and a value of DC voltage $DC_{det}(m_{cal})$ is executed.

The several selected masses $m_{cal}$, for which a corresponding value of the amplitude of the RF voltage $RF_{det}(m_{cal})$ and value of DC voltage $DC_{det}(m_{cal})$ is determined individually (step ii a), 61), are 4 to 18 selected masses $m_{cal}$, preferable 8 to 15 selected masses $m_{cal}$ and particular preferable 9 to 12 selected masses $m_{cal}$.

During the individual determination of the corresponding value of the amplitude of the RF voltage $RF_{det}(m_{cal})$ and value of DC voltage $DC_{det}(m_{cal})$ to a selected mass $m_{cal}$ the second mass analyzer 105 is filtering the selected mass $m_{cal}$. During this determination the second quadrupole 105 is set to filter the selected mass $m_{cal}$ by selecting masses m in a mass filter window having a filter window width $w_2$ between 0.6 u and 0.9 u and preferable by selecting masses m in a mass filter window having a filter window width $w_2$ between 0.65 u and 0.85 u.

During the individual determination of the corresponding value of the amplitude of the RF voltage $RF_{det}(m_{cal})$ and value of DC voltage $DC_{det}(m_{cal})$ to a selected mass $m_{cal}$ the first quadrupole 104 is scanned over a mass range $\rho_{mass}$ comprising the selected mass $m_{cal}$ applying the RF amplitude and the DC voltage to the electrodes of the first quadrupole according to the first function RF(m, $w_{cal}$) and the a second function DC(m, $w_{cal}$) for the masses m of the mass range $\rho_{mass}$. After the scanning of the first quadrupole 104 over the mass range $\rho_{mass}$ it may be evaluated for which masses $m_{set}$ of the mass range $\rho_{mass}$ when set at the first function of the amplitude of the RF(m, $w_{cal}$) and the second function of the DC voltage DC(m, $w_{cal}$) to apply the RF voltage and DC voltage at the first quadrupole 104 the ion detector 103 is detecting the selected mass $m_{cal}$.

The filter window width w of the first quadrupole 104 is increased when the selected mass $m_{cal}$ is not transmitted by the second analyzer 105 and detected by the ion detector 3 during the individual determination of the corresponding value of the amplitude of the RF voltage $RF_{det}(m_{cal})$ and value of DC voltage $DC_{det}(m_{cal})$ to the selected mass $m_{cal}$. Preferably the filter window width w of the first quadrupole 104 is at least doubled.

Furthermore the DC voltage applied to the electrodes of the first quadrupole 104 is decreased stepwise until the selected mass $m_{cal}$ is detected by the second analyzer 105 when the selected mass $m_{cal}$ is not detected by the second analyzer 105 during the individual determination of the corresponding value of the amplitude of the RF voltage $RF_{det}(m_{cal})$ and value of DC voltage $DC_{det}(m_{cal})$ to the selected mass $m_{cal}$, after the filter window width w of the first quadrupole 104 is extended.

In particular the DC voltage applied to the electrodes of the first quadrupole 104 is decreased stepwise in that in the second function DC(m, w) which is defining the DC voltage, a constant offset value DCoffset is lowered stepwise until the selected mass $m_{cal}$ is detected by the second analyzer 105 and the detection means 103.

If due to these provisions the selected mass $m_{cal}$ is detected by the second analyzer 105 and the ion detector 103 the constant offset value DCoffset of the second function DC(m, w) is increased stepwise until the filter window width w of the first quadrupole 4 is below a filter window width $w_{min}$ of the mass selecting mode to be calibrated, when the selected mass $m_{cal}$ is analysed by the second analyzer 105 and detected by the ion detector 103 and the peak width w of the selected mass $m_{cal}$ is bigger than a first maximum peak width $w_{max}$.

After the evaluation at which masses $m_{set}$ of the mass range $\rho_{mass}$ the ion detector 103 is detecting the selected mass $m_{cal}$ it is determined if the whole peak of the mass $m_{cal}$ is detected. This is only given if there is detected at both borders of the mass range $\rho_{mass}$ only no real mass signal, that means only a signal a noise signal detected by the ion detector 103. If only at one of the borders of the mass range no real mass signal is detected, the peak of the mass $m_{cal}$ has to be shifted. This is done by adding offset values RFoffset and DCoffset to the first function of the amplitude of the RF(m, w) and the second function of the DC voltage DC(m, w) to apply the RF voltage and DC voltage at the first quadrupole 104. If at bother border a real mass signal is detected the peak of the mass $m_{cal}$ is broader than the mass range $\rho_{mass}$ and has at first made more narrow by adding a positive offset value DCoffset to the second function of the DC voltage DC(m, w) to apply the DC voltage at the first quadrupole 104.

If the whole peak of the mass $m_{cal}$ is detected the shift of the peak position $\Delta m(m_{cal})$ of the selected mass $m_{cal}$ may be evaluated. The evaluation of the shift of the peak position $\Delta m(m_{cal})$ of the selected mass $m_{cal}$ is performed by calculating the difference between the mass $m_{set_c}$ at the center of the masses $m_{set}$ at which the ion detector 103 is detecting the selected mass $m_{cal}$ and the selected mass $m_{cal}$.

The individual determination of the corresponding value of the amplitude of the RF voltage $RF_{det}(m_{cal})$ and value of DC voltage $DC_{det}(m_{cal})$ to a selected mass $m_{cal}$ the individual definition of a corresponding the amplitude of the RF voltage $RF_{det}(m_{cal})$ and DC voltage $DC_{det}(m_{cal})$ (step ii a), 161) of the selected mass $m_{cal}$ is done by changing the value of the first function $RF(m_{cal},w_{cal})$ and/or the value of the second function $DC(m_{cal}, w_{cal})$ corresponding to the selected mass $m_{cal}$ depending on the shift of the peak position $\Delta m(m_{cal})$ of the selected mass $m_{cal}$. This individual definition of a corresponding value of the amplitude of the RF voltage $RF_{det}(m_{cal})$ and value of the DC voltage $DC_{det}(m_{cal})$ of the selected mass $m_{cal}$ may be done by adding to the value of the first function $RF(m_{cal},w_{cal})$ and/or the value of the second function $DC(m_{cal},w_{cal})$ corresponding to the selected mass $m_{cal}$ the value the shift of the peak position $\Delta m(m_{cal})$ of the selected mass $m_{cal}$ multiplied with a factor corresponding to the amplitude of the RF voltage RFfactor$_{p_shift}$ and/or DC voltage DCfactor$_{p_shift}$.

$$RF(m_{cal},w_{cal})_{new}=RF(m_{cal},w_{cal})+RF\text{factor}_{p_shift}*\Delta m_{(m_{cal})}$$

$$DC(m_{cal},w_{cal})_{new}=DC(m_{cal},w_{cal})+DC\text{factor}_{p_shift}*\Delta m_{(m_{cal})}$$

In particular the individual definition of a corresponding value of the amplitude of the RF voltage $RF_{det}(m_{cal})$ of the selected mass $m_{cal}$ may be done by adding to the value of the first function $RF(m_{cal},w_{cal})$ corresponding to the selected mass $m_{cal}$ the value the shift of the peak position $\Delta m(m_{cal})$ of the selected mass $m_{cal}$ multiplied with a linear factor RFlinear of the first function $RF(m, w_{cal})$.

$$RF(m_{cal},w_{cal})_{new}=RF(m_{cal},w_{cal})+RF\text{linear}*\Delta m(m_{cal})$$

The linear factor RFlinear of the first function $RF(m, w_{cal})$ is the factor with which the mass m is multiplied if the function $RF(m, w_{cal})$ in a summation of different functions and one of the summed function is a linear function.

$$RF(m,w_{cal})=RF\text{linear}*m+f_1(m)+f_2(m)+\ldots.$$

In particular the individual definition of a corresponding DC voltage $DC_{det}(m_{cal})$ of the selected mass $m_{cal}$ may be done by adding to the value of the second function $DC(m_{cal}, w_{cal})$ corresponding to the selected mass $m_{cal}$ the value the shift of the peak position $\Delta m(m_{cal})$ of the selected mass $m_{cal}$ multiplied with a linear factor DClinear of the second function $DC(m, w_{cal})$ divided by a linear factor RFlinear of the first function $RF(m, w_{cal})$.

$$DC(m_{cal},w_{cal})_{new}=DC(m_{cal},w_{cal})+DC\text{linear}/RF\text{linear}*\Delta m(m_{cal})$$

The linear factor DClinear of the second function $DC(m, w_{cal})$ is the factor with which the mass m is multiplied if the function $DC(m, w_{cal})$ in a summation of different functions and one of the summed function is a linear function.

$$DC(m,w_{cal})=DC\text{linear}*m+f_1(m)+f_2(m)+\ldots.$$

The deviation of the filter window width $\Delta w(m_{cal})$ of the selected mass $m_{cal}$ is evaluated after the evaluation at which masses $m_{set}$ of the mass range $\rho_{mass}$ the detection means is detecting the selected mass $m_{cal}$. Preferably the evaluation of the deviation of the filter window width $\Delta w(m_{cal})$ of the selected mass $m_{cal}$ is performed by evaluating a mass range $\rho_{massdetect}(m_{cal})$ of the masses $m_{set}$ set at the first function of the amplitude of the $RF(m, w_{cal})$ and the second function of the DC voltage $DC(m, w_{cal})$ to apply the RF voltage and DC voltage at the first quadrupole 104 for which the detection means is detecting the selected mass $m_{cal}$ and calculating the difference $\Delta w(m_{cal})$ between the mass range $\rho_{massdetect}(m_{cal})$ and the filter window width $w_{cal}$ for which the first quadrupole has to be calibrated.

$$\Delta w(m_{cal})=\rho_{massdetect}(m_{cal})-w_{cal}$$

The evaluation of the mass range $\rho_{massdetect}(m_{cal})$ is performed by evaluating the masses $m_{set}$ set at the first function of the amplitude of the $RF(m, w_{cal})$ and the second function of the DC voltage $DC(m, w_{cal})$ to apply the RF voltage and DC voltage at the first quadrupole for which the ion detector 103 is detecting a signal which is higher than a percentage of the highest signal detected by the detection means. Preferable the evaluation of the mass range $\rho_{massdetect}(m_{cal})$ is performed by evaluating the masses $m_{set}$ set at the first function of the amplitude of the $RF(m, w_{cal})$ and the second function of the DC voltage $DC(m, w_{cal})$ to apply the RF voltage and DC voltage at the first quadrupole 104 for which the detection means is detecting a signal which is higher than 20 percent of the highest signal detected by the detection means 3, in particular higher than 10 percent of the highest signal detected by the detection means.

During the individual determination of the corresponding value of the amplitude of the RF voltage $RF_{det}(m_{cal})$ and value of DC voltage $DC_{det}(m_{cal})$ to a selected mass $m_{cal}$ the individual definition of a corresponding the amplitude of the RF voltage $RF_{det}(m_{cal})$ and DC voltage $DC_{det}(m_{cal})$ (step ii a), 161) of the selected mass $m_{cal}$ is done by changing the value of the first function $RF(m_{cal}, w_{cal})$ and the value of the second function $DC(m_{cal}, w_{cal})$ corresponding to the selected mass $m_{cal}$ depending on the deviation of the filter window width $\Delta w(m_{cal})$ of the selected mass $m_{cal}$.

In particular the individual determination of a corresponding value of the amplitude of the RF voltage $RF_{det}(m_{cal})$ and value of the DC voltage $DC_{det}(m_{cal})$ of the selected mass $m_{cal}$ is done by adding to the value of the first function $RF(m_{cal}, w_{cal})$ and/or the value of the second function $DC(m_{cal}, w_{cal})$ corresponding to the selected mass $m_{cal}$ the value the deviation of the filter window width $\Delta w(m_{cal})$ of the selected mass $m_{cal}$ multiplied with a factor corresponding to the RF voltage $\Delta w\text{-factor}_{RF}$ and/or DC voltage $\Delta w\text{-factor}_{DC}$.

$$RF(m_{cal},w_{cal})_{new}=RF(m_{cal},w_{cal})+\Delta w\text{-factor}_{RF}*\Delta w_{(m_{cal})}$$

$$DC(m_{cal},w_{cal})_{new}=DC(m_{cal},w_{cal})+\Delta w\text{-factor}_{DC}*\Delta w_{(m_{cal})}$$

In particular the individual determination of a corresponding value of the amplitude of the RF voltage $RF_{det}(m_{cal})$ of the selected mass $m_{cal}$ is done by adding to the value of the first function $RF(m_{cal}, w_{cal})$ corresponding to the selected mass $m_{cal}$ the value of the deviation of the filter window width $\Delta w(m_{cal})$ of the selected mass $m_{cal}$ multiplied with a linear factor DClinear of the second function $DC(m, w_{cal})$ divided by a linear factor RFlinear of the first function $RF(m, w_{cal})$.

$$RF(m_{cal},w_{cal})_{new}=RF(m_{cal},w_{cal})+DC\text{linear}/RF\text{linear}*\Delta w(m_{cal})$$

Preferable for two selected masses $m_{coarse}$ a corresponding value of the amplitude of the RF voltage $RF_{det}(m_{coarse})$ and value of DC voltage $DC_{det}(m_{coarse})$ is determined individually before for several selected masses $m_{cal}$ a corresponding value of the amplitude of the RF voltage $RF_{det}(m_{cal})$ and value of DC voltage $DC_{det}(m_{cal})$ is determined individually (step ii a, 161)). In particular the two selected masses $m_{coarse}$ for which a corresponding value of the amplitude of the RF voltage $RF_{det}(m_{coarse})$ and value of DC voltage $DC_{det}(m_{coarse})$ is determined individually before for several selected masses $m_{cal}$ a corresponding value of the amplitude of the RF voltage $RF_{det}(m_{cal})$ and value of DC voltage $DC_{det}(m_{cal})$ is determined individually are the masses of the molecules $^{16}O^{40}Ar$ and $^{40}Ar^{40}Ar$.

After for the two selected masses $m_{coarse}$ a corresponding value of the amplitude of the RF voltage $RF_{det}(m_{coarse})$ and value of DC voltage $DC_{det}(m_{coarse})$ is determined individually, a function $RF_{coarse}(m, w_{cal})$ of the selected mass m is fitted to the values of the amplitudes of the RF voltage $RF_{det}(m_{coarse})$ corresponding to the two selected masses $m_{coarse}$ by changing a linear factor RFlinear and a constant offset value RFoffset of the initial function $RF_{ini}(m, w_{cal})$ and a function $DC_{coarse}(m, w_{cal})$ of the selected mass m is fitted to the values of DC voltage $DC_{det}(m_{coarse})$ corresponding to the two selected masses $m_{coarse}$ by changing a linear factor DClinear and a constant offset value DCoffset of the initial function $DC_{ini}(m, w_{cal})$.

In the next step of the calibration of the first quadrupole (step ii b), 162) shown in FIG. 8 functions are fitted to the reference points determined for the calibration masses in the step described before. A function $RF_{fit}(m, w_{cal})$ of the selected mass m is fitted to the values of the amplitude of the RF voltage $RF_{det}(m_{cal})$ corresponding to the several selected masses $m_{cal}$ and a function $DC_{fit}(m, w_{cal})$ of the selected mass m is fitted to the values of DC voltages $DC_{det}(m_{cal})$ corresponding to the several selected masses $m_{cal}$. The function $RF_{fit}(m, w_{cal})$ of the selected mass m is fitted to the value of the amplitude of the RF voltage $RF_{det}(m_j)$ of each mass $m_j$ (j=1, 2, 3, . . . , n) of set $M_{cal}$ of calibration masses $m_{cal}$. The function $DC_{fit}(m, w_{cal})$ of the selected mass m is fitted to value of DC voltage $DC_{det}(m_j)$ of each mass $m_j$ (j=1, 2, 3, . . . , n) of set $M_{cal}$ of calibration masses $m_{cal}$.

In general there are various approaches to fit a function $RF_{fit}(m, w_{cal})$ of the selected mass m to the determined values of the amplitude of the RF voltage $RF_{det}(m_{cal})$ corresponding to the several selected masses $m_{cal}$ and a function $DC_{fit}(m, w_{cal})$ of the selected mass m to the determined values of DC voltages $DC_{det}(m_{cal})$ corresponding to the several selected masses $m_{cal}$.

In one approach of fitting a function $RF_{fit}(m,w_{cal})$ of the selected mass m to the values of the amplitude of the RF voltage $RF_{det}(m_{cal})$ corresponding to the several selected masses $m_{cal}$ (step ii b), 162) the function $RF_{fit}(m,w_{cal})$ is summation of a constant $RFoffset_{fit}$ and a linear function of the selected mass m.

In another approach of fitting a function $DC_{fit}(m,w_{cal})$ of the selected mass m to the values of DC voltage $DC_{det}(m_{cal})$ corresponding to the several selected masses $m_{cal}$ (step ii b), 162) the function $DC_{fit}(m,w_{cal})$ is a summation of a constant value $DCoffset_{fit}$ and a linear function of the selected mass m.

In another approach of fitting a function $RF_{fit}(m,w_{cal})$ of the selected mass m to the values of the amplitude of the RF voltage $RF_{det}(m_{cal})$ corresponding to the several selected masses $m_{cal}$ (step ii b), 162) the function $RF_{fit}(m,w_{cal})$ is a sum of functions comprising a linear function of the selected mass m.

In another approach of fitting a function $RF_{fit}(m,w_{cal})$ of the selected mass m to the values of the amplitude of the RF voltage $RF_{det}(m_{cal})$ corresponding to the several selected masses $m_{cal}$ (step ii b), 162) the function $RF_{fit}(m,w_{cal})$ is a sum of functions comprising a quadratic function of the selected mass m.

In another approach of fitting a function $RF_{fit}(m,w_{cal})$ of the selected mass m to the values of the amplitude of the RF voltage $RF_{det}(m_{cal})$ corresponding to the several selected masses $m_{cal}$ (step ii b), 162) the function $RF_{fit}(m,w_{cal})$ is a sum of functions comprising an exponential function of the selected mass m.

In another approach of fitting a function $RF_{fit}(m,w_{cal})$ of the selected mass m to the values of the amplitude of the RF voltage $RF_{det}(m_{cal})$ corresponding to the several selected masses $m_{cal}$ (step ii b)) the function $RF_{fit}(m,w_{cal})$ is a sum of functions comprising an exponential function whose exponent is a linear function of the selected mass m.

In another approach of fitting a function $RF_{fit}(m,w_{cal})$ of the selected mass m to the values of the amplitude of the RF voltage $RF_{det}(m_{cal})$ corresponding to the several selected masses $m_{cal}$ (step ii b), 162) the function $RF_{fit}(m,w_{cal})$ is a sum of functions comprising at least two exponential functions whose exponents are different linear functions of the selected mass m.

In another approach of fitting a function $RF_{fit}(m,w_{cal})$ of the selected mass m to the values of the amplitude of the RF voltage $RF_{det}(m_{cal})$ corresponding to the several selected masses $m_{cal}$ (step ii b), 162) the function $RF_{fit}(m,w_{cal})$ is a sum of functions containing only two exponential functions whose exponents are different linear functions of the selected mass m. Only these two exponential functions are summed up in the function $RF_{fit}(m,w_{cal})$.

In another approach of fitting a function $DC_{fit}(m,w_{cal})$ of the selected mass m to the values of DC voltage $DC_{det}(m_{cal})$ corresponding to the several selected masses $m_{cal}$ (step ii b), 162) the function $DC_{fit}(m,w_{cal})$ is a sum of functions comprising a linear function of the selected mass m.

In another approach of fitting a function $DC_{fit}(m,w_{cal})$ of the selected mass m to the values of DC voltage $DC_{det}(m_{cal})$ corresponding to the several selected masses $m_{cal}$ (step ii b), 162) the function $DC_{fit}(m,w_{cal})$ is a sum of functions comprising a quadratic function of the selected mass m.

In another approach of fitting a function $DC_{fit}(m,w_{cal})$ of the selected mass m to the values of DC voltage $DC_{det}(m_{cal})$ corresponding to the several selected masses $m_{cal}$ (step ii b), 162) the function $DC_{fit}(m,w_{cal})$ is a sum of functions comprising an exponential function of the selected mass m.

In another approach of fitting a function $DC_{fit}(m,w_{cal})$ of the selected mass m to the values of DC voltage $DC_{det}(m_{cal})$ corresponding to the several selected masses $m_{cal}$ (step ii b), 162) the function $DC_{fit}(m,w_{cal})$ is a sum of functions comprising an exponential function whose exponent is a linear function of the selected mass m.

In another approach of fitting a function $DC_{fit}(m,w_{cal})$ of the selected mass m to the values of DC voltage $DC_{det}(m_{cal})$ corresponding to the several selected masses $m_{cal}$ (step ii b), 62) the function $DC_{fit}(m,w_{cal})$ is a sum of functions comprising at least two exponential functions whose exponents are different linear functions of the selected mass m.

In another approach of fitting a function $DC_{fit}(m,w_{cal})$ of the selected mass m to the values of DC voltage $DC_{det}(m_{cal})$ corresponding to the several selected masses $m_{cal}$ (step ii b), 162) the function $DC_{fit}(m,w_{cal})$ is a sum of functions containing only two exponential functions whose exponents are different linear functions of the selected mass m.

In preferred approach of fitting a function $RF_{fit}(m,w_{cal})$ of the selected mass m to the values of the amplitude of the RF voltage $RF_{det}(m_{cal})$ corresponding to the several selected masses $m_{cal}$ and fitting a function $DC_{fit}(m,w_{cal})$ of the selected mass m to the values of DC voltage $DC_{det}(m_{cal})$ corresponding to the several selected masses $m_{cal}$ (step ii b), 162) the function $RF_{fit}(m,w_{cal})$ is the summation of a constant value $RFoffset_{fit}$, a linear function of the selected mass m, a quadratic function of the selected mass m and two exponential functions whose exponents are different linear functions of the selected mass m and the function $DC_{fit}(m, w_{cal})$ is summation of a constant value $DCoffset_{fit}$ and a linear function of the selected mass m.

In another approach of fitting a function $RF_{fit}(m,w_{cal})$ of the selected mass m to the values of the amplitude of the RF voltage $RF_{det}(m_{cal})$ corresponding to the several selected masses $m_{cal}$ and fitting a function $DC_{fit}(m,w_{cal})$ of the selected mass m to the values of DC voltage $DC_{det}(m_{cal})$ corresponding to the several selected masses $m_{cal}$ (step ii b), 162) the function $RF_{fit}(m,w_{cal})$ is the summation of a constant value $RFoffset_{fit}$, a linear function of the selected mass m, a quadratic function of the selected mass m and two exponential functions whose exponents are different linear functions of the selected mass m and the function $DC_{fit}(m, w_{cal})$ is the summation of a constant value $DCoffset_{fit}$, a linear function of the selected mass m, a quadratic function of the selected mass m and two exponential functions whose exponents are different linear functions of the selected mass m.

In another preferred approach of fitting a function $RF_{fit}(m,w_{cal})$ of the selected mass m to the values of the amplitude of the RF voltage $RF_{det}(m_{cal})$ corresponding to the several selected masses $m_{cal}$ and fitting a function $DC_{fit}(m,w_{cal})$ of the selected mass m to the values of DC voltage $DC_{det}(m_{cal})$ corresponding to the several selected masses $m_{cal}$ (step ii b), 162) the function $RF_{fit}(m,w_{cal})$ is summation of a constant value $RFoffset_{fit}$ and a linear function of the selected mass m and the function $DC_{fit}(m, w_{cal})$ is summation of a constant value $DCoffset_{fit}$ and a linear function of the selected mass m.

In another particular preferred approach of fitting a function $RF_{fit}(m,w_{cal})$ of the selected mass m to the values of the amplitude of the RF voltage $RF_{det}(m_{cal})$ corresponding to the several selected masses $m_{cal}$ and fitting a function $DC_{fit}(m,w_{cal})$ of the selected mass m to the values of DC voltage $DC_{det}(m_{cal})$ corresponding to the several selected masses $m_{cal}$ (step ii b), 162) in a first step summation of a constant value $RFoffset_{fit}$ and a linear function of the selected mass m is fitted for the function $RF_{fit}(m,w_{cal})$ and summation of a constant value $DCoffset_{fit}$ and a linear function of the selected mass m is fitted for the function $DC_{fit}(m,w_{cal})$ and in a second step the function $RF_{fit}(m,w_{cal})$ is fitted by adding to the summation of a constant value $RFoffset_{fit}$ and a linear function of the selected mass m fitted in the first step the summation of a constant value, a quadratic function of the selected mass m and two exponential functions whose exponents are different linear functions of the selected mass m and the function $DCF_{fit}(m,w_{cal})$ is fitted by adding to the summation of a constant value $DCoffset_{fit}$ and a linear function of the selected mass m fitted in the first step the summation of a constant, a quadratic function of the selected mass m and two exponential functions whose exponents are different linear functions of the selected mass m.

The fitting of a function $RF_{fit}(m,w_{cal})$ of the selected mass m to the values of the amplitude of the RF voltage $RF_{det}(m_{cal})$ corresponding to the several selected masses $m_{cal}$ and fitting a function $DC_{fit}(m,w_{cal})$ of the selected mass m to the values of DC voltage $DC_{det}(m_{cal})$ corresponding to the several selected masses $m_{cal}$ (step ii b), 162) may be done by a method of polynomial fit, cubic spline fit or nonlinear least square fit.

In the next step of the calibration of the first quadrupole (step ii c), 163) shown in FIG. 9 the fit of the functions fitted in the step above (step ii b), 162) is checked. This check is performed for at least some of the several selected masses $m_{check}$. These masses $m_{check}$ belong to the several masses $m_{cal}$ for which in the foregoing step ii a) 161 the RF voltage and DC voltage has been determined. For which of the several selected masses $m_{check}$ the check is performed is set during the setting of the calibration parameters 160.

The check is performed for some of the masses $m_{cal}$ for which in the foregoing step ii a) 161 the RF voltage and DC voltage has been determined. So the set $M_{check}$ of masses $m_{check}$ for which the check is performed is a subset of the set $M_{cal}$ of calibration masses $m_{cal}$.

$$m_{check} \epsilon M_{check};\ M_{check} \underline{C} M_{cal}$$

If for k masses $m_{check}$ the check is performed the set $M_{check}$ of masses $m_{check}$ is:

$$M_{check}=\{m_{check_1}, m_{check_2}, \ldots, m_{check_k}\};\ k \leq n$$

So for each mass $m_{check_i}$ (i=1, 2, 3, . . . , k) of set $M_{check}$ of masses $m_{check}$ the check is performed.

The masses $m_{check}$ for which the check is performed are detected at the ion detector 3 via the second analyzer 105 operating in a mass analysing mode during scanning the first quadrupole 104 operating as pre-selecting analyzer in the mass selecting mode selecting masses in the mass filter window having the filter window width $w_{cal}$ over a mass range $\rho_{mass_m_check}$ assigned to the selected mass $m_{check}$, comprising the selected mass $m_{check}$ and being larger than the filter window width $w_{cal}$ of the mass filter window of the mass selecting mode of the first quadrupole. The assignment of a mass range $\rho_{mass_m_check}$ to each the of selected masses $m_{check}$ is performed during the setting of the calibration parameters 160.

The amplitude of the RF voltage applied to the electrodes of the first quadrupole 104 is given by the function $RF_{fit}(m, w_{cal})$ and the DC voltage applied to the electrodes of the first quadrupole is given by the function $DC_{fit}(m, w_{cal})$.

So each mass $m_{check_i}$ (i=1, 2, 3, . . . , k) of set $M_{check}$ of masses $m_{check}$ is one after the other detected at the ion detector 3 via the second analyzer 105 operating in a mass analysing mode during scanning the first quadrupole 104 operating as pre-selecting analyzer in the mass selecting mode selecting masses in the mass filter window having the filter window width $w_{cal}$ over a mass range $\rho_{mass_m_check_i}$ assigned to the selected mass $m_{check_i}$. This mass range $\rho_{mass_m_check_i}$ comprises the selected mass $m_{check_i}$ and is larger than the filter window width $w_{cal}$ of the mass filter window of the mass selecting mode of the first quadrupole 104. During the scanning of the first quadrupole 104 the amplitude of the RF voltage applied to the electrodes of the first quadrupole is given by the function $RF_{fit}(m, w_{cal})$ and the DC voltage applied to the electrodes of the first quadrupole 104 is given by the function $DC_{fit}(m, w_{cal})$.

That each mass $m_{check_i}$ (i=1, 2, 3, . . . , k) of set $M_{check}$ of masses $m_{check}$ is one after the other is detected individually at the ion detector 103 via the second analyzer 105 operating in a mass analysing mode during scanning the first quadrupole 104 operating as pre-selecting analyzer in the mass selecting mode selecting masses in the mass filter window having the filter window width $w_{cal}$ over a mass range $\rho_{mass_m_check_i}$ assigned to the selected mass $m_{check_i}$, is shown in FIG. 9 by the arrow 172. Before step ii c) 163 a mass indicator i is set to i=0. This indicator is increased before a detection of a mass $m_{check_i}$ by i=i+1. So at first the detection of a mass $m_{check_i}$ is executed for the mass $m_{check_1}$ (i=1). The mass indicator i is increased with every repetition shown by the arrow 172, so that during the second detection of a mass $m_{check_i}$ the detection is executed for the mass $m_{check_2}$ (i=2). This detection is in that way repeated up to the mass $m_{check_k}$ (i=k). If i=k there is no more repetition of a detection of a mass $m_{check_i}$ and the next step of the calibration (step ii d, 164) is executed. So for all of the masses $m_{check}$, the set $M_{check}$ of masses $m_{check}$ containing the masses $$M_{check}=\{m_{check_1}, m_{check_2}, \ldots, m_{check_k}\}$$

a detection at the ion detector 3 via the second analyzer 105 operating in a mass analysing mode during scanning the first quadrupole 104 operating as pre-selecting analyzer in the mass selecting mode selecting masses in the mass filter window having the filter window width $w_{cal}$ over a mass range $\rho_{mass_m_check_i}$ assigned to the selected mass $m_{check_i}$ is executed.

Some of the several selected masses $m_{cal}$, the masses $m_{check}$, are detected at the ion detector 103 via the second analyzer 105 operating in a mass analysing mode during scanning the first quadrupole 104 operating as pre-selecting analyzer in the mass selecting mode selecting masses in the mass filter window having the filter window width $w_{cal}$ over a mass range $\rho_{mass_m_check}$ assigned to the selected mass $m_{check}$, comprising the selected mass $m_{check}$ and being larger than the filter window width $w_{cal}$ of the mass filter window of the mass selecting mode of the first quadrupole 104, the amplitude of the RF voltage applied to the electrodes of the first quadrupole 104 given by the function $RF_{fit}(m)$ and the DC voltage applied to the electrodes of the first quadrupole given by the function $DC_{fit}(m)$.

So not calibration masses $m_{cal}$ are checked in step ii c) 163 as mass $m_{check}$. Not more than two-thirds of the calibration masses $m_{cal}$, preferably not more than half of the calibration masses $m_{cal}$ and particular not more than one-third of the calibration masses $m_{cal}$ may be checked in step ii c) 163 as mass $m_{check}$.

The number of masses $m_{check}$ checked in step ii c) 63 may be between 2 and 15, preferable between 4 and 12 and particular preferable between 6 and 10.

In the next step of the calibration of the first quadrupole 104 (step ii d, 164) shown in FIG. 9 the check of the fitted functions $RF_{fit}(m, w_{cal})$ and $DC_{fit}(m, w_{cal})$ is evaluated. For each of these detected selected masses $m_{check}$ a shift of the peak position $\Delta m(m_{check})$ and a deviation of the filter window width $\Delta w(m_{check})$ of the mass selecting mode of the first quadrupole 104 selecting masses in the mass filter window having the filter window width $w_{cal}$, when applying the RF voltage with the amplitude given by the function $RF_{fit}(m, w_{cal})$ and the DC voltage given by the function $DC_{fit}(m, w_{cal})$, is evaluated. By the parameters shift of the peak position $\Delta m(m)$ and/or a deviation of the filter window width $\Delta w(m)$ it shall be determined how big is the deviation of the mass peaks of the detected selected masses $m_{check}$ in the ion detector 103 when the first quadrupole 104 operating as pre-selecting analyzer in the mass selecting mode selecting masses in the mass filter window having the filter window width $w_{cal}$ is scanned over the mass range $\rho_{mass_m_check}$ assigned to the selected mass $m_{check}$ from the expected mass peak of the detected selected masses $m_{check}$ when this detected selected masses $m_{check}$ is in the center of the mass filter window of the first quadrupole 104 and the filter mass window has the filter window width $w_{cal}$. The filter mass window of the first quadrupole 104 is mapped on the ion detector 103 by the mass analysing mode of the second analyzer 105 during scanning the mass range $\rho_{mass_m_check}$ by the first quadrupole 104. This may be a convolution of the mass filter window of the first quadrupole 104 with the mass filter window of the second analyzer 105 operating in the mass analysing mode. The filter window width $w_2$ of the mass filter window of the second mass analyzer 105 operating in the mass analysing mode is nearly 1 u, preferably exactly 1 u (having a tolerance typically for a mass analyzer according to the state of the art).

For each mass $m_{check_i}$ (i=1, 2, 3, . . . , k) of set $M_{check}$ of masses $m_{check}$ a shift of the peak position $\Delta m(m_{check_i})$ and a deviation of the filter window width $\Delta w(m_{check_i})$ of the mass selecting mode of the first quadrupole 104 selecting masses in the mass filter window having the filter window width $w_{cal}$, when applying the RF voltage with the amplitude given by the function $RF_{fit}(m, w_{cal})$ and the DC voltage given by the function $DC_{fit}(m, w_{cal})$, is evaluated.

At the beginning of the evaluation of the check of the fitted functions $RF_{fit}(m, w_{cal})$ and $DC_{fit}(m, w_{cal})$ after the scanning of the first quadrupole 104 over the mass range $\rho_{mass_m_check}$ (step ii c, 163) for a selected mass $m_{check}$ it is evaluated for which masses $m_{set_m_check}$ of the mass range $\rho_{mass_m_check}$ when set at the first function of the amplitude of the $RF_{fit}(m, w_{cal})$ and the second function of the DC voltage $DC_{fit}(m, w_{cal})$ to apply the RF voltage and DC voltage at the first quadrupole 104 the ion detector 103 is detecting the selected mass $m_{check}$.

According to the result of this evaluation the evaluation of the shift of the peak position $\Delta m(m_{check})$ of the detected selected masses $m_{check}$ (step ii d)) is performed by calculating the difference between the mass $m_{set_m_check_c}$ at the center of the scanned masses $m_{set_m_check}$ at which the detection means is detecting the selected mass $m_{check}$ and the selected mass $m_{check}$.

$$\Delta m(m_{check})=m_{set_m_check_c}-m_{check}$$

Like at all differences ($\Delta m(\ldots)$, $\Delta w(\ldots)$) calculated during the execution of the inventive method the difference $\Delta m(m_{check})$ may have positive and negative values or be in the best case zero. According to a positive or negative value the mass $m_{set_m_check_c}$ at the center of the scanned masses can be shifted to a higher value or lower value in comparison to the expected value $m_{check}$.

According to the result of before mentioned evaluation of the masses $m_{set_m_check}$ the evaluation of the deviation of the filter window width $\Delta w(m_{check})$ of the detected selected mass $m_{check}$ (step ii d)) is performed by evaluating a filter window width $w_{check}(m_{check})$ from the masses $m_{set_m_check}$ of the mass range $\rho_{mass_m_check}$ at which the detection means is detecting the selected mass $m_{check}$ and calculating the difference between the filter window width $w_{check}(m_{check})$ and the filter window width $w_{cal}$ for which the first quadrupole has to be calibrated.

$$\Delta w(m_{check})=w_{check}(m_{check})-w_{cal}$$

If $\Delta w(m_{check})$ has a positive value the detected peak for the mass $m_{check}$ during scanning the first quadrupole 104 is too wide and for a negative value to narrow.

The filter window width $w_{check}(m_{check})$ from the masses $m_{set_m_check}$ is determined by determining at which masses $m_{set_m_check}$ during scanning the first quadrupole over the mass range $\rho_{mass_m_check}$ the detection means is detecting a signal which is higher than a percentage of the highest signal detected by the detection means during the scanning. Preferable this percentage is 20% and particular preferable this percentage is 10%.

In the next step of the calibration of the first quadrupole 104 (step ii e), 165) shown in FIG. 10 a decision about the repetition of the calibration has to be defined. It is decided to repeat the calibration steps ii a) to ii e) if the evaluated values of the shift of the peak position $\Delta m(m_{check})$ and the deviation of the filter window width $\Delta w(m_{check})$ of the detected selected masses $m_{check}$ do not comply with a quality condition of the calibration or if another repetition condition is fulfilled. By such a quality condition it is made sure that when a RF voltage with an amplitude given by the function $RF_{fit}(m, w_{cal})$ as calibration function and a DC voltage given by the function $DC_{fit}(m, w_{cal})$ as calibration function are applied to electrodes of the first quadrupole 104 that the shift of the peak position $\Delta m(m_{check})$ does not exceed a threshold value $\Delta m_{max}$ and the deviation of the filter window width $\Delta w(m_{check})$ does not exceed a threshold value $\Delta w_{max}$. These threshold values $\Delta m_{max}$ and $\Delta w_{max}$ may be the same for all detected selected masses $m_{check}$. There may be also different threshold values $\Delta m_{max_i}$ and $\Delta w_{max_i}$ for different detected selected masses $m_{check_i}$.

It is therefore decided to repeat the calibration steps ii a) to ii e) if the evaluated values of the shift of the peak position $\Delta m(m_{check_i})$ and the deviation of the filter window width $\Delta w(m_{check_i})$ of the masses $m_{check_i}$ (i=1, 2, 3, . . . , k) of set $M_{check}$ of masses $m_{check}$ do not comply with a quality condition of the calibration.

During the repetition of the calibration steps ii a) to ii e) in step ii a) in the mass selecting mode of the first quadrupole 104 the functions $RF_{fit}(m, w_{cal})$ as the first function RF(m, w) and $DC_{fit}(m, w_{cal})$ as the second function DC(m, w) are used.

The quality conditions of the calibration to be fulfilled such that the repetition of the calibration steps ii a) to ii e) is stopped are that all evaluated values of a shift of the peak position $\Delta m(m_{check})$ of the mass selecting mode of the detected selected masses $m_{check}$ are below a critical threshold $\Delta m_{max}$ and all deviations of the filter window width $\Delta w(m_{check})$ of the mass selecting mode of the measured selected masses m are below a second critical threshold $\Delta w_{max}$.

The repetition of the calibration steps ii a) to ii e) is executed according to the decision until all quality conditions of the calibration are fulfilled the calibration steps ii a) to ii e) have been executed N times ($N_{rep}$=N).

The number N defining the number of calibration runs after which the calibration is finished is set during the setting of the calibration parameters 160.

The repetition condition to be fulfilled such that the repetition of the calibration steps ii a) to ii e) is stopped may be that the calibration steps ii a) to ii e) has been repeated 2, 3, 5, 7 or 10 or 20 times.

If all quality conditions of the calibration are fulfilled the calibration by the steps ii a) to ii e) is finished and a RF voltage with an amplitude given by the function $RF_{fit}(m, w_{cal})$ as calibration function and a DC voltage given by the function $DC_{fit}(m, w_{cal})$ as calibration function is applied to electrodes of the first quadrupole 104 afterwards during the measurement with the mass spectrometer calibrated with the method according to the invention. So the functions function $RF_{fit}(m, w_{cal})$ and $DC_{fit}(m, w_{cal})$ fitted in the last step ii b) have been defined as suitable calibration functions with which the first quadrupole 104 can be operated as a preselecting mass analyzer in a mass selecting mode selecting masses in a mass filter window having a filter window width $w_{cal}$.

If on the other hand the calibration steps ii a) to ii e) have been executed N times and after that not all quality conditions of the calibration are fulfilled the calibration is stopped because it was not successful. In this case the inventive method for calibrating a mass spectrometer 101 may be started again having a different setting of the calibration parameters like different initial functions of the amplitude of the RF voltage $RF_{ini}(m, w_{cal})$ and the DC voltage $DC_{ini}(m, w_{cal})$, a new set of the several selected masses $M_{cal}$ to determine individually corresponding value of the amplitude of the RF voltage $RF_{det}(m_{cal})$ and value of DC voltage $DC_{det}(m_{cal})$ applied to the electrodes of the first quadrupole 104, a new set of masses $M_{check}$ for which the check of the fitted functions $RF_{fit}(m, w_{cal})$ and $DC_{fit}(m, w_{cal})$ is performed, a new fitting procedure using e.g. a modified fitting function or another fitting algorithm, new quality conditions or an higher number of possible repetitions N of the calibration steps.

The calibrating of the first quadrupole 104 may be repeated after changing at least one kind of function used in calibration step ii b) 162 to fit a function $RF_{fit}(m,w_{cal})$ of the selected mass m to the values of the amplitude of the RF voltage $RF_{det}(m_{cal})$ corresponding to the several selected masses $m_{cal}$ and to fit a function $DC_{fit}(m,w_{cal})$ of the selected mass m to the values of DC voltage $DC_{det}(m_{cal})$ corresponding to the several selected masses $m_{cal}$ or after changing at least one of the quality conditions of the calibration when not all quality conditions of the calibration are fulfilled after the calibration steps ii a) to ii e) have been executed N times.

The calibration may be started again after N repetitions of the calibration with the aim to find calibration functions by changing the kind of function fitted to the values of the amplitude of the RF voltage $RF_{det}(m_{cal})$ corresponding to the several selected masses $m_{cal}$ or values of DC voltage $DC_{det}(m_{cal})$ corresponding to the several selected masses $m_{cal}$.

The calibrating of the first quadrupole 104 may be repeated after changing at least one function of the initial function $RF_{ini}(m,w_{cal})$ for the first function RF(m,w) and the initial function $DC_{ini}(m,w_{cal})$ for the second function DC(m, w) at the beginning of the calibration of the first quadrupole in the mass selecting mode when not all quality conditions of the calibration are fulfilled after the calibration steps ii a) to ii e) have been executed N times. In this embodiment the calibration is started again after N repetitions of the calibration with the aim to find calibration functions by starting the calibration again with at least the changed initial function $RF_{ini}(m,w_{cal})$ or $DC_{ini}(m,w_{cal})$.

The step ii) of calibrating the first quadrupole 4 in the mass selecting mode with the inventive method can repeated several times for different values of the filter window width $w_{cal}$ in the range between 2 u and 30 u, preferable in the range between 5 u and 20 u and particular preferable in the range between 8 u and 15 u.

Figure 12:
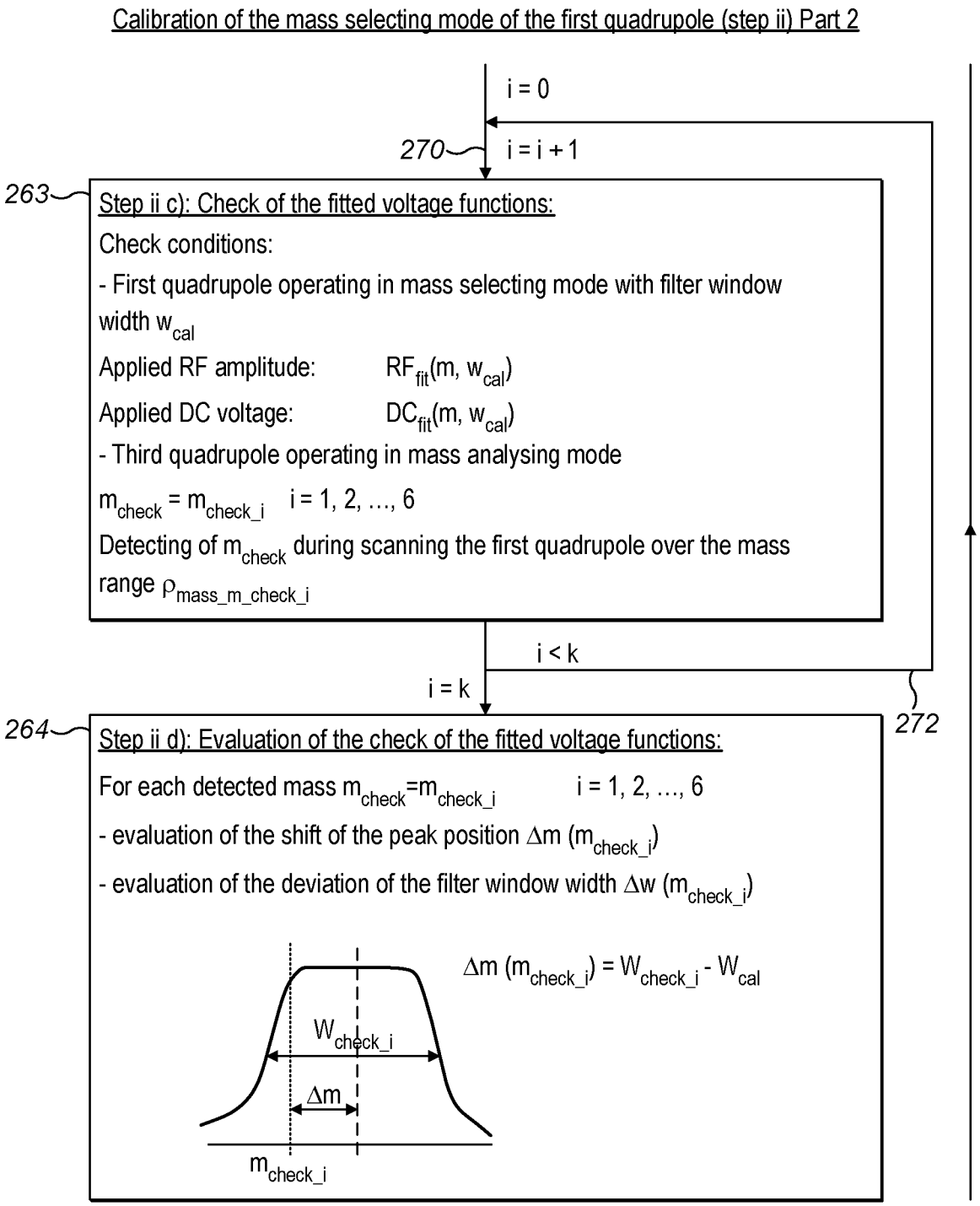
FIG. 12 is a flow chart illustrating in detail the steps of the calibration of the first quadrupole of the second embodiment of a mass spectrometer according to a second embodiment of the inventive method (part 2).
Figure 13:
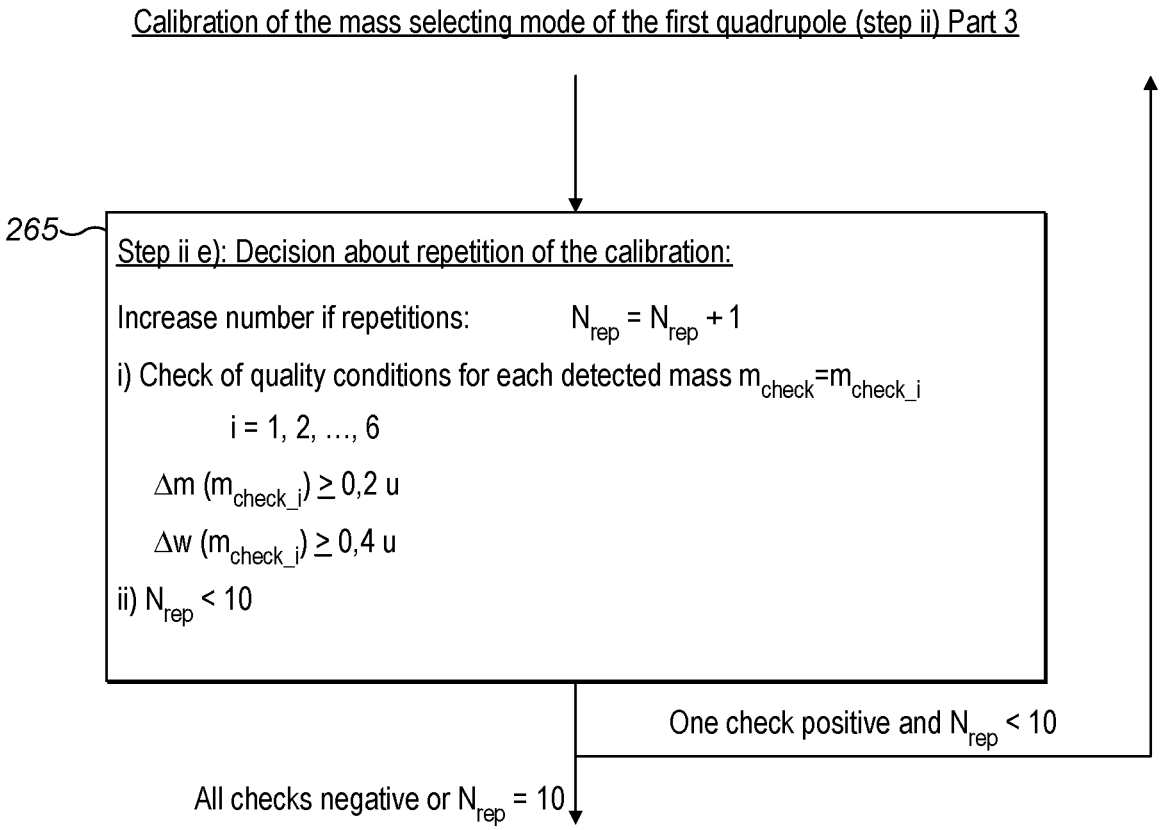
FIG. 13 is a flow chart illustrating in detail the steps of the calibration of the first quadrupole of the second embodiment of a mass spectrometer according to a second embodiment of the inventive method (part 3).

The second embodiment of the claimed method which is used for calibrating the first embodiment of a mass spectrometer shown in FIG. 7 is illustrated in detail by a flow chart showing in detail the steps of the calibration of the first quadrupole (step ii, 22). For better clarity of the flow chart showing a lot of details of the method the low chart in split in three parts (parts 1, 2 and 3) which are shown in the separate FIGS. 11, 12 and 13. It is clear that the different steps of the method shall be executed one of the other following the arrows between the boxes of the flow chart. So despite the repetitions of several steps shown by arrows running in parallel to the boxes of the flow short showing up the different steps are executed starting from the top of each Figure to the bottom of the Figure and after executing the steps of one Figure the steps of the following Figure are executed again from the top to the bottom of the following Figure. The after the steps of FIG. 11 are executed the Steps of FIG. 12 are executed and after the steps of FIG. 12 are executed the Steps of FIG. 13 are executed. More in detail for example of the step at the bottom of FIG. 11 is executed (step ii b) the step at the top of FIG. 12 (step ii c) is executed. This is also shown by the arrow 270 above the box of step ii c) in FIG. 12 pointing with his arrowhead to the box of step ii c).

Before the calibration of the first quadrupole 104 is started, there is a setting of calibration parameters 260 for the calibration. During this setting the filter window width $w_{cal}$ of the mass filter window is set, for which mass filter window the mass selecting mode of the first quadrupole 104 shall be calibrated. The filter window width $w_{cal}$ is set in this second embodiment of the inventive method to the value 10 u ($w_{cal}$=10 u).

At the beginning of the calibration of the first quadrupole 104 in the mass selecting mode an initial function $RF_{ini}(m, w_{cal})$ is used for the first function $RF(m, w_{cal})$ and an initial function $DC_{ini}(m, w_{cal})$ for the second function $DC(m, w_{cal})$. These initial functions are set during the setting of calibration parameters 260.

In a first step of the calibration of the first quadrupole (step ii a), 261) for 8 selected masses $m_{cal}$ which shall be selected by the first quadrupole 104 in the mass selecting mode the amplitude of the RF voltage and DC voltage is determined which has to be applied to the electrodes of the first quadrupole 104 so that the mass $m_{cal}$ is selected by the first quadrupole 104 in the middle of the mass filter window which has the intended filter window width $w_{cal}$=10 u.

This determination is executed individually for each of several selected masses $m_{cal}$ one after the other. These several selected masses $m_{cal}$ are calibration masses for defining reference points of suitable values of the amplitude of the RF voltage and DC voltage. These several selected masses $m_{cal}$ are defined in a parameter set during the setting of the calibration parameters 60. So a number of 8 calibration masses are defined as the several selected masses. Accordingly the defined calibration masses result in a set $M_{cal}$ of calibration masses $m_{cal}$ containing the masses $m_1$, $m_2$, $m_3$, . . . , $m_8$.

$$m_{cal} \in M_{cal} = \{m_1, m_2, \ldots, m_8\}$$

For each of the 8 selected masses $m_{cal}$ a corresponding value of the amplitude of the RF voltage $RF_{det}(m_{cal})$ and value of DC voltage $DC_{det}(m_{cal})$ is determined. If the corresponding RF voltage and DC voltage applied to the electrodes of the first quadrupole, masses are selected by the first quadrupole 104 in a mass filter window having in the middle the selected mass $m_{cal}$ and the filter window width $w_{cal}$. So for each mass $m_j$ (j=1, 2, 3, . . . , 8 of set $M_{cal}$ of calibration masses $m_{cal}$a corresponding value of the amplitude of the RF voltage $RF_{det}(m_j)$ and value of DC voltage $DC_{det}(m_j)$ is determined.

That determination is executed individually for each of several selected masses $m_{cal}$ one after the other, is shown in FIG. 11 by the arrow 271. Before step ii a) 261 a mass indicator j is set to j=0. This indicator is increased before a determination of a value of the amplitude of the RF voltage $RF_{det}(m_{cal})$ and a value of DC voltage $DC_{det}(m_{cal})$ by j=j+1. So at first the determination is executed for the mass $m_1$ (j=1). The mass indicator j is increased with every repetition shown by the arrow 271, so that during the second determination of a value of the amplitude of the RF voltage $RF_{det}(m_{cal})$ and a value of DC voltage $DC_{det}(m_{cal})$ the determination is executed for the mass $m_2$ (j=2). This determination is in that way repeated up to the mass $m_8$ (j=8). If j=8 there is no more repetition of a determination of a value of the amplitude of the RF voltage $RF_{det}(m_{cal})$ and a value of DC voltage $DC_{det}(m_{cal})$ and the next step of the calibration (step ii b, 262) is executed. So for all of the several selected masses $m_{cal}$, the set $M_{cal}$ of calibration masses $m_{cal}$ containing the masses $m_1$, $m_2$, $m_3$, . . . , $m_8$ a determination of a value of the amplitude of the RF voltage $RF_{det}(m_{cal})$ and a value of DC voltage $DC_{det}(m_{cal})$ is executed.

During the individual determination of the corresponding value of the amplitude of the RF voltage $RF_{det}(m_{cal})$ and value of DC voltage $DC_{det}(m_{cal})$ to a selected mass $m_{cal}$ the second mass analyzer 105 is filtering the selected mass $m_{cal}$. During this determination the second quadrupole 105 is set to filter the selected mass $m_{cal}$ by selecting masses m in a mass filter window having a filter window width $w_2$ of 0.75 u.

During the individual determination of the corresponding value of the amplitude of the RF voltage $RF_{det}(m_{cal})$ and value of DC voltage $DC_{det}(m_{cal})$ to a selected mass $m_{cal}$ the first quadrupole 104 is scanned over a mass range $\rho_{mass}$ comprising the selected mass $m_{cal}$ applying the RF amplitude and the DC voltage to the electrodes of the first quadrupole according to the first function $RF(m, w_{cal})$ and the a second function $DC(m, w_{cal})$ for the masses m of the mass range $\rho_{mass}$. After the scanning of the first quadrupole 104 over the mass range $\rho_{mass}$ it may be evaluated for which masses $m_{set}$ of the mass range $\rho_{mass}$ when set at the first function of the amplitude of the $RF(m, w_{cal})$ and the second function of the DC voltage $DC(m, w_{cal})$ to apply the RF voltage and DC voltage at the first quadrupole 104 the ion detector 103 is detecting the selected mass $m_{cal}$.

The filter window width w of the first quadrupole 104 is increased when the selected mass $m_{cal}$ is not transmitted by the second analyzer 105 and detected by the ion detector 3 during the individual determination of the corresponding value of the amplitude of the RF voltage $RF_{det}(m_{cal})$ and value of DC voltage $DC_{det}(m_{cal})$ to the selected mass $m_{cal}$. The filter window width w of the first quadrupole 104 is doubled.

Furthermore the DC voltage applied to the electrodes of the first quadrupole 104 is decreased stepwise until the selected mass $m_{cal}$ is detected by the second analyzer 105 when the selected mass $m_{cal}$ is not detected by the second analyzer 105 during the individual determination of the corresponding value of the amplitude of the RF voltage $RF_{det}(m_{cal})$ and value of DC voltage $DC_{det}(m_{cal})$ to the selected mass $m_{cal}$, after the filter window width w of the first quadrupole 104 is extended.

In particular the DC voltage applied to the electrodes of the first quadrupole 104 is decreased stepwise in that in the second function DC(m, w) which is defining the DC voltage, a constant offset value DCoffset is lowered stepwise until the selected mass $m_{cal}$ is detected by the second analyzer 105 and the detection means 103.

If due to these provisions the selected mass $m_{cal}$ is detected by the second analyzer 105 and the ion detector 103 the constant offset value DCoffset of the second function DC(m, w) is increased stepwise until the filter window width w of the first quadrupole 104 is below a filter window width $w_{min}$ of the mass selecting mode to be calibrated, when the selected mass $m_{cal}$ is analysed by the second analyzer 105 and detected by the ion detector 103 and the peak width w of the selected mass $m_{cal}$ is bigger than a first maximum peak width $w_{max}$.

After the evaluation at which masses $m_{set}$ of the mass range $\rho_{mass}$ the ion detector 103 is detecting the selected mass $m_{cal}$ it is determined if the whole peak of the mass $m_{cal}$ is detected. This is only given if there is detected at both borders of the mass range $\rho_{mass}$ only no real mass signal, that means only a signal a noise signal detected by the ion detector 103. If only at one of the borders of the mass range no real mass signal is detected, the peak of the mass $m_{cal}$ has to be shifted. This is done by adding offset values RFoffset and DCoffset to the first function of the amplitude of the RF(m, w) and the second function of the DC voltage DC(m, w) to apply the RF voltage and DC voltage at the first quadrupole 104. If at bother border a real mass signal is detected the peak of the mass $m_{cal}$ is broader than the mass range $\rho_{mass}$ and has at first made more narrow by adding a positive offset value DCoffset to the second function of the DC voltage DC(m, w) to apply the DC voltage at the first quadrupole 104.

If the whole peak of the mass $m_{cal}$ is detected the shift of the peak position $\Delta m(m_{cal})$ of the selected mass $m_{cal}$ may be evaluated. The evaluation of the shift of the peak position $\Delta m(m_{cal})$ of the selected mass $m_{cal}$ is performed by calculating the difference between the mass $m_{set_c}$ at the center of the masses $m_{set}$ at which the ion detector 103 is detecting the selected mass $m_{cal}$ and the selected mass $m_{cal}$.

The individual determination of the corresponding value of the amplitude of the RF voltage $RF_{det}(m_{cal})$ and value of DC voltage $DC_{det}(m_{cal})$ to a selected mass $m_{cal}$ the individual definition of a corresponding the amplitude of the RF voltage $RF_{det}(m_{cal})$ and DC voltage $DC_{det}(m_{cal})$ (step ii a), 261) of the selected mass $m_{cal}$ is done by changing the value of the first function $RF(m_{cal},w_{cal})$ and/or the value of the second function $DC(m_{cal}, w_{cal})$ corresponding to the selected mass $m_{cal}$ depending on the shift of the peak position $\Delta m(m_{cal})$ of the selected mass $m_{cal}$. This individual definition of a corresponding value of the amplitude of the RF voltage $RF_{det}(m_{cal})$ and value of the DC voltage $DC_{det}(m_{cal})$ of the selected mass $m_{cal}$ may be done by adding to the value of the first function $RF(m_{cal},w_{cal})$ and/or the value of the second function $DC(m_{cal},w_{cal})$ corresponding to the selected mass $m_{cal}$ the value the shift of the peak position $\Delta m(m_{cal})$ of the selected mass $m_{cal}$ multiplied with a factor corresponding to the amplitude of the RF voltage $RFfactor_{p_shift}$ and/or DC voltage $DCfactor_{p_shift}$.

$$RF(m_{cal},w_{cal})_{new}=RF(m_{cal},w_{cal})+RF\text{factor}_{p_shift}*\Delta m(m_{cal})$$

$$DC(m_{cal},w_{cal})_{new}=DC(m_{cal},w_{cal})+DC\text{factor}_{p_shift}*\Delta m(m_{cal})$$

In particular the individual definition of a corresponding value of the amplitude of the RF voltage $RF_{det}(m_{cal})$ of the selected mass $m_{cal}$ may be done by adding to the value of the first function $RF(m_{cal},w_{cal})$ corresponding to the selected mass $m_{cal}$ the value the shift of the peak position $\Delta m(m_{cal})$ of the selected mass $m_{cal}$ multiplied with a linear factor RFlinear of the first function $RF(m, w_{cal})$.

$$RF(m_{cal},w_{cal})_{new}=RF(m_{cal},w_{cal})+RF\text{linear}*\Delta m(m_{cal})$$

The linear factor RFlinear of the first function $RF(m, w_{cal})$ is the factor with which the mass m is multiplied if the function $RF(m, w_{cal})$ in a summation of different functions and one of the summed function is a linear function.

$$RF(m,w_{cal})=RF\text{linear}*m+f_1(m)+f_2(m)+\ldots.$$

In particular the individual definition of a corresponding DC voltage $DC_{det}(m_{cal})$ of the selected mass $m_{cal}$ may be done by adding to the value of the second function $DC(m_{cal}, w_{cal})$ corresponding to the selected mass $m_{cal}$ the value the shift of the peak position $\Delta m(m_{cal})$ of the selected mass $m_{cal}$ multiplied with a linear factor DClinear of the second function $DC(m, w_{cal})$ divided by a linear factor RFlinear of the first function $RF(m, w_{cal})$.

$$DC(m_{cal},w_{cal})_{new}=DC(m_{cal},w_{cal})+DC\text{linear}/RF\text{linear}*\Delta m(m_{cal})$$

The linear factor DClinear of the second function $DC(m, w_{cal})$ is the factor with which the mass m is multiplied if the function $DC(m, w_{cal})$ in a summation of different functions and one of the summed function is a linear function.

$$DC(m,w_{cal})=DC\text{linear}*m+f_1(m)+f_2(m)+\ldots$$

The deviation of the filter window width $\Delta w(m_{cal})$ of the selected mass $m_{cal}$ is evaluated after the evaluation at which masses $m_{set}$ of the mass range $\rho_{mass}$ the detection means is detecting the selected mass $m_{cal}$. The evaluation of the deviation of the filter window width $\Delta w(m_{cal})$ of the selected mass $m_{cal}$ is performed by evaluating a mass range $\rho_{massdetect}(m_{cal})$ of the masses $m_{set}$ set at the first function of the amplitude of the $RF(m, w_{cal})$ and the second function of the DC voltage $DC(m, w_{cal})$ to apply the RF voltage and DC voltage at the first quadrupole 104 for which the detection means is detecting the selected mass $m_{cal}$ and calculating the difference $\Delta w(m_{cal})$ between the mass range $\rho_{massdetect}(m_{cal})$ and the filter window width $w_{cal}$ for which the first quadrupole has to be calibrated.

$$\Delta w(m_{cal})=\rho_{massdetect}(m_{cal})-w_{cal}$$

The evaluation of the mass range $\rho_{massdetect}(m_{cal})$ is performed by evaluating the masses $m_{set}$ set at the first function of the amplitude of the $RF(m, w_{cal})$ and the second function of the DC voltage $DC(m, w_{cal})$ to apply the RF voltage and DC voltage at the first quadrupole for which the ion detector 103 is detecting a signal which is higher than a percentage of the highest signal detected by the detection means. The evaluation of the mass range $\rho_{massdetect}(m_{cal})$ is performed by evaluating the masses $m_{set}$ set at the first function of the amplitude of the $RF(m, w_{cal})$ and the second function of the DC voltage $DC(m, w_{cal})$ to apply the RF voltage and DC voltage at the first quadrupole 104 for which the detection means is detecting a signal which is higher than 20 percent of the highest signal detected by the detection means.

During the individual determination of the corresponding value of the amplitude of the RF voltage $RF_{det}(m_{cal})$ and value of DC voltage $DC_{det}(m_{cal})$ to a selected mass $m_{cal}$ the individual definition of a corresponding the amplitude of the RF voltage $RF_{det}(m_{cal})$ and DC voltage $DC_{det}(m_{cal})$ (step ii a), 261) of the selected mass $m_{cal}$ is done by changing the value of the first function $RF(m_{cal}, w_{cal})$ and the value of the second function $DC(m_{cal}, w_{cal})$ corresponding to the selected mass $m_{cal}$ depending on the deviation of the filter window width $\Delta w(m_{cal})$ of the selected mass $m_{cal}$.

In particular the individual determination of a corresponding value of the amplitude of the RF voltage $RF_{det}(m_{cal})$ and value of the DC voltage $DC_{det}(m_{cal})$ of the selected mass $m_{cal}$ is done by adding to the value of the first function $RF(m_{cal}, w_{cal})$ and/or the value of the second function $DC(m_{cal}, w_{cal})$ corresponding to the selected mass $m_{cal}$ the value the deviation of the filter window width $\Delta w(m_{cal})$ of the selected mass $m_{cal}$ multiplied with a factor corresponding to the RF voltage $\Delta w\text{-factor}_{RF}$ and/or DC voltage $\Delta w\text{-factor}_{DC}$.

$$RF(m_{cal},w_{cal})_{new}=RF(m_{cal},w_{cal})+\Delta w\text{-factor}_{RF}*\Delta w(m_{cal})$$

$$DC(m_{cal},w_{cal})_{new}=DC(m_{cal},w_{cal})+\Delta w\text{-factor}_{DC}*\Delta w(m_{cal})$$

In particular the individual determination of a corresponding value of the amplitude of the RF voltage $RF_{det}(m_{cal})$ of the selected mass $m_{cal}$ is done by adding to the value of the first function $RF(m_{cal}, w_{cal})$ corresponding to the selected mass $m_{cal}$ the value of the deviation of the filter window width $\Delta w(m_{cal})$ of the selected mass $m_{cal}$ multiplied with a linear factor DClinear of the second function $DC(m, w_{cal})$ divided by a linear factor RFlinear of the first function $RF(m, w_{cal})$.

$$RF(m_{cal},w_{cal})_{new}=RF(m_{cal},w_{cal})+DC\text{linear}/RF\text{linear}*\Delta w(m_{cal})$$

Preferable for two selected masses $m_{coarse}$ a corresponding value of the amplitude of the RF voltage $RF_{det}(m_{coarse})$ and value of DC voltage $DC_{det}(m_{coarse})$ is determined individually before for 8 selected masses $m_{cal}$ a corresponding value of the amplitude of the RF voltage $RF_{det}(m_{cal})$ and value of DC voltage $DC_{det}(m_{cal})$ is determined individually (step ii a, 261)). In particular the two selected masses $m_{coarse}$ for which a corresponding value of the amplitude of the RF voltage $RF_{det}(m_{coarse})$ and value of DC voltage $DC_{det}(m_{coarse})$ is determined individually before for several selected masses $m_{cal}$ a corresponding value of the amplitude of the RF voltage $RF_{det}(m_{cal})$ and value of DC voltage $DC_{det}(m_{cal})$ is determined individually are the masses of the molecules $^{16}O^{40}Ar$ and $^{40}Ar^{40}Ar$.

After for the two selected masses $m_{coarse}$ a corresponding value of the amplitude of the RF voltage $RF_{det}(m_{coarse})$ and value of DC voltage $DC_{det}(m_{coarse})$ is determined individually a function $RF_{coarse}(m, w_{cal})$ of the selected mass m is fitted to the values of the amplitudes of the RF voltage $RF_{det}(m_{coarse})$ corresponding to the two selected masses $m_{coarse}$ by changing a linear factor RFlinear and a constant offset value RFoffset of the initial function $RF_{ini}(m, w_{cal})$ and a function $DC_{coarse}(m, w_{cal})$ of the selected mass m is fitted to the values of DC voltage $DC_{det}(m_{coarse})$ corresponding to the two selected masses $m_{coarse}$ by changing a linear factor DClinear and a constant offset value DCoffset of the initial function $DC_{ini}(m, w_{cal})$.

In the next step of the calibration of the first quadrupole (step ii b), 262) shown in FIG. 11 functions are fitted to the reference points determined for the calibration masses in the step described before. A function $RF_{fit}(m, w_{cal})$ of the selected mass m is fitted to the values of the amplitude of the RF voltage $RF_{det}(m_{cal})$ corresponding to the several selected masses $m_{cal}$ and a function $DC_{fit}(m, w_{cal})$ of the selected mass m is fitted to the values of DC voltages $DC_{det}(m_{cal})$ corresponding to the several selected masses $m_{cal}$. The function $RF_{fit}(m, w_{cal})$ of the selected mass m is fitted to the value of the amplitude of the RF voltage $RF_{det}(m_j)$ of each mass $m_j$ (j=1, 2, 3, . . . , 8) of set $M_{cal}$ of calibration masses $m_{cal}$. The function $DC_{fit}(m, w_{cal})$ of the selected mass m is fitted to value of DC voltage $DC_{det}(m_j)$ of each mass $m_j$ (j=1, 2, 3, . . . , 8) of set $M_{cal}$ of calibration masses $m_{cal}$.

In general there are various approaches to fit a function $RF_{fit}(m, w_{cal})$ of the selected mass m to the determined values of the amplitude of the RF voltage $RF_{det}(m_{cal})$ corresponding to the several selected masses $m_{cal}$ and a function $DC_{fit}(m, w_{cal})$ of the selected mass m to the determined values of DC voltages $DC_{det}(m_{cal})$ corresponding to the several selected masses $m_{cal}$.

In the used approach of fitting a function $RF_{fit}(m,w_{cal})$ of the selected mass m to the values of the amplitude of the RF voltage $RF_{det}(m_{cal})$ corresponding to the several selected masses $m_{cal}$ and fitting a function $DC_{fit}(m,w_{cal})$ of the selected mass m to the values of DC voltage $DC_{det}(m_{cal})$ corresponding to the several selected masses $m_{cal}$ (step ii b), 262) the function $RF_{fit}(m,w_{cal})$ is the summation of a constant value $RFoffset_{fit}$, a linear function of the selected mass m, a quadratic function of the selected mass m and two exponential functions whose exponents are different linear functions of the selected mass m and the function $DC_{fit}(m, w_{cal})$ is the summation of a constant value $DCoffset_{fit}$, a linear function of the selected mass m, a quadratic function of the selected mass m and two exponential functions whose exponents are different linear functions of the selected mass m.

In the preferably used approach of fitting a function $RF_{fit}(m,w_{cal})$ of the selected mass m to the values of the amplitude of the RF voltage $RF_{det}(m_{cal})$ corresponding to the several selected masses $m_{cal}$ and fitting a function $DC_{fit}(m,w_{cal})$ of the selected mass m to the values of DC voltage $DC_{det}(m_{cal})$ corresponding to the several selected masses $m_{cal}$ (step ii b), 262) in a first step summation of a constant value $RFoffset_{fit}$ and a linear function of the selected mass m is fitted for the function $RF_{fit}(m,w_{cal})$ and summation of a constant value $DCoffset_{fit}$ and a linear function of the selected mass m is fitted for the function $DC_{fit}(m,w_{cal})$ and in a second step the function $RF_{fit}(m,w_{cal})$ is fitted by adding to the summation of a constant value $RFoffset_{fit}$ and a linear function of the selected mass m fitted in the first step the summation of a constant value, a quadratic function of the selected mass m and two exponential functions whose exponents are different linear functions of the selected mass m and the function $DCF_{fit}(m,w_{cal})$ is fitted by adding to the summation of a constant value $DCoffset_{fit}$ and a linear function of the selected mass m fitted in the first step the summation of a constant, a quadratic function of the selected mass m and two exponential functions whose exponents are different linear functions of the selected mass m.

The fitting of a function $RF_{fit}(m,w_{cal})$ of the selected mass m to the values of the amplitude of the RF voltage $RF_{det}(m_{cal})$ corresponding to the several selected masses $m_{cal}$ and fitting a function $DC_{fit}(m,w_{cal})$ of the selected mass m to the values of DC voltage $DC_{det}(m_{cal})$ corresponding to the several selected masses $m_{cal}$ (step ii b), 262) may be done by a method of polynomial fit, cubic spline fit or nonlinear least square fit.

In the next step of the calibration of the first quadrupole (step ii c), 263) shown in FIG. 12 the fit of the functions fitted in the step above (step ii b), 262) is checked. This check is performed for at least some of the several selected masses $m_{check}$. These masses $m_{check}$ belong to the 8 masses $m_{cal}$ for which in the foregoing step ii a) 161 the RF voltage and DC voltage has been determined. For which of the 8 selected masses $m_{check}$ the check is performed is set during the setting of the calibration parameters 160.

The check is performed for some of the masses $m_{cal}$ for which in the foregoing step ii a) 261 the RF voltage and DC voltage has been determined. So the set $M_{check}$ of masses $m_{check}$ for which the check is performed is a subset of the set $M_{cal}$ of calibration masses $m_{cal}$.

$$m_{check} \in M_{check};\ M_{check} \subseteq M_{cal}$$

If for 6 masses $m_{check}$ the check is performed the set $M_{check}$ of masses $m_{check}$ is:

$$M_{check}=\{m_{check_1}, m_{check_2}, \ldots, m_{check_6}\}$$

So for each mass $m_{check_i}$ (i=1, 2, 3, . . . , 6) of set $M_{check}$ of masses $m_{check}$ the check is performed.

The masses $m_{check}$ for which the check is performed are detected at the ion detector 103 via the second analyzer 105 operating in a mass analysing mode during scanning the first quadrupole 104 operating as pre-selecting analyzer in the mass selecting mode selecting masses in the mass filter window having the filter window width $w_{cal}$ over a mass range $\rho_{mass_m_check}$ assigned to the selected mass $m_{check}$, comprising the selected mass $m_{check}$ and being larger than the filter window width $w_{cal}$ of the mass filter window of the mass selecting mode of the first quadrupole. The assignment of a mass range $\rho_{mass_m_check}$ to each the of selected masses $m_{check}$ is performed during the setting of the calibration parameters 260.

The amplitude of the RF voltage applied to the electrodes of the first quadrupole 104 is given by the function $RF_{fit}(m, w_{cal})$ and the DC voltage applied to the electrodes of the first quadrupole is given by the function $DC_{fit}(m, w_{cal})$.

So each mass $m_{check_i}$ (i=1, 2, 3, . . . , 6) of set $M_{check}$ of masses $m_{check}$ is one after the other detected at the ion detector 3 via the second analyzer 105 operating in a mass analysing mode during scanning the first quadrupole 104 operating as pre-selecting analyzer in the mass selecting mode selecting masses in the mass filter window having the filter window width $w_{cal}$ over a mass range $\rho_{mass_m_check_i}$ assigned to the selected mass $m_{check_i}$. This mass range $\rho_{mass_m_check_i}$ comprises the selected mass $m_{check_i}$ and is larger than the filter window width $w_{cal}$ of the mass filter window of the mass selecting mode of the first quadrupole 104. During the scanning of the first quadrupole 104 the amplitude of the RF voltage applied to the electrodes of the first quadrupole is given by the function $RF_{fit}(m, w_{cal})$ and the DC voltage applied to the electrodes of the first quadrupole 104 is given by the function $DC_{fit}(m, w_{cal})$.

That each mass $m_{check_i}$ (i=1, 2, 3, . . . , 6) of set $M_{check}$ of masses $m_{check}$ is one after the other is detected individually at the ion detector 103 via the second analyzer 105 operating in a mass analysing mode during scanning the first quadrupole 104 operating as pre-selecting analyzer in the mass selecting mode selecting masses in the mass filter window having the filter window width $w_{cal}$ over a mass range $\rho_{mass_m_check_i}$ assigned to the selected mass $m_{check_i}$, is shown in FIG. 9 by the arrow 272. Before step ii c) 263 a mass indicator i is set to i=0. This indicator is increased before a detection of a mass $m_{check_i}$ by i=i+1. So at first the detection of a mass $m_{check_i}$ is executed for the mass $m_{check_1}$ (i=1). The mass indicator i is increased with every repetition shown by the arrow 272, so that during the second detection of a mass $m_{check_i}$ the detection is executed for the mass $m_{check_2}$ (i=2). This detection is in that way repeated up to the mass $m_{check_6}$ (i=6). If i=6 there is no more repetition of a detection of a mass $m_{check_i}$ and the next step of the calibration (step ii d, 264) is executed. So for all of the masses $m_{check}$, the set $M_{check}$ of masses $m_{check}$ containing the masses $$M_{check}=\{m_{check_1}, m_{check_2}, \ldots, m_{check_6}\}$$

a detection at the ion detector 3 via the second analyzer 105 operating in a mass analysing mode during scanning the first quadrupole 104 operating as pre-selecting analyzer in the mass selecting mode selecting masses in the mass filter window having the filter window width $w_{cal}$ over a mass range $\rho_{mass_m_check_i}$ assigned to the selected mass $m_{check_i}$ is executed.

Some of the several selected masses $m_{cal}$, the masses $m_{check}$, are detected at the ion detector 103 via the second analyzer 105 operating in a mass analysing mode during scanning the first quadrupole 104 operating as pre-selecting analyzer in the mass selecting mode selecting masses in the mass filter window having the filter window width $w_{cal}$ over a mass range $\rho_{mass_m_check}$ assigned to the selected mass $m_{check}$, comprising the selected mass $m_{check}$ and being larger than the filter window width $w_{cal}$ of the mass filter window of the mass selecting mode of the first quadrupole 104, the amplitude of the RF voltage applied to the electrodes of the first quadrupole 104 given by the function $RF_{fit}(m)$ and the DC voltage applied to the electrodes of the first quadrupole given by the function $DC_{fit}(m)$.

So not all calibration masses $m_{cal}$ are checked in step ii c) 263 as mass $m_{check}$.

In the next step of the calibration of the first quadrupole 104 (step ii d, 264) shown in FIG. 12 the check of the fitted functions $RF_{fit}(m, w_{cal})$ and $DC_{fit}(m, w_{cal})$ is evaluated. For each of these detected 6 selected masses $m_{check}$ a shift of the peak position $\Delta m(m_{check})$ and a deviation of the filter window width $\Delta w(m_{check})$ of the mass selecting mode of the first quadrupole 104 selecting masses in the mass filter window having the filter window width $w_{cal}$, when applying the RF voltage with the amplitude given by the function $RF_{fit}(m, w_{cal})$ and the DC voltage given by the function $DC_{fit}(m, w_{cal})$, is evaluated. By the parameters shift of the peak position $\Delta m(m)$ and/or a deviation of the filter window width $\Delta w(m)$ it shall be determined how big is the deviation of the mass peaks of the detected selected masses $m_{check}$ in the ion detector 103 when the first quadrupole 104 operating as pre-selecting analyzer in the mass selecting mode selecting masses in the mass filter window having the filter window width $w_{cal}$ is scanned over the mass range $\rho_{mass_m_check}$ assigned to the selected mass $m_{check}$ from the expected mass peak of the detected selected masses $m_{check}$ when this detected selected masses $m_{check}$ is in the center of the mass filter window of the first quadrupole 104 and the filter mass window has the filter window width $w_{cal}$. The filter mass window of the first quadrupole 104 is mapped on the ion detector 103 by the mass analysing mode of the second analyzer 105 during scanning the mass range $\rho_{mass_m_check}$ by the first quadrupole 104. This may be a convolution of the mass filter window of the first quadrupole 104 with the mass filter window of the second analyzer 105 operating in the mass analysing mode. The filter window width $w_2$ of the mass filter window of the second mass analyzer 105 operating in the mass analysing mode is 0.75 u.

For each mass $m_{check_i}$ (i=1, 2, 3, . . . , 6) of set $M_{check}$ of masses $m_{check}$ a shift of the peak position $\Delta m(m_{check_i})$ and a deviation of the filter window width $\Delta w(m_{check_i})$ of the mass selecting mode of the first quadrupole 104 selecting masses in the mass filter window having the filter window width $w_{cal}$, when applying the RF voltage with the amplitude given by the function $RF_{fit}(m, w_{cal})$ and the DC voltage given by the function $DC_{fit}(m, w_{cal})$, is evaluated.

At the beginning of the evaluation of the check of the fitted functions $RF_{fit}(m, w_{cal})$ and $DC_{fit}(m, w_{cal})$ after the scanning of the first quadrupole 104 over the mass range $\rho_{mass_m_check}$ (step ii c, 263) for a selected mass $m_{check}$ it is evaluated for which masses $m_{set_m_check}$ of the mass range $\rho_{mass_m_check}$ when set at the first function of the amplitude of the $RF_{fit}(m, w_{cal})$ and the second function of the DC voltage $DC_{fit}(m, w_{cal})$ to apply the RF voltage and DC voltage at the first quadrupole 104 the ion detector 103 is detecting the selected mass $m_{check}$.

According to the result of this evaluation the evaluation of the shift of the peak position $\Delta m(m_{check})$ of the detected selected masses $m_{check}$ (step ii d)) is performed by calculating the difference between the mass $m_{set_m_check_c}$ at the center of the scanned masses $m_{set_m_check}$ at which the detection means is detecting the selected mass $m_{check}$ and the selected mass $m_{check}$.

$$\Delta m(m_{check})=m_{set_m_check_c}-m_{check}$$

Like at all differences ($\Delta m(\ldots)$, $\Delta w(\ldots)$) calculated during the execution of the inventive method the difference $\Delta m(m_{check})$ may have positive and negative values or be in the best case zero. According to a positive or negative value the mass $m_{set_m_check_c}$ at the center of the scanned masses can be shifted to a higher value or lower value in comparison to the expected value $m_{check}$.

According to the result of before mentioned evaluation of the masses $m_{set_m_check}$ the evaluation of the deviation of the filter window width $\Delta w(m_{check})$ of the detected selected mass $m_{check}$ (step ii d), 264) is performed by evaluating a filter window width $w_{check}(m_{check})$ from the masses $m_{set_m_check}$ of the mass range $\rho_{mass_m_check}$ at which the detection means is detecting the selected mass $m_{check}$ and calculating the difference between the filter window width $w_{check}(m_{check})$ and the filter window width $w_{cal}$ for which the first quadrupole has to be calibrated.

$$\Delta w(m_{check})=w_{check}(m_{check})-w_{cal}$$

If $\Delta w(m_{check})$ has a positive value the detected peak for the mass $m_{check}$ during scanning the first quadrupole 104 is too wide and for a negative value to narrow.

The filter window width $w_{check}(m_{check})$ from the masses $m_{set_m_check}$ is determined by determining at which masses $m_{set_m_check}$ during scanning the first quadrupole over the mass range $\rho_{mass_m_check}$ the detection means is detecting a signal which is higher than a 20% of the highest signal detected by the detection means during the scanning.

In the next step of the calibration of the first quadrupole 104 (step ii e), 265) shown in FIG. 13 a decision about the repetition of the calibration has to be defined. It is decided to repeat the calibration steps ii a) to ii e) if the evaluated values of the shift of the peak position $\Delta m(m_{check})$ and the deviation of the filter window width $\Delta w(m_{check})$ of the detected 6 masses $m_{check}$ do not comply with a quality condition of the calibration or if another repetition condition is fulfilled. By such a quality condition it is made sure that when a RF voltage with an amplitude given by the function $RF_{fit}(m, w_{cal})$ as calibration function and a DC voltage given by the function $DC_{fit}(m, w_{cal})$ as calibration function are applied to electrodes of the first quadrupole 104 that the shift of the peak position $\Delta m(m_{check})$ does not exceed a threshold value $\Delta m_{max}$ and the deviation of the filter window width $\Delta w(m_{check})$ does not exceed a threshold value $\Delta w_{max}$. These threshold values $\Delta m_{max}$ and $\Delta w_{max}$ are the same for all detected 6 masses $m_{check}$. They have the values $\Delta m_{max}=0.2$ u and $\Delta w_{max}=0.4$ u It is therefore decided to repeat the calibration steps ii a) to ii e) if the evaluated values of the shift of the peak position $\Delta m(m_{check_i})$ and the deviation of the filter window width $\Delta w(m_{check_i})$ of the masses $m_{check_i}$ (i=1, 2, 3, . . . , 6) of set $M_{check}$ of masses $m_{check}$ do not comply with a quality condition of the calibration.

During the repetition of the calibration steps ii a) to ii e) in step ii a) in the mass selecting mode of the first quadrupole 104 the functions $RF_{fit}(m, w_{cal})$ as the first function RF(m, w) and $DC_{fit}(m, w_{cal})$ as the second function DC(m, w) are used.

The quality conditions of the calibration to be fulfilled such that the repetition of the calibration steps ii a) to ii e) is stopped are that all evaluated values of a shift of the peak position $\Delta m(m_{check})$ of the mass selecting mode of the detected selected masses $m_{check}$ are below the critical threshold $\Delta m_{max}$ and all deviations of the filter window width $\Delta w(m_{check})$ of the mass selecting mode of the measured selected masses m are below the second critical threshold $\Delta w_{max}$.

The repetition of the calibration steps ii a) to ii e) is executed according to the decision until all quality conditions of the calibration are fulfilled the calibration steps ii a) to ii e) have been executed 10 times ($N_{rep}=10$). The number N defining the number of calibration runs after which the calibration is finished is set during the setting of the calibration parameters 260 to the value N=10.

If all quality conditions of the calibration are fulfilled the calibration by the steps ii a) to ii e) is finished and a RF voltage with an amplitude given by the function $RF_{fit}(m, w_{cal})$ as calibration function and a DC voltage given by the function $DC_{fit}(m, w_{cal})$ as calibration function is applied to electrodes of the first quadrupole 104 afterwards during the measurement with the mass spectrometer calibrated with the method according to the invention. So the functions function $RF_{fit}(m, w_{cal})$ and $DC_{fit}(m, w_{cal})$ fitted in the last step ii b) 262 have been defined as suitable calibration functions with which the first quadrupole 104 can be operated as a preselecting mass analyzer in a mass selecting mode selecting masses in a mass filter window having a filter window width $w_{cal}$.

If on the other hand the calibration steps ii a) to ii e) have been executed 6 times and after that not all quality conditions of the calibration are fulfilled the calibration is stopped because it was not successful. In this case the inventive method for calibrating a mass spectrometer 101 may be started again having a different setting of the calibration parameters like different initial functions of the amplitude of the RF voltage $RF_{ini}(m, w_{cal})$ and the DC voltage $DC_{ini}(m, w_{cal})$, a new set of the several selected masses $M_{cal}$ to determine individually corresponding value of the amplitude of the RF voltage $RF_{det}(m_{cal})$ and value of DC voltage $DC_{det}(m_{cal})$ applied to the electrodes of the first quadrupole 104, a new set of masses $M_{check}$ for which the check of the fitted functions $RF_{fit}(m, w_{cal})$ and $DC_{fit}(m, w_{cal})$ is performed, a new fitting procedure using e.g. a modified fitting function or another fitting algorithm, new quality conditions or an higher number of possible repetitions N of the calibration steps.

The calibrating of the first quadrupole 4 may be repeated after changing at least one kind of function used in calibration step ii b) 262 to fit a function $RF_{fit}(m,w_{cal})$ of the selected mass m to the values of the amplitude of the RF voltage $RF_{det}(m_{cal})$ corresponding to the several selected masses $m_{cal}$ and to fit a function $DC_{fit}(m,w_{cal})$ of the selected mass m to the values of DC voltage $DC_{det}(m_{cal})$ corresponding to the several selected masses $m_{cal}$ or after changing at least one of the quality conditions of the calibration when not all quality conditions of the calibration are fulfilled after the calibration steps ii a) to ii e) have been executed 6 times.

The calibration may be started again after 6 repetitions of the calibration with the aim to find calibration functions by changing the kind of function fitted to the values of the amplitude of the RF voltage $RF_{det}(m_{cal})$ corresponding to the several selected masses $m_{cal}$ or values of DC voltage $DC_{det}(m_{cal})$ corresponding to the several selected masses $m_{cal}$.

The calibrating of the first quadrupole 104 may be repeated after changing at least one function of the initial function $RF_{ini}(m,w_{cal})$ for the first function RF(m,w) and the initial function $DC_{ini}(m,w_{cal})$ for the second function DC(m, w) at the beginning of the calibration of the first quadrupole in the mass selecting mode when not all quality conditions of the calibration are fulfilled after the calibration steps ii a) to ii e) have been executed 6 times. In this embodiment the calibration is started again after 6 repetitions of the calibration with the aim to find calibration functions by starting the calibration again with at least the changed initial function $RF_{ini}(m,w_{cal})$ or $DC_{ini}(m,w_{cal})$.

The step ii) 22 of calibrating the first quadrupole 4 in the mass selecting mode with the inventive method can repeated several times for different values of the filter window width $w_{cal}$ in the range between 2 u and 30 u, preferable in the range between 5 u and 20 u and particular preferable in the range between 8 u and 15 u.

The invention claimed is:

1. A method of operating a mass spectrometer, comprising:

i) calibrating a mass analyzer at a first time $t_1$ while operating a first quadrupole in a transmission mode in which ions are not mass selected, ii) calibrating the first quadrupole in a mass selecting mode selecting masses in a mass filter window having a filter window width $w_{cal}$ at a second time $t_2$ later than the first time $t_1$ when the mass analyzer is operated in a mass analysing mode, wherein calibrating the first quadrupole comprises the steps of:

ii a) determining individually for each of several selected masses $m_{cal}$ a corresponding value of an amplitude of the RF voltage $RF_{det}(m_{cal})$ and value of DC voltage $DC_{det}(m_{cal})$ applied to the electrodes of the first quadrupole, ii b) fitting a function $RF_{fit}(m, w_{cal})$ of a selected mass m to values of the amplitude of the RF voltage $RF_{det}(m_{cal})$ corresponding to the several selected masses $m_{cal}$ and $DC_{fit}(m, w_{cal})$ of the selected mass m to the values of DC voltages $DC_{det}(m_{cal})$ corresponding to the several selected masses $m_{cal}$, ii c) detecting one or more selected masses ($m_{check}$) at a detection means via the mass analyzer operating in a mass analysing mode during scanning the first quadrupole operating as a pre-selecting analyzer in the mass selecting mode, selecting masses in the mass filter window having the filter window width $w_{cal}$ over a mass range $\rho_{mass_m_check}$ assigned to the mass $m_{check}$, comprising the mass $m_{check}$ and being larger than the filter window width $w_{cal}$ of the mass filter window of the mass selecting mode of the first quadrupole, the amplitude of the RF voltage applied to the electrodes of the first quadrupole given by a function $RF_{fit}(m, w_{cal})$ and a DC voltage applied to the electrodes of the first quadrupole given by a function $DC_{fit}(m, w_{cal})$;

ii d) evaluating for each of these detected masses $m_{check}$ a shift of the peak position $\Delta m(m_{check})$ or a deviation of a filter window width $\Delta w(m_{check})$ of the mass selecting mode of the first quadrupole selecting masses in the mass filter window having the filter window width $w_{cal}$, when applying a RF voltage with an amplitude given by the function $RF_{fit}(m, w_{cal})$ and the DC voltage given by a function $DC_{fit}(m, w_{cal})$; and, ii e) if evaluated values of the shift of the peak position $\Delta m(m_{check})$ or the deviation of the filter window width $\Delta w(m_{check})$ of the detected masses $m_{check}$ do not comply with a quality condition of a calibration or if another repetition condition is fulfilled, repeating calibration steps ii a) to ii e) until all quality conditions of the calibration are fulfilled and no repetition condition is fulfilled or the calibration steps ii a) to ii e) have been executed N times and iii) after completion of the calibration steps, operating the first quadrupole to filter ions using RF and DC voltages determined respectively by the $RF_{fit}(m, w_{cal})$ and $DC_{fit}(m,w_{cal})$ functions derived in step iib).

2. The method of claim 1 wherein the mass analyzer is a second quadrupole, a time-of-flight mass analyser, an ion trap, an orbitrap, or an ion cyclotron resonance cell.

3. The method of claim 2 wherein the mass spectrometer comprises a third quadrupole.

4. The method of claim 3 wherein during the calibration of the first quadrupole in the mass selecting mode the third quadrupole is operated in a transmission mode.

5. The method of claim 1 wherein the mass spectrometer further comprises a reaction cell, which is located between the first quadrupole and the mass analyzer and is passed by the ions ejected from an ion source which are moved on trajectories to the detection means.

6. The method of claim 5 wherein the reaction cell is a collision and/or fragmentation cell.

7. The method of claim 5 wherein the reaction cell comprises a quadrupole.

8. The method of claim 1 wherein the first quadrupole is calibrated in the mass selecting mode to have a filter window width $w_{cal}$ between 2 u and 30 u.

9. The method of claim 8 wherein the step ii) of calibrating the first quadrupole in the mass selecting mode is repeated several times for different values of the filter window width $w_{cal}$ in the range between 2 u and 30 u.

10. The method of claim 1 wherein at the beginning of the calibration of the first quadrupole in the mass selecting mode an initial function $RF_{ini}(m, w_{cal})$ for the first function $RF(m, w_{cal})$ and an initial function $DC_{ini}(m, w_{cal})$ for the second function $DC(m, w_{cal})$ is used.

11. The method of claim 1 wherein for two selected masses $m_{coarse}$ a corresponding value of the amplitude of the RF voltage $RF_{det}(m_{coarse})$ and value of DC voltage $DC_{det}(m_{coarse})$ is determined individually before for several selected masses $m_{cal}$ a corresponding value of the amplitude of the RF voltage $RF_{det}(m_{cal})$ and value of DC voltage $DC_{det}(m_{cal})$ is determined individually (step ii a)).

12. The method of claim 11 wherein after for the two selected masses $m_{coarse}$ a corresponding value of the amplitude of the RF voltage $RF_{det}(m_{coarse})$ and value of DC voltage $DC_{det}(m_{coarse})$ is determined individually a function $RF_{coarse}(m, w_{cal})$ being a summation of a constant value $RFoffset_{2_fit}$ and a linear function of the selected mass m is fitted to the values of the amplitudes of the RF voltage $RF_{det}(m_{coarse})$ corresponding to the two selected masses $m_{coarse}$ and/or a function $DC_{coarse}(m, w_{cal})$ being a summation of a constant value $DCoffset_{2_fit}$ and a linear function of the selected mass m is fitted to the values of DC voltages $DC_{det}(m_{coarse})$ corresponding to the two selected masses $m_{coarse}$.

13. The method of claim 10 wherein after for the two selected masses $m_{coarse}$ a corresponding value of the amplitude of the RF voltage $RF_{det}(m_{coarse})$ and value of DC voltage $DC_{det}(m_{coarse})$ is determined individually a function $RF_{coarse}(m, w_{cal})$ of the selected mass m is fitted to the values of the amplitudes of the RF voltage $RF_{det}(m_{coarse})$ corresponding to the two selected masses $m_{coarse}$ by changing a linear factor RFlinear and/or a constant offset value RFoffset of the initial function RF $(m, w_{cal})$ and/or a function $DC_{coarse}(m, w_{cal})$ of the selected mass m is fitted to the values of DC voltage $DC_{det}(m_{coarse})$ corresponding to the two selected masses $m_{coarse}$ by changing a linear factor DClinear and/or a constant offset value DCoffset of the initial function $DC_{ini}(m, w_{cal})$.

14. The method of claim 1 wherein the several selected masses moat, for which a corresponding value of the amplitude of the RF voltage $RF_{det}(m_{cal})$ and value of DC voltage $DC_{det}(m_{cal})$ is determined individually (step ii a)), are 4 to 18 selected masses $m_{cal}$.

15. The method of claim 1 wherein during the individual determination of the corresponding value of the amplitude of the RF voltage $RF_{det}(m_{cal})$ and value of DC voltage $DC_{det}(m_{cal})$ to a selected mass $m_{cal}$ the mass analyzer is filtering the selected mass meal.

16. The method of claim 2 wherein during the individual determination of the corresponding value of the amplitude of the RF voltage $RF_{det}(m_{cal})$ and value of DC voltage $DC_{det}(m_{cal})$ to a selected mass meal the second quadrupole is set to filter the selected mass $m_{cal}$ by selecting masses m in a mass filter window having a filter window width $w_2$ between 0.5 u and 1 u.

17. The method of claim 15 wherein when the selected mass $m_{cal}$ is not transmitted by the mass analyzer and detected by the detection means during the individual determination of the corresponding value of the amplitude of the RF voltage $RF_{det}(m_{cal})$ and value of DC voltage $DC_{det}(m_{cal})$ to the selected mass $m_{cal}$, then the filter window width w of the first quadrupole is increased.

18. The method of claim 17 wherein when the selected mass $m_{cal}$ is not detected by the mass analyzer during the individual determination of the corresponding value of the amplitude of the RF voltage $RF_{det}(m_{cal})$ and value of DC voltage $DC_{det}(m_{cal})$ to the selected mass $m_{cal}$, after the filter window width w of the first quadrupole is extended, then the DC voltage applied to the electrodes of the first quadrupole is decreased stepwise until the selected mass $m_{cal}$ is detected by the mass analyzer.

19. The method of claim 18 wherein the DC voltage applied to the electrodes of the first quadrupole is decreased stepwise in that in the second function DC(m, w) which is defining the DC voltage, a constant offset value DCoffset is lowered stepwise until the selected mass is detected by the mass analyzer.

20. The method of claim 17 wherein when the selected mass $m_{cal}$ is analysed by the mass analyzer and detected by the detection means and the peak width w of the selected mass $m_{cal}$ is bigger than a first maximum peak width $w_{max}$, the constant offset value DCoffset of the second function DC(m, w) is increased stepwise until the filter window width w of the first quadrupole is below a filter window width $w_{min}$ of the mass selecting mode to be calibrated.

21. The method of claim 15 wherein during the individual determination of the corresponding value of the amplitude of the RF voltage $RF_{det}(m_{cal})$ and value of DC voltage $DC_{det}(m_{cal})$ to a selected mass meal the first quadrupole is scanned over a mass range $\rho_{mass}$ comprising the selected mass meal applying the RF amplitude and the DC voltage to the electrodes of the first quadrupole according to the first function $RF(m, w_{cal})$ and the a second function $DC(m, w_{cal})$ for the masses m of the mass range $\rho_{mass}$.

22. The method of claim 21 wherein after the scanning of the first quadrupole over the mass range $\rho_{mass}$ it is evaluated for which masses $m_{set}$ of the mass range $\rho_{mass}$ when set at the first function of the amplitude of the $RF(m, w_{cal})$ and the second function of the DC voltage $DC(m, w_{cal})$ to apply the RF voltage and DC voltage at the first quadrupole the detection means is detecting the selected mass meal.

23. The method of claim 22 wherein after the evaluation at which masses $m_{set}$ of the mass range $\rho_{mass}$ the detection means is detecting the selected mass meal the shift of the peak position $\Delta m(m_{cal})$ of the selected mass meal is evaluated.

24. The method of claim 23 wherein the evaluation of the shift of the peak position $\Delta m(m_{cal})$ of the selected mass $m_{cal}$ is performed by calculating the difference between the mass $m_{set_c}$ at the center of the masses $m_{set}$ at which the detection means is detecting the selected mass meal and the selected mass meal.

25. The method of claim 23 wherein during the individual determination of the corresponding value of the amplitude of the RF voltage $RF_{det}(m_{cal})$ and value of DC voltage $DC_{det}(m_{cal})$ to a selected mass meal the individual definition of a corresponding the amplitude of the RF voltage $RF_{det}(m_{cal})$ and DC voltage $DC_{det}(m_{cal})$ (step ii a)) of the selected mass $m_{cal}$ is done by changing the value of the first function $RF(m_{cal}, w_{cal})$ and/or the value of the second function $DC(m_{cal}, w_{cal})$ corresponding to the selected mass meal depending on the shift of the peak position $\Delta m(m_{cal})$ of the selected mass meal.

26. The method of claim 25 wherein the individual determination of a corresponding value of the amplitude of the RF voltage $RF_{det}(m_{cal})$ and value of the DC voltage $DC_{det}(m_{cal})$ of the selected mass meal is done by adding to the value of the first function $RF(m_{cal}, w_{cal})$ and/or the value of the second function $DC(m_{eah} w_{cal})$ corresponding to the selected mass meal the value the shift of the peak position $\Delta m(m_{cal})$ of the selected mass $m_{cal}$ multiplied with a factor corresponding to the amplitude of the RF voltage $RFfactor_{p_shift}$ and/or DC voltage $DCfactor_{p_shift}$.

27. The method of claim 23 wherein after the evaluation at which masses $m_{set}$ of the mass range $\rho_{mass}$ the detection means is detecting the selected mass meal the deviation of the filter window width $\Delta w(m_{cal})$ of the selected mass $m_{cal}$ is evaluated.

28. The method of claim 27 wherein the evaluation of the deviation of the filter window width $\Delta w(m_{cal})$ of the selected mass $m_{cal}$ is performed by evaluating a mass range $\rho_{massdetect}(m_{cal})$ of the masses $m_{set}$ set at the first function of the amplitude of the $RF(m, w_{cal})$ and the second function of the DC voltage $DC(m, w_{cal})$ to apply the RF voltage and DC voltage at the first quadrupole for which the detection means is detecting the selected mass meal and calculating the difference $\Delta w(m_{cal})$ between the mass range $\rho_{massdetect}(m_{cal})$ and the filter window width $w_{cal}$ for which the first quadrupole has to be calibrated.

29. The method of claim 28 wherein the evaluation of the mass range $\rho_{massdetect}(m_{cal})$ is performed by evaluating the masses $m_{set}$ set at the first function of the amplitude of the $RF(m, w_{cal})$ and the second function of the DC voltage $DC(m, w_{cal})$ to apply the RF voltage and DC voltage at the first quadrupole for which the detection means is detecting a signal higher than a minimum detection value.

30. The method of claim 27 wherein during the individual determination of the corresponding value of the amplitude of the RF voltage $RF_{det}(m_{cal})$ and value of DC voltage $DC_{det}(m_{cal})$ to a selected mass meal the individual determination of a corresponding the amplitude of the RF voltage $RF_{det}(m_{cal})$ and DC voltage $DC_{det}(m_{cal})$ (step ii a)) of the selected mass $m_{cal}$ is done by changing the value of the first function $RF(m_{cal}, w_{cal})$ and/or the value of the second function $DC(m_{cal}, w_{cal})$ corresponding to the selected mass meal depending on the deviation of the filter window width $\Delta w(m_{cal})$ of the selected mass meal.

31. The method of claim 30 wherein the individual determination of a corresponding value of the amplitude of the RF voltage $RF_{det}(m_{cal})$ and value of the DC voltage $DC_{det}(m_{cal})$ of the selected mass $m_{cal}$ is done by adding to the value of the first function $RF(m_{cal}, w_{cal})$ and/or the value of the second function $DC(m_{cal}, w_{cal})$ corresponding to the selected mass meal the value the deviation of the filter window width $\Delta w(m_{cal})$ of the selected mass $m_{cal}$ multiplied with a factor corresponding to the RF voltage $\Delta$w-factor$_{RF}$ and/or DC voltage $\Delta$w-factor$_{DC}$.

32. The method of claim 30 wherein the individual determination of a corresponding value of the amplitude of the RF voltage $RF_{det}(m_{cal})$ of the selected mass $m_{cal}$ is done by adding to the value of the first function $RF(m_{cal}, w_{cal})$ corresponding to the selected mass meal the value of the deviation of the filter window width $\Delta w(m_{cal})$ of the selected mass $m_{cal}$ multiplied with a linear factor DClinear of the second function $DC(m, w_{cal})$ divided by a linear factor RFlinear of the first function $RF(m, w_{cal})$.

33. The method of claim 31 wherein during a repetition of the calibration steps ii a) to ii e) the factor $\Delta$w-factor$_{DC}$ with which the value the deviation of the filter window width $\Delta w(m_{cal})$ of the selected mass $m_{cal}$ is multiplied and then added to the value of the second function $DC(m_{cal}, w_{cal})$ of the selected mass $m_{cal}$ to individually determine the DC voltage $DC(m_{cal}, w_{cal})$ of the selected mass $m_{cal}$ is changed.

34. The method of claim 33 wherein the change of the factor $\Delta$w-factor$_{DC}$ during a repetition of the calibration steps ii a) to ii e) is such indicates that the determination of the DC voltage $DC(m_{cal}, w_{cal})$ of the selected mass $m_{cal}$ is converging.

35. The method of claim 33 wherein the factor $\Delta$w-factor$_{DC}$ during the repetition of the calibration steps ii a) to ii e) is only changed if during the repetition of the calibration steps ii a) to ii e) it is observed that the deviation of the filter window width $\Delta w(m_{cal})$ of the selected mass meal has not changed compared to the previous calibration steps such that the deviation of the filter window width $\Delta w(m_{cal})$ of the selected mass $m_{cal}$ is converging.

36. The method of claim 1 wherein the individual determination of the corresponding value of the amplitude of the RF voltage $RF_{det}(m_{cal})$ and value of DC voltage $DC_{det}(m_{cal})$ to a selected mass $m_{cal}$ (step ii a)) is done by adding an offset to the value of the first function $RF(m_{cal},w_{cal})$ and/or the value of the second function $DC(m_{cal},w_{cal})$ corresponding to the selected mass meal.

37. The method of claim 1 wherein when fitting a function $RF_{fit}(m,w_{cal})$ of the selected mass m to the values of the amplitude of the RF voltage $RF_{det}(m_{cal})$ corresponding to the several selected masses $m_{cal}$ (step ii b)) the function $RF_{fit}(m,w_{cal})$ is summation of a constant $RFoffset_{fit}$ and a linear function of the selected mass m.

38. The method of claim 1 wherein when fitting a function $DC_{fit}(m,w_{cal})$ of the selected mass m to the values of DC voltage $DC_{det}(m_{cal})$ corresponding to the several selected masses $m_{cal}$ (step ii b)) the function $DC_{fit}(m,w_{cal})$ is a summation of a constant value $DCoffset_{fit}$ and a linear function of the selected mass m.

39. The method of claim 1 wherein when fitting a function $RF_{fit}(m,w_{cal})$ of the selected mass m to the values of the amplitude of the RF voltage $RF_{det}(m_{cal})$ corresponding to the several selected masses $m_{cal}$ (step ii b)) the function $RF_{fit}(m,w_{cal})$ is a sum of functions comprising one of the following: a linear function of the selected mass m, a quadratic function of the selected mass m, an exponential function of the selected mass m, an exponential function whose exponent is a linear function of the selected mass m, or at least two exponential functions whose exponents are different linear functions of the selected mass m.

40. The method of claim 1 wherein when fitting a function $RF_{fit}(m,w_{cal})$ of the selected mass m to the values of the amplitude of the RF voltage $RF_{det}(m_{cal})$ corresponding to the several selected masses $m_{cal}$ (step ii b)) the function $RF_{fit}(m,w_{cal})$ is a sum of functions containing only two exponential functions whose exponents are different linear functions of the selected mass m.

41. The method of claim 1 wherein when fitting a function $DC_{fit}(m,w_{cal})$ of the selected mass m to the values of DC voltage $DC_{det}(m_{cal})$ corresponding to the several selected masses $m_{cal}$ (step ii b)) the function $DC_{fit}(m,w_{cal})$ is a sum of functions comprising one of the following: a linear function of the selected mass m, a quadratic function of the selected mass m, an exponential function of the selected mass m, a linear function of the selected mass m, or at least two exponential functions whose exponents are different linear functions of the selected mass m.

42. The method of claim 1 wherein when fitting a function $DC_{fit}(m,w_{cal})$ of the selected mass m to the values of DC voltage $DC_{det}(m_{cal})$ corresponding to the several selected masses meal (step ii b)) the function $DC_{fit}(m,w_{cal})$ is a sum of functions containing only two exponential functions whose exponents are different linear functions of the selected mass m.

43. The method of claim 1 wherein when fitting a function $RF_{fit}(m,w_{cal})$ of the selected mass m to the values of the amplitude of the RF voltage $RF_{det}(m_{cal})$ corresponding to the several selected masses $m_{cal}$ and fitting a function $DC_{fit}(m,w_{cal})$ of the selected mass m to the values of DC voltage $DC_{det}(m_{cal})$ corresponding to the several selected masses $m_{cal}$ (step ii b)) the function $RF_{fit}(m,w_{cal})$ is the summation of a constant value $RFoffset_{fit}$, a linear function of the selected mass m, a quadratic function of the selected mass m and two exponential functions whose exponents are different linear functions of the selected mass m and the function $DC_{fit}(m,w_{cal})$ is the summation of a constant value $DCoffset_{fit}$,a linear function of the selected mass m, a quadratic function of the selected mass m and two exponential functions whose exponents are different linear functions of the selected mass m.

44. The method of claim 1 wherein when some masses and/or at least some of the several selected masses $m_{check}$ are detected at the detection means via the mass analyzer operating in a mass analysing mode during scanning the first quadrupole operating as pre-selecting analyzer in the mass selecting mode selecting masses in the mass filter window having the filter window width $w_{cal}$ over a mass range $\rho_{mass_m_check}$ assigned to the mass $m_{check}$, comprising the mass $m_{check}$ and being larger than the filter window width w the mass filter window of the mass selecting mode of the first quadrupole, the amplitude of the RF voltage applied to the electrodes of the first quadrupole given by the function $RF_{fit}(m)$ and the DC voltage applied to the electrodes of the first quadrupole given by the function $DC_{fit}(m)$ (step ii c)) all of the several selected masses $m_{cal}$ for which a corresponding value of the amplitude of the RF voltage $RF_{det}(m_{cal})$ and value of DC voltage $DC_{det}(m_{cal})$ is determined individually are scanned with the first quadrupole and detected at the detection means.

45. The method of claim 1 wherein after the scanning of the first quadrupole over the mass range $\rho_{mass_m_check}$ (step ii c) it is evaluated for which masses $m_{set_m_check}$ of the mass range $\rho_{mass_m_check}$ when set at the first function of the amplitude of the $RF_{fit}(m, w_{cal})$ and the second function of the DC voltage $DC_{fit}(m, w_{cal})$ to apply the RF voltage and DC voltage at the first quadrupole the detection means is detecting the mass $m_{check}$.

46. The method of claim 45 wherein the evaluation of the shift of the peak position $\Delta m(m_{check})$ of the detected masses $m_{check}$ (step ii d)) is performed by calculating the difference between the mass $m_{set_m_check_c}$ at the center of the scanned masses $m_{set_m_check}$ at which the detection means is detecting the mass $m_{check}$ and the mass $m_{check}$.

47. The method of claim 45 wherein the evaluation of the deviation of the filter window width $\Delta w(m_{check})$ of the detected mass $m_{check}$ (step ii d)) is performed by evaluating a filter window width $w_{check}(m_{check})$ from the masses $m_{set_m_check}$ of the mass range $\rho_{mass_m_check}$ at which the detection means is detecting the mass $m_{check}$ and calculating the difference between the filter window width $w_{check}$ $(m_{check})$ and the filter window width $w_{cal}$ for which the first quadrupole has to be calibrated.

48. The method of claim 1 wherein the repetition condition to be fulfilled such that the repetition of the calibration steps ii a) to ii e) is stopped is that the calibration steps ii a) to ii e) has been repeated one time.

49. The method of claim 1 wherein the quality condition of the calibration to be fulfilled such that the repetition of the calibration steps ii a) to ii e) is stopped is that all evaluated values of a shift of the peak position $\Delta m(m_{check})$ of the mass selecting mode of the detected masses $m_{check}$ are below a critical threshold $\Delta m_{max}$ and all deviations of the filter window width $\Delta w(m_{check})$ of the mass selecting mode of the measured selected masses m are below a second critical threshold $\Delta w_{max}$.

50. The method of claim 49 wherein if the quality conditions are not fulfilled the calibration steps ii a) to ii e) are repeated, using in step ii a) in the mass selecting mode of the first quadrupole the functions $RF_{fit}(m,w_{cal})$ as the first function RF(m,w) and $DC_{fit}(m,w_{cal})$ as the second function DC(m,w), determining individually corresponding values of the amplitude of the RF voltage $RF_{det}(m_{cal})$ and corresponding values of DC voltage $DC_{det}(m_{cal})$ only for such of the detected masses $m_{check}$ for which the evaluated value of the shift of the peak position $\Delta m(m_{check})$ of the mass selecting mode is not below a critical threshold $\Delta m_{max}$ or the deviation of the filter window width $\Delta w(m_{check})$ of the mass selecting mode is not below a second critical threshold $\Delta w_{max}$.

51. The method of claim 1 wherein when not all quality conditions of the calibration are fulfilled after the calibration steps ii a) to ii e) have been executed N times the calibrating of the first quadrupole is repeated after changing at least one kind of function used in calibration step ii b) to fit a function $RF_{fit}(m,w_{cal})$ of the selected mass m to the values of the amplitude of the RF voltage $RF_{det}(m_{cal})$ corresponding to the several selected masses meal and to fit a function $DC_{fit}(m,w_{cal})$ of the selected mass meal to the values of DC voltage $DC_{det}(m_{cal})$ corresponding to the several selected masses m or after changing at least one of the quality conditions of the calibration.

* * * * *